US012310541B2

(12) United States Patent
Gori et al.

(10) Patent No.: US 12,310,541 B2
(45) Date of Patent: May 27, 2025

(54) MODULAR SHOWER BASE KIT

(71) Applicant: Leaf Home Safety Solutions, Hudson, OH (US)

(72) Inventors: Michael Gori, Norton, OH (US); Thomas Victor Czerny, Streetsboro, OH (US)

(73) Assignee: Leaf Home Safety Solutions, Hudson, OH (US)

( * ) Notice: Subject to any disclaimer, the term of this patent is extended or adjusted under 35 U.S.C. 154(b) by 217 days.

(21) Appl. No.: 18/163,102

(22) Filed: Feb. 1, 2023

(65) Prior Publication Data

US 2024/0251998 A1 Aug. 1, 2024

(51) Int. Cl.
*A47K 3/28* (2006.01)
*A47K 3/40* (2006.01)

(52) U.S. Cl.
CPC ..... *A47K 3/284* (2013.01); *A47K 3/40* (2013.01)

(58) Field of Classification Search
CPC ..... A47K 3/40; A47K 3/284
USPC ..... 4/614, 612, 596
See application file for complete search history.

(56) References Cited

U.S. PATENT DOCUMENTS 4,215,444 A * 8/1980 Brown ..... A47K 3/28 4/612
4,348,777 A * 9/1982 Peterson ..... A47K 3/286 4/596
4,477,934 A * 10/1984 Salminen ..... A47K 4/00 4/596
4,553,276 A * 11/1985 Paradis ..... B29C 65/5014 4/596
4,987,619 A * 1/1991 Smith ..... A47K 3/20 4/612
4,989,279 A * 2/1991 Powell ..... A47K 3/284 4/612
8,109,044 B2 * 2/2012 Graber ..... A47K 3/30 52/36.2
8,561,224 B2 * 10/2013 Cook ..... A47K 3/40 4/604
2007/0157538 A1 * 7/2007 DeGarmo ..... A47K 3/40 52/608
2008/0127409 A1 * 6/2008 Rooke ..... A47K 3/40 4/614
2008/0222793 A1 * 9/2008 Cook ..... A47K 3/40 4/612

(Continued)

FOREIGN PATENT DOCUMENTS

EP 2060377 A2 * 5/2009 ..... A47K 3/40
WO WO-2021163431 A1 * 8/2021 ..... A47K 3/40
WO WO-2022046880 A1 * 3/2022 ..... A47K 3/284

*Primary Examiner* — Lori L Baker
(74) *Attorney, Agent, or Firm* — Benesch Friedlander Coplan & Aronoff LLP

(57) ABSTRACT

A modular shower base kit includes configurable and compatible components including shower bases and shower perimeter components. The shower perimeter components are arranged to attach to edges of a shower base and subsequently secure the shower base to various shower enclosures such as panels, walls, and doors. A shower base may include an integrated threshold along one edge of the shower base. A shower base kit may include multiple independent thresholds that are arranged to be selectively attached to the shower base. Such attachment is facilitated by a threshold brackets and threshold gaskets.

24 Claims, 52 Drawing Sheets

(56) References Cited

U.S. PATENT DOCUMENTS

| | | | | |
|---|---|---|---|---|
| 2008/0222797 | A1* | 9/2008 | Cook | A47K 3/40 4/613 |
| 2009/0241258 | A1* | 10/2009 | Cook | A47K 3/00 29/428 |
| 2009/0260151 | A1* | 10/2009 | Graber | A47K 3/30 4/599 |
| 2010/0263188 | A1* | 10/2010 | Cook | A47K 3/283 29/428 |
| 2011/0088161 | A1* | 4/2011 | Stimpson | A47K 3/405 4/613 |
| 2013/0205685 | A1* | 8/2013 | Leatherman | E04H 1/1266 52/79.1 |
| 2013/0276226 | A1* | 10/2013 | Cook | A47K 3/40 4/613 |
| 2014/0175700 | A1* | 6/2014 | Cook | B29C 45/376 264/297.1 |
| 2016/0037973 | A1* | 2/2016 | Cook | A47K 4/00 29/428 |
| 2016/0166119 | A1* | 6/2016 | McDonald | A47K 3/281 4/614 |
| 2018/0103806 | A1* | 4/2018 | Smith | A47K 3/284 |
| 2018/0184854 | A1* | 7/2018 | Salvatore | A47K 3/40 |
| 2020/0100624 | A1* | 4/2020 | Smith | A47K 3/40 |
| 2022/0192433 | A1* | 6/2022 | Cook | A47K 3/40 |
| 2023/0240479 | A1* | 8/2023 | Murray | A47K 3/40 4/613 |
| 2023/0320535 | A1* | 10/2023 | Leavitt | A47K 3/284 4/614 |
| 2024/0065490 | A1* | 2/2024 | Gori | A47K 3/284 |

* cited by examiner

MODULAR SHOWER BASE KIT

FIELD OF INVENTION

The present disclosure generally relates to methods and systems for forming a shower base assembly from a modular shower base kit comprising configurable and compatible components. More specifically, the present disclosure relates to methods and systems for efficiently manufacturing, transporting, inventorying, sourcing, distributing, and delivering a modular shower base kit comprising configurable and compatible components to construct and install a shower base assembly in a preexisting structure.

BACKGROUND

In recent years, the requirements and demands of the residential home remodeling and home improvement markets have evolved to include a broader demographic and an ever-growing variety of services. Traditionally, most consumers could justify the cost of remodeling a home because remodeling increases the value of the home, repairs defects to the home, improves energy efficiency, and/or updates the aesthetic styling and amenities of the home. However, with the increased aging of the world's population, particularly in industrialized countries, more and more consumers are remodeling homes to satisfy aging consumers' desires to safely remain in their homes longer despite physical limitations that come with aging. The same can be said for younger people with mobility limitations caused by injury or ailment. In addition to the understandable desire to continue to live independently, the cost of in-home care, assisted living facilities, and other such alternatives often provide an economic incentive for aging and mobility-limited consumers to remodel their residential homes.

As noted, today's older consumers are more independent and commonly choose to remain in their residential home much longer than prior generations. In one estimate, the number of Americans over the age of 65 will increase from 54 million in 2020 to 80 million in 2040, which includes a more than doubling of Americans over the age of 85 from 7 million to 15 million. This growth in the number of aging Americans has a proportional effect on the number of homeowners over the age of 65. In the last decade or so, the number of homeowners over the age of 65 has increased by 9 million (roughly a 35% increase since 2010), and it is expected that this number will grow by an additional 19.3 million in the next decade (roughly a 40% increase over 2020). As the population ages, many more home remodeling projects will focus on making the home safer for aging Americans, particularly those with mobility imitations, that desire to remain in their homes. Even today, 45% of consumers cite making a home safer and more useable for an aging or mobility-limited resident as one of the reasons for remodeling a home. This percentage is sure to grow in the coming years and decades.

While there are often many projects required to make a home safe and efficient for an aging resident, one room that is the sensible focus of many remodeling projects is the bathroom. The bathroom is of course often used for bathing and showering, which leads to wet and slippery surfaces. In addition, many bathroom surfaces are hard and rigid thus, presenting substantial risk of accidents and resulting injury for aging persons and any other residents with mobility and balance challenges. For any aging or mobility-limited person to remain in his or her residential home, making the bathroom safe and efficient to use must be a high priority.

Most existing homes are designed for raising a family. Most homes include a tub and shower combination 10, such as illustrated in FIG. 1. Such a tub and shower combination 10 makes sense for homes where children are bathed, and agile adults take showers. However, in order for an aging person to use such a tub and shower combination 10, he or she must step over the front wall 20 of the tub portion onto a likely wet and slippery surface. The aging person must maintain his or her balance while supporting themselves on one leg and crossing the other leg over the front wall 20 of the tub portion to enter or exit the tub and shower combination 10. As is readily understood, such situations are ripe for accidents and injury of aging persons and anyone struggling with mobility and balance issues.

Even when a home includes a traditional single purpose shower 30, such as illustrated in FIG. 2, danger is present. Although there is no tub wall to present an obstacle, aging or mobility-limited persons must still navigate wet and slippery surfaces without the benefit or aid of secure locations to grasp to maintain balance and avoid accidents. As illustrated in FIG. 2, most single purpose showers 30 do not traditionally include grab bars or non-slippery surfaces to assist those with mobility and balance challenges. To retrofit a traditional single purpose shower with safety features, particularly an older single purpose shower made from materials that have grown brittle and/or fragile over time, may not be a realistic option for many existing homes.

Therefore, remodeling a bathroom by removing an existing shower and tub combination 10 or traditional single purpose shower 30 and installing a new replacement shower that offers safety features is often the best option for an aging or mobility-limited person that desires to continue living independently in a residential home. Current replacement showers for residential homes typically include a monolithic preformed shower base fabricated in a few standard shapes and sizes. If a remodeling project requires a shower base that is other than one of these standard shapes or sizes, a custom build shower base may be required to complete the remodeling project. Such custom built shower bases are expensive and can have significant lead times that can delay a remodeling project.

Shower bases are designed to capture water falling from the showerhead and channel that water to a drain formed in the shower base. Such control of the flow of water prevents water from flowing onto the adjoining floor, where it can cause damage to the structure of the floor and surrounding walls. While prior art shower bases function to effectively control the flow of water to limit potential damage, because such prior art shower bases are preformed as monolithic structures (i.e., once fabricated, non-variable in shape or size), in order to meet the varying demands of the marketplace, many configurations of such prior art shower bases would have to be designed, manufactured, and inventoried to meet the ever growing consumer requirements and demands. The number of variable configurations needed for prior art shower bases to meet all demand of the market is in the thousands. Among the variables to consider include, but are not limited to, color, width and length, threshold height, drain location, and texture of surface. The alternative to designing and fabricating an increasing number of standard shower bases is to fabricate custom shower bases for consumers. However, as noted, custom fabrication adds substantial cost and increased delivery times for a consumer interested in purchasing a shower base. In addition to added costs and increasing time delays, the evolving home remodeling market creates substantial challenges in logistics management throughout the supply chain. Manufacturers need to manage projected volumes for a high number of stock keeping units (SKUs), distributors need to manage the on-sight inventory of such high number of SKUs, and retailers and direct to consumer sales must create a complicated network of distributors in an attempt to decrease the time from the placement of a consumer order for a shower base until that shower base is installed. Currently, it typically takes a few weeks or more from the time a consumer orders a shower base until the delivery and installation of that shower base in the consumer's home.

Therefore, it is desirable to develop a more efficient approach to the design, fabrication, and delivery of shower base assemblies that offers flexibility and variability in size and shape while providing for a shortened time between the placement of a consumer order for a shower base assembly and the installation of that shower base assembly in a consumer's home. Such an efficient approach is needed to meet the market's demands for variable shower bases at a reasonable cost without affecting the overall project schedule for remodeling a bathroom. The modular shower kits described and disclosed herein meet all of these requirements of the evolving home remodeling and improvement market.

SUMMARY

Disclosed herein are a number of embodiments of modular shower base kits comprised of various configurable and compatible components. Examples of such configurable and compatible components include shower bases and shower perimeter components. The shower perimeter components are arranged to attach to edges of a shower base and subsequently secure the shower base to various shower enclosures (such as panels, walls, doors, etc.). In one example, each shower base includes an integrated threshold along one edge of the shower base. In another example, a shower base kit includes multiple independent thresholds that are arranged to be selectively attached to the shower base. Such attachment is facilitated by a threshold brackets and threshold gaskets.

One exemplary embodiment of a modular shower base kit includes a pair of shower bases, a pair of thresholds, a pair of threshold brackets, a pair of threshold gaskets, and three shower perimeter components. The pair of shower bases are sized such that one of the two shower bases can be trimmed to a desired size and desirable drain placement for a shower replacement project. The first shower base is 48 inches by 42 inches and the second shower base is 60 inches by 36 inches. The first shower base includes drain location in the center of the shower base (i.e., equidistant for each opposing side of the shower base), and the second shower base includes a drain location that is off-set (i.e., equidistant from one pair of opposing sides but closer to one side of the other pair of opposing sides). The first shower base can be uses in its original size, 48 inches by 42 inches, or can be cut or trimmed to any desired size down to 12 inches by 12 inches. Such cutting or trimming can be selectively used to change the drain location from centered to off-set to match the preexisting plumbing in the home. The second shower base can be uses in its original size, 60 inches by 36 inches, or can be cut or trimmed to any size down to 26 inches by 24 inches. Such cutting or trimming can be selectively used to change the drain location from its original off-set location to match the preexisting plumbing in the home. Once the shower base is cut to its desired size, one of the thresholds and its corresponding threshold bracket and threshold gasket can be selected and secured to one edge of the shower based using fasteners. The shower base assembly is completed by using fasteners to secure a shower perimeter component to each of other three edges of the shower base in preparation for securing the shower base assembly to shower enclosures and/or the existing interior walls of the home. This embodiment described is but one example of a modular shower base kit and it components. Other examples can include different dimensioned shower bases; more or less shower bases, thresholds, and shower perimeter components; and any number of fasteners and other components used to assembly the shower base assembly.

BRIEF DESCRIPTION OF THE DRAWINGS

In the accompanying drawings, structures are illustrated that, together with the detailed description provided below, describe example embodiments of the disclosed apparatus and methods. Where appropriate, like elements are identified with the same or similar reference numerals. Elements shown as a single component can be replaced with multiple components. Elements shown as multiple components can be replaced with a single component. The drawings may not be to scale. The proportion of certain elements may be exaggerated for the purpose of illustration.

DETAILED DESCRIPTION

Figure 1:
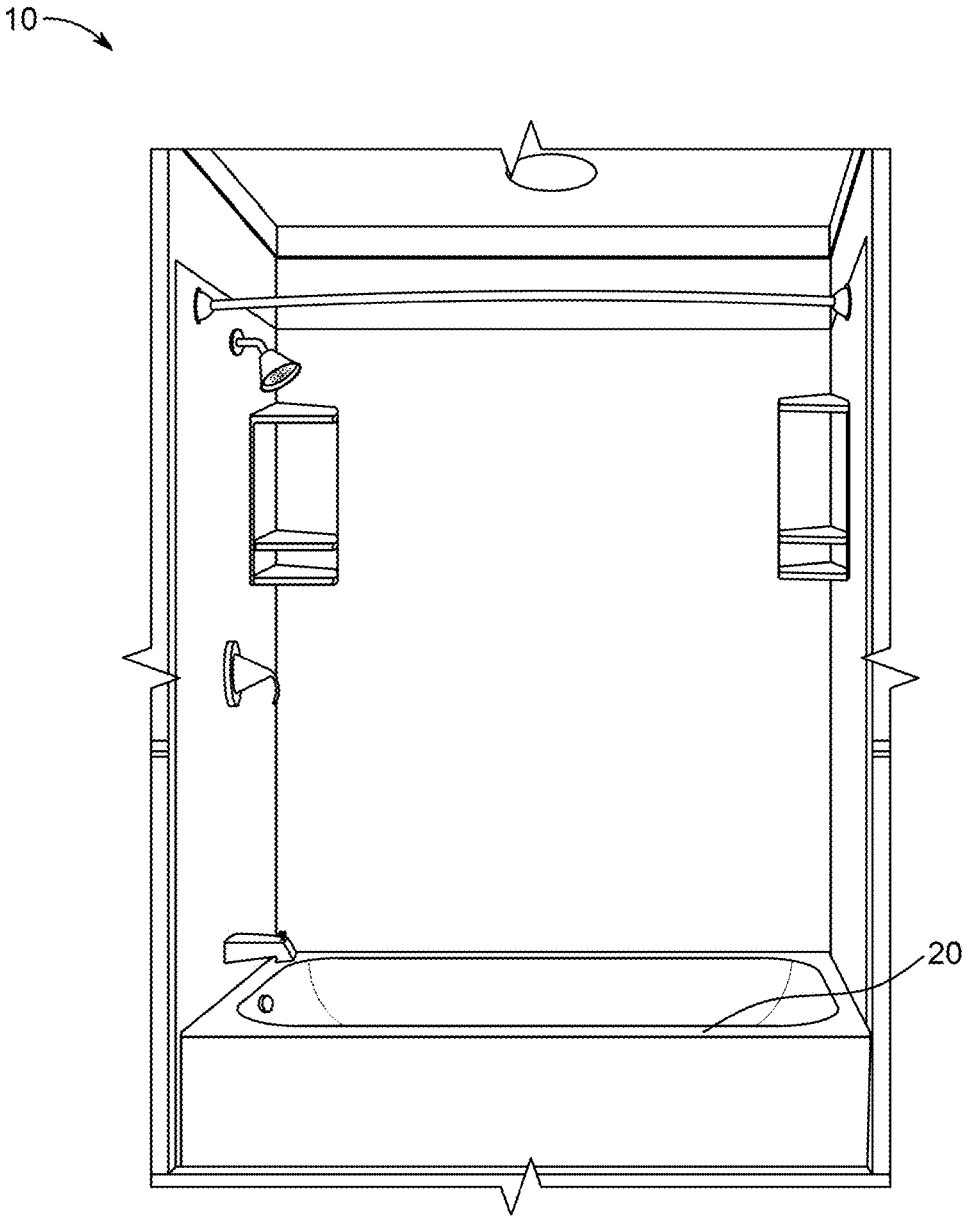
FIG. 1 Prior Art
FIG. 1 is a photograph of a prior art tub and shower combination for use in a residential bathroom.
Figure 2:
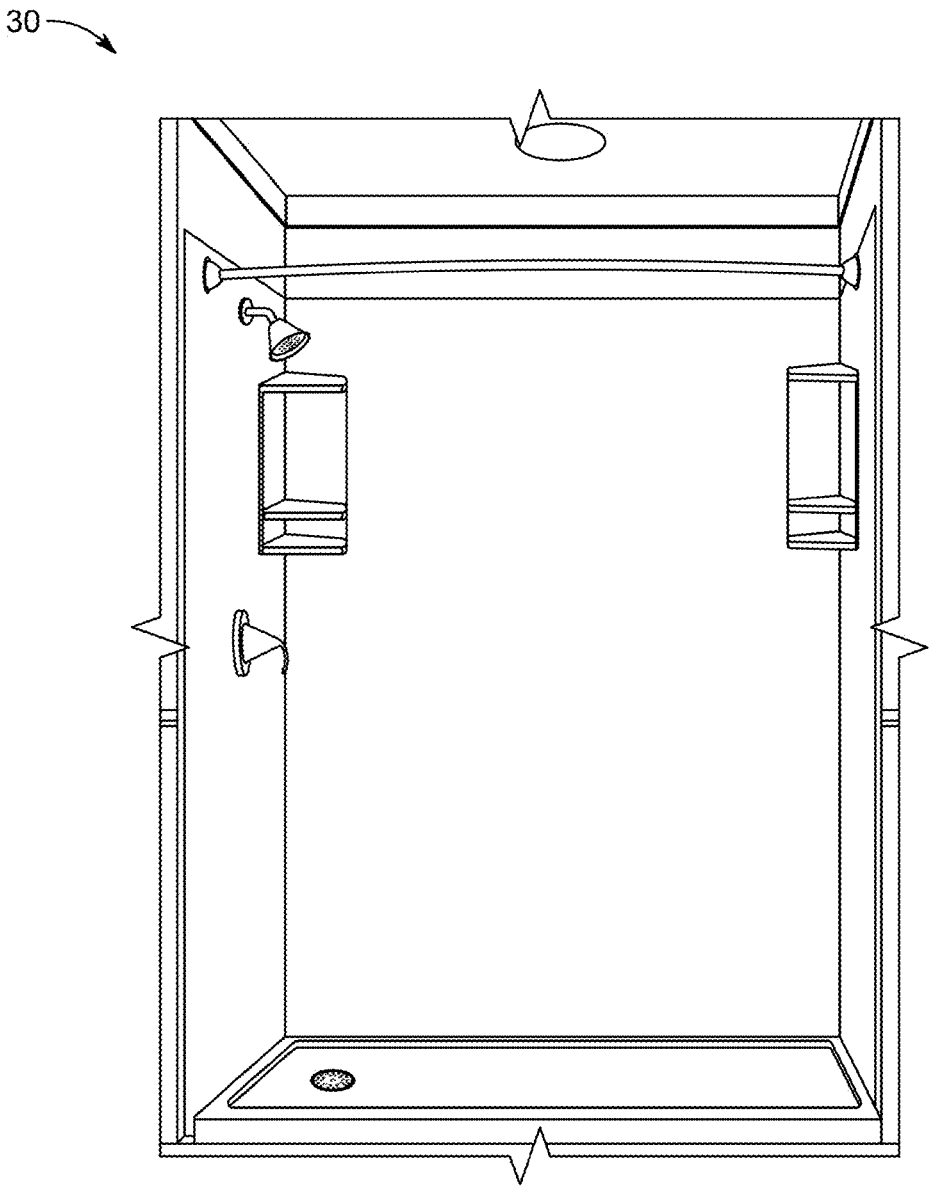
FIG. 2 Prior Art
FIG. 2 is a photograph of a prior art single purpose shower for use in a residential bathroom.

The apparatus, arrangements, and methods disclosed in this document are described in detail by way of examples and with reference to the figures. It will be appreciated that modifications to disclosed and described examples, arrangements, configurations, components, elements, apparatus, methods, materials, etc. can be made and may be desired for a specific application. In this disclosure, any identification of specific techniques, arrangements, method, etc. are either related to a specific example presented or are merely a general description of such a technique, arrangement, method, etc. Identifications of specific details or examples are not intended to be and should not be construed as mandatory or limiting unless specifically designated as such. Selected examples of a modular shower base kit that includes a number of modular components that can be configured and assembled to form a shower base assembly are hereinafter disclosed and described in detail with reference made to FIGS. 1-58.

As will be described in detail herein, this disclosure is directed to embodiments of modular shower base kits arranged to facilitate efficient logistical handling, configuration, and installation of a shower base assembly. In particular, the modular shower base kits disclosed herein can include multiple components that are arranged to be modified to customized shapes and sizes and modularly assembled to form shower base assemblies that meet any variety of needs and requirements. Such modifications and customizations in size and shape can be performed on-site during the installation process by contractors, other such workers, or even homeowners.

Modular shower base kits can include combinations of one or more shower bases, one or more shower perimeter components, one or more threshold components, and an assortment of accessories, all of which are arranged to be modularly assembled to form a shower base assembly. The variability and customization with regard to size, shape, and design of a shower base assembly is facilitated by the modular nature of its components. Prior art shower bases are integrally formed during the manufacturing process, with the perimeter dimensions set and a threshold portion integrally fabricated with the shower base, which rigidly determines the size, shape, and design of the prior art shower base. In the novel embodiments described and disclosed herein, the perimeter dimensions of the shower base itself, along with the size of shower perimeter components and threshold components are variable and can be mixed and matched to create a large number of combinations from a relatively small number of components.

Figure 3:
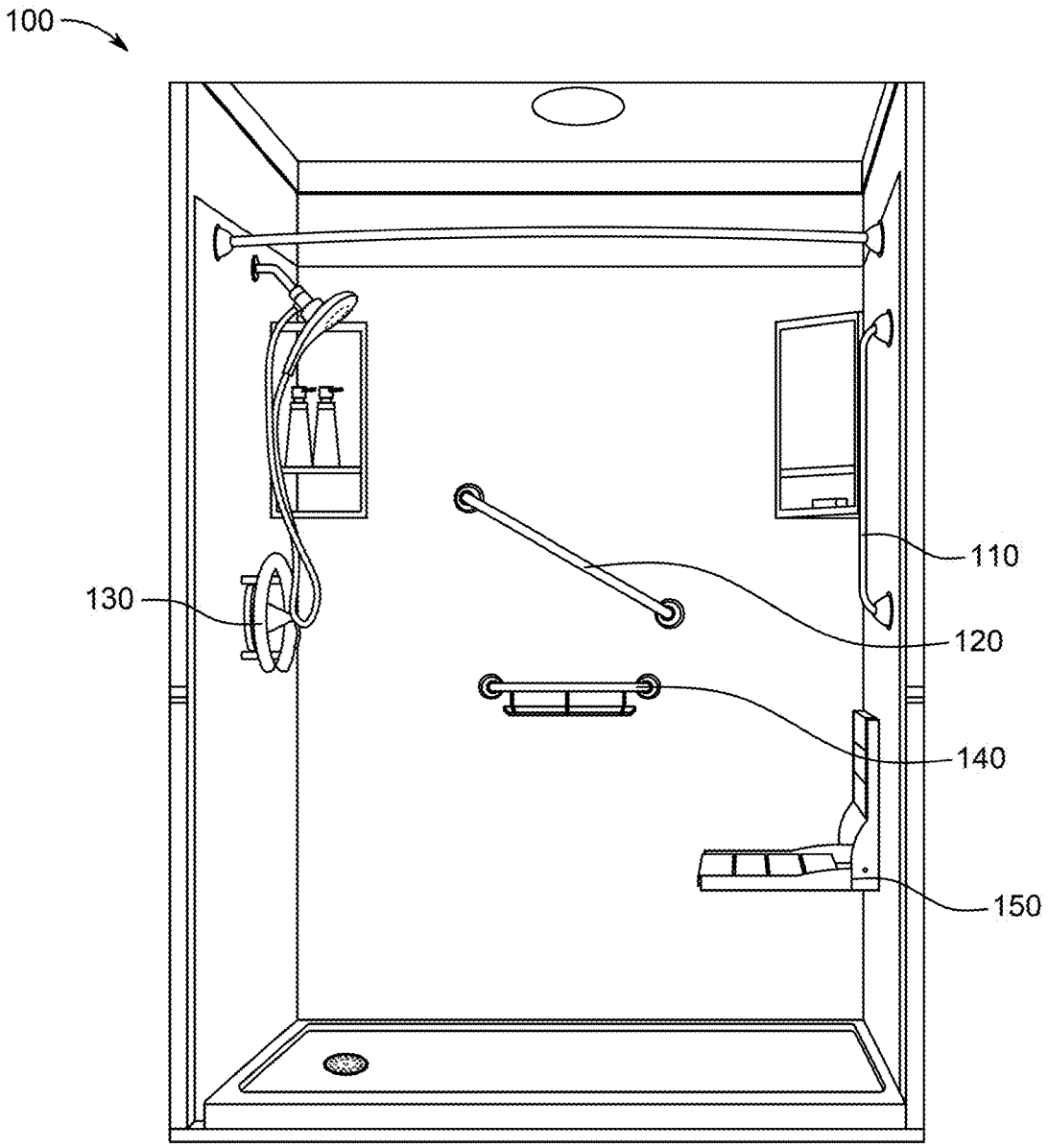
FIG. 3 is a photograph of an exemplary novel safety shower for use in a residential bathroom.

As previously noted, consumers often desire to improve the safety and functionality of residential bathrooms. An exemplary safety shower 100 is illustrated in FIG. 3. Such a safety shower 100 includes among other safety features, a number of grab bars (110, 120, 130, and 140) and a retractable seat 150 to assist a mobility challenged user in effectively using the shower. When a consumer decides to remodel a bathroom to include a safety shower, there remain a number of logistical issues. For example, it will be understood that requirements for the size and shape of a safety shower for remodeling an existing bathroom are substantially more complicated than designing a bathroom for a new home. A shower may need to be relocated and sized to accommodate other safety features in a remodeled bathroom. For example, when remodeling a bathroom for an aging or mobility-limited person, there is often more space allotted around a toilet for ease of use, a number of handrails and guardrails are installed throughout the bathroom, and enlarged vanities with seating are commonly installed to facilitate aging persons fully utilizing the bathroom and its amenities. Thus, it is often necessary to select an unconventional size and shape of a shower (and thus, an unconventional size and shape for the shower base) to accommodate other safety features and fully take advantage of the existing footprint of a bathroom remodeled for an aging person.

FIGS. 4-23 illustrate an exemplary embodiment of a shower base assembly. In this embodiment, a modular shower base kit includes one or more shower bases that include a threshold portion integrally formed with the shower base, one or more shower perimeter components, and a number of accessories. One of the shower bases is selected and modified, one or more shower perimeter components are selected and modified, and the accessories are used to assemble the shower base assembly for said shower base and shower perimeter component(s).

Figure 4:
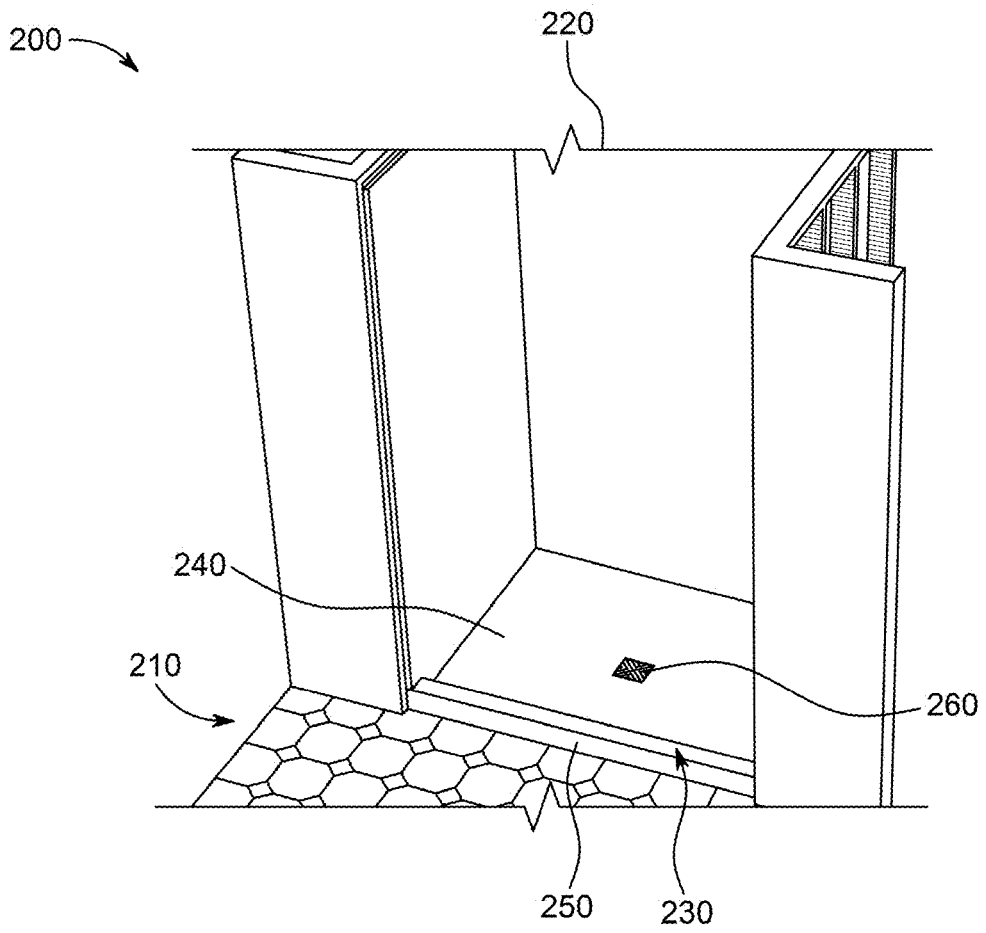
FIG. 4 schematically illustrates a perspective view of an exemplary shower with a shower base assembly constructed from a modular shower base kit.
Figure 5:
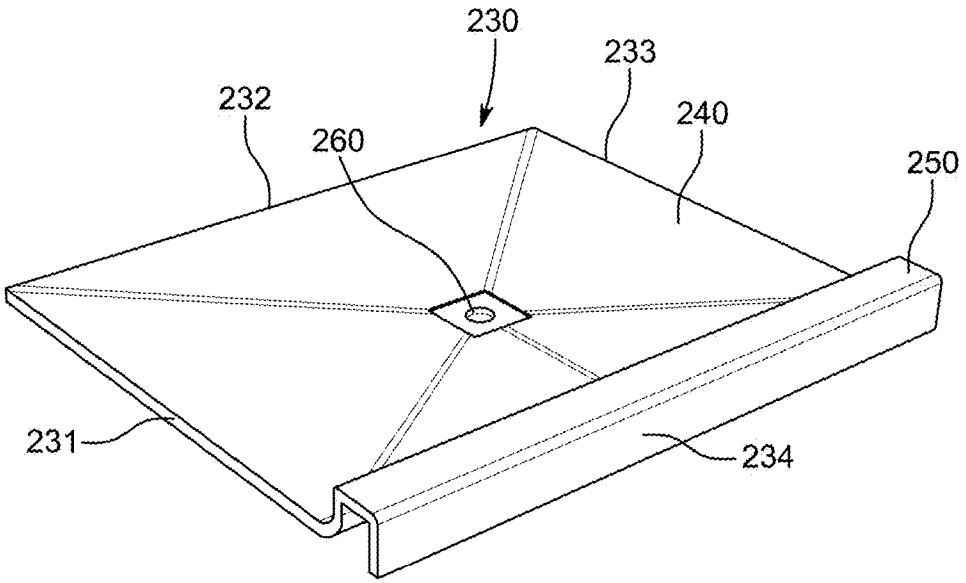
FIG. 5 schematically illustrates a perspective view of an exemplary shower base for use with a modular shower base kit.
Figure 6:
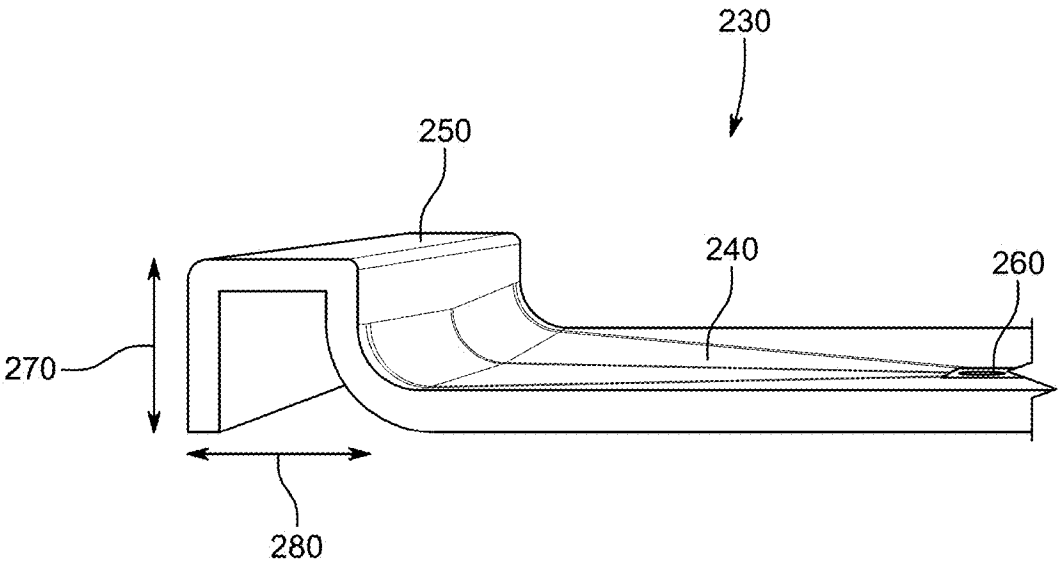
FIG. 6 schematically illustrates another perspective view of the shower base of FIG. 5.

FIG. 4 illustrates a shower 200 that includes a shower base assembly 210 installed to form a portion of a shower 200. The shower 200 further includes a shower enclosure 220 secured to and extending above the shower base assembly 210. The shower enclosure 220 can include one or more shower panels, walls, windows, and/or doors to at least partially enclose the shower 200. As illustrated in FIGS. 5 and 6, a shower base 230 includes a floor portion 240, a threshold portion 250 integrated with the floor portion 240, and a drain 260 located in the floor portion 240. The shower base 230 further includes a first edge 231, a second edge 232 perpendicular to the first edge, a third edge 233 opposite the first edge and perpendicular to the second edge, a fourth edge 234 opposite the second edge and perpendicular to the first edge and third edge. The shower enclosure 220 and the shower base assembly 210 work cooperatively to direct water to the drain 260 formed in a floor portion 240 to remove water from the shower 200. When the shower base assembly 210 is installed, the drain 260 is aligned with pre-existing piping installed in the home to facilitate water removal. This is to say that the shower 200 is configured to provide water containment and management such that water from the showerhead is substantially contained within the shower enclosure 220 and the shower base assembly 210, where water is ultimately removed from the shower 200 through the drain 260. As will be subsequently described, the shower base assembly 210 comprises additional components such as shower perimeter components that provide for engagement with the shower enclosure and/or sections of the interior walls of the remodeled bathroom.

As will be understood, the threshold portion 250 is elevated and typically positioned at the entryway to the shower 200. The elevated nature of the threshold portion 250 creates a dam that inhibits the flow of water out of the front of the shower 200 to assist with water management. The threshold portion 250 can be designed to have a seamless, clean, and aesthetically pleasing look. The threshold portion 250 can have any suitable dimensions (e.g., height 270 and width 280) to facilitate its function as a dam against the flow of water out of the shower 200. In some embodiments, the threshold portion 250 has a height 270 of about 2.75 inches (about 6.99 centimeters) and a width 280 of about 3 inches (7.62 centimeters).

The shower base 230 can be formed of any suitable material and via any suitable manufacturing or fabrication method. In some embodiments, the shower base 230 is formed of materials to provide a non-slip surface texture for the safety of its users. For example, the shower base 230 can be formed of a material having a minimum coefficient of friction (COF) rating of 0.6 according to ASTM C1028 standard, a minimum dynamic coefficient of friction (DCOF) rating of 0.42 according to ANSI A137.1 standard for wet and dry surfaces, or both. The shower base 230 can be formed of a material that is easy to clean.

In certain embodiments, the shower base 230 is formed of materials comprising engineered resin composites, plastics, or polymers. For example, the shower base 230 can be made of a colorless resin, a filler material, a coloring agent, and combinations thereof, mixed in appropriate proportions to achieve desirable color and aesthetics for the shower base 230. The coloring agent can include poly chips, reflective materials, pigments in the form of powders and/or flakes, color stabilizing agents, or combinations thereof. In certain embodiments, at least four or more different colors are formulated for the shower base 230.

In certain embodiments, the shower base 230 includes about 63 percent by weight ("wt. percent") of alumina trihydrate and about 37 wt. percent polyester resin. In some embodiments, the resin does not contain any urea formaldehyde. In some embodiments, the shower base 230 includes any suitable geocoat, such as an ISO-NPG polymer, to provide a high-quality surface finish for the shower base 230.

Figure 8:
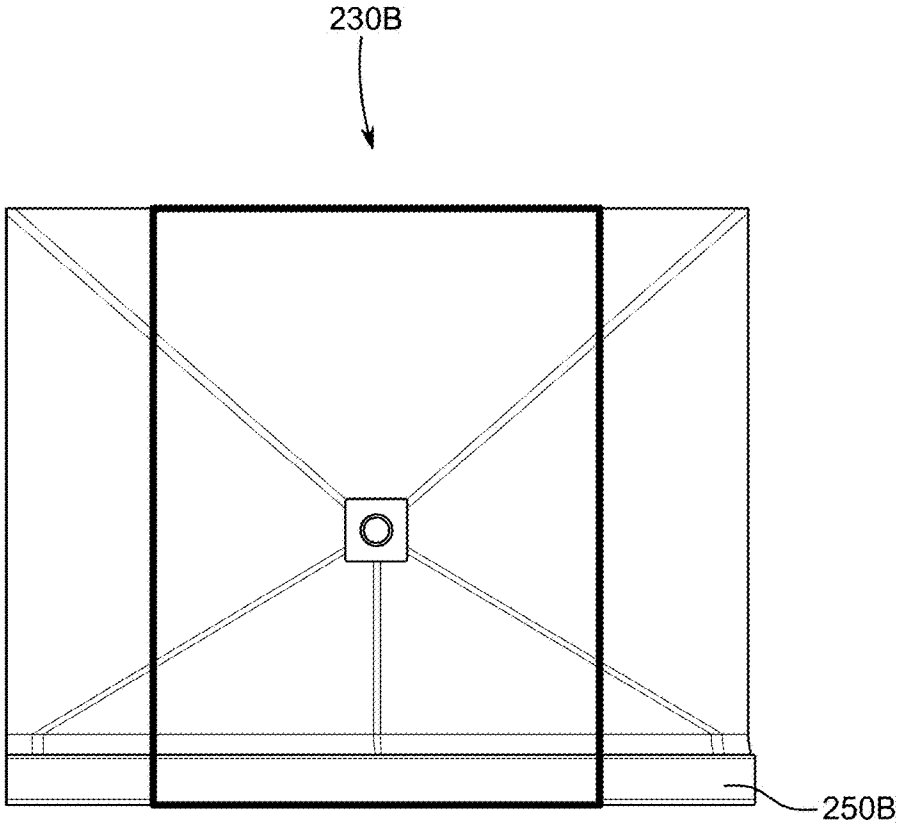
FIG. 8 schematically illustrates a top plan view of a shower base of a second standard size.
Figure 7:
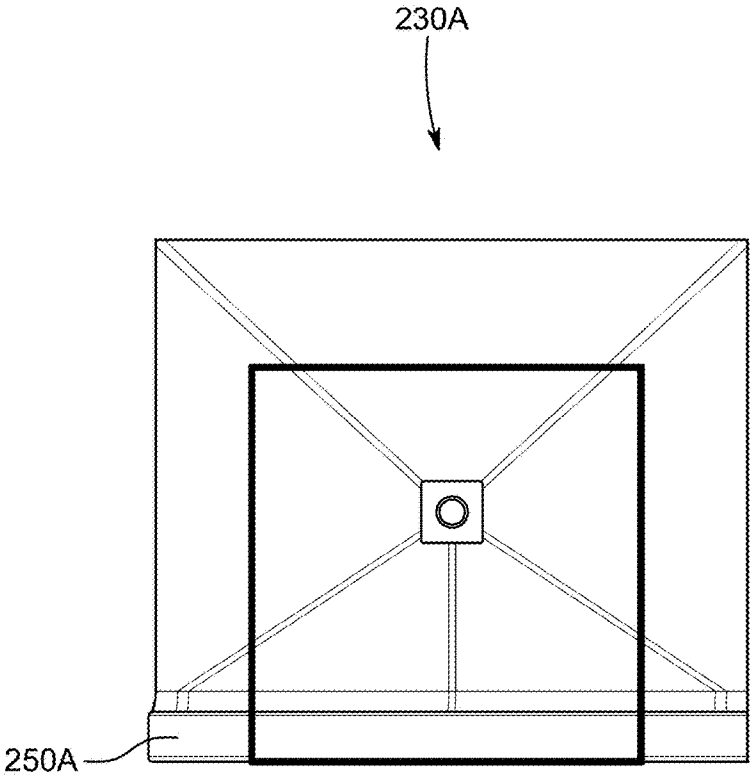
FIG. 7 schematically illustrates a top plan view of a shower base of a first standard size.

A modular shower base kit can include multiple shower bases 230, each of a different standard size and shape. FIGS. 7 and 8 illustrate two exemplary embodiments of shower bases 230 of different sizes and shapes. FIG. 7 illustrates a "small" shower base 230A, and FIG. 8 illustrates a "large" shower base 230B. The small 230A and large 230B shower bases each can have any suitable overall dimensions to allow reduction or downsizing of such overall dimensions to accommodate a wide range of final dimensions to satisfy various consumer driven custom size and shape needs. For example, the small shower base 230A can be fabricated with initial dimension of 48 inches×42 inches (48"×42"), and the large shower base 230 can be fabricated with initial dimension of 60"×48". Prior to installation, an installer can determine the needed size and shape of the shower base 230 based on space restrictions in the remodeled bathroom and consumer needs and preferences. Once the final dimensions are determined, the installer can choose between the small 230A and large 230B shower bases and can trim the selected shower base 230 to the dimensions desired. Such a trimming process can include cutting the threshold portion (250A, 250B) to the proper width to accommodate the opening of the shower 200.

As illustrated in FIG. 7, the small shower base 230A can be trimmed to form a square shower base (illustrated using a box superimposed on the small shower base 230A) that is approximately 36 inches by 36 inches in size to satisfy such a specific requirement from a remodeling project. It will be understood that the same 36 inch by 36 inch shower base can be cut from the large shower base 230B of FIG. 8; however, using the large shower base 230B would result in more waste than using small shower base 230A. Thus, selecting the small shower base 230A is prudent. Similarly, as illustrated in FIG. 8, the large shower base 230B can be trimmed to form a rectangular shower base (illustrated using a rectangular box superimposed on the large shower base 230B) that is approximately 48 inches by 36 inches in size to satisfy such a specific requirement from a remodeling project. While the same 48 inch by 36 inch shower base can be cut from the small shower base 230A of FIG. 7, because of drain location, using the large shower base 230B may better meet the requirements of the project. The two examples given above illustrated why multiple shower bases 230 can be included in modular shower base kits. The unused shower base 230 can be used on a subsequent project.

The shower bases 230 as described herein offer a superior solution as compared to the prior art model of molding monolithic shower bases of many different sizes and/or dedicating significant hand fabrication for custom needs (e.g., custom sizes, colors, designs, etc.). The modular shower base kit disclosed herein can be used universally to modify and assemble components into a shower base assembly 210 in the on-site to accommodate custom needs. For these reasons, the modular shower base kit disclosed herein offers advantages, including limiting manufacturing SKUs, simplifying inventory and supply chain processes, simplifying logistics management, and shorter sale-to-install times. With the modular shower base kit disclosed herein, the delivering and installation processes of shower replacement or tub-to-shower conversion jobs can be completed within one week or less.

In addition to the example described above with reference to FIG. 7, the small shower base 230A can be trimmed to any number of suitable sizes to facilitate the installation of a shower 200. Table 1 below depicts several optional sizes to which the small shower base 230A can be trimmed. For example, the small shower base 230A, with an original side of 48"×42", can be trimmed to form a 48"×36" shower base by removing about 288 square inches, or 14.29%, of the shower base material. In another example, the small shower base 230A can be trimmed to form a 32"×32" shower base by removing about 992 square inches, or 49.21%, of the shower base material. It will be understood that the examples shown in Table 1 below are exemplary only and that any additional sizes can be achieved to facilitate many different shower installations.

TABLE 1

Exemplary shower base sizes achievable based on a standard shower base size
Small Sized Shower Base

| Size | Material Removed (inches$^2$) | Material Removed (%) |
|---|---|---|
| 48 × 42 | 0 - original size | 0 - original size |
| 48 × 36 | 288 | 14.29% |
| 48 × 34 | 384 | 19.05% |
| 48 × 32 | 480 | 23.81% |
| 48 × 30 | 576 | 28.57% |
| 42 × 42 | 252 | 12.50% |
| 42 × 36 | 504 | 25.00% |
| 42 × 34 | 588 | 29.17% |
| 42 × 32 | 672 | 33.33% |
| 38 × 37 | 610 | 30.26% |
| 36 × 36 | 720 | 35.71% |
| 36 × 32 | 864 | 42.86% |
| 34 × 34 | 860 | 42.66% |
| 32 × 32 | 992 | 49.21% |
| Average | 599 | 29.72% |

As described for the small shower base 230A, the large shower base 230B can also be trimmed to any number of suitable sizes to facilitate the installation of a shower 200. Table 2 below depicts several optional sizes to which the large shower base 230B can be trimmed. For example, the large shower base 230B, with an original side of 60"×48", can be trimmed to form a 60"×42" shower base by removing about 360 square inches, or 12.50%, of the shower base material. In another example, the large shower base 230B can be trimmed to form a 54"×30" shower base by removing about 1800 square inches, or 62.50%, of the shower base material. It will be understood that the examples shown in Table 2 below are exemplary only and that any additional sizes can be achieved to facilitate many different shower installations.

TABLE 2

Exemplary shower base sizes achievable based on another standard shower base size
Large Sized Shower Base

| Size | Material Removed (inches$^2$) | Material Removed (%) |
|---|---|---|
| 60 × 48 | 0 - original size | 0 - original size |
| 60 × 42 | 360 | 12.50% |
| 60 × 38 | 600 | 20.83% |
| 60 × 36 | 720 | 25.00% |
| 60 × 34 | 840 | 29.17% |
| 60 × 32 | 960 | 33.33% |
| 60 × 30 | 1080 | 37.50% |
| 56 × 36 | 864 | 30.00% |
| 54 × 42 | 612 | 21.25% |
| 54 × 36 | 936 | 32.50% |
| 54 × 32 | 1152 | 40.00% |
| 54 × 30 | 1800 | 62.50% |
| 48 × 48 | 576 | 20.00% |
| 42 × 48 | 864 | 30.00% |
| 36 × 48 | 1152 | 40.00% |
| Average | 894 | 31.04% |

In examples provided in Tables 1 and 2, the average amount of material trimmed from the small 230A and large 230B shower bases to form custom size shower bases is about 30% for both small 230A and large 230B shower bases. In some embodiments, all of the custom sizes listed in Tables 1 and 2 are formed from the large shower base 230B, in which case the average amount of material trimmed way from the large shower base 230B is about 38.47% (e.g., about a quarter higher than 30%). Accordingly, it can be more efficient and create less material waste to fabricate or manufacture two standard shower base sizes (e.g., the small 230A and large 230B shower bases) from which customized shower bases can be trimmed instead of fabricating a single larger sided shower base (e.g., the large shower base 230B).

The shower base 230 can be configured to allow appropriate water drainage to meet slope requirements of applicable plumbing and building codes. For example, the shower base 230 can be fabricated such that the slope of the shower base 230 is no greater than about 2% (comparing rise over length). For example, the slope of the shower base 230 is no greater than about 0.25 inches of rise for every 12 inches of length. The drain 260 can have a drain diameter equal to or greater than 3.5 inches. The shower base 230 can include a built-in slope; thus, no thin-set or pre-sloping is required during installation. For example, the shower base 230 can have a varying thickness to create desired slope(s) across the floor portion 240 of the shower base 230.

Figure 9:
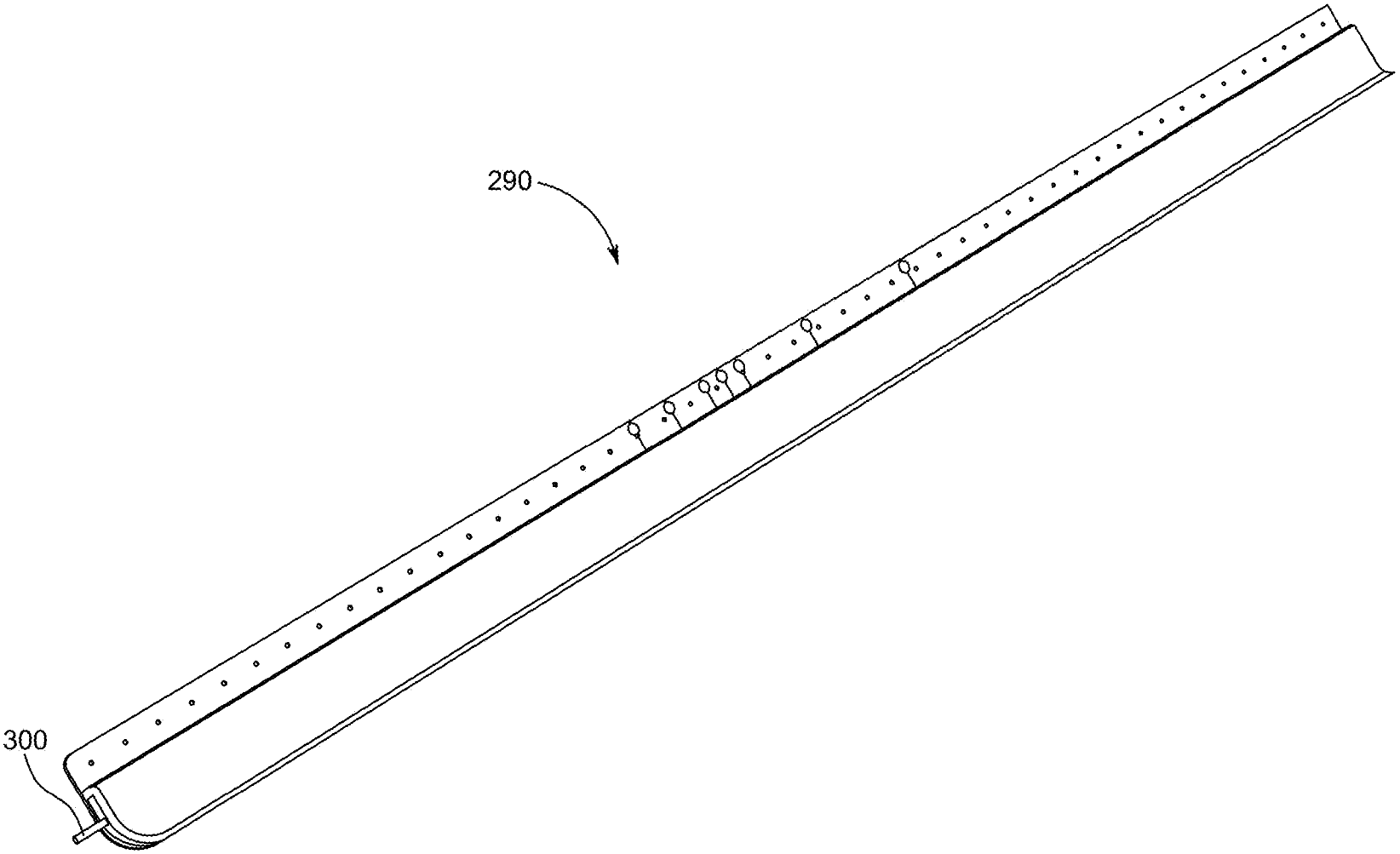
FIG. 9 schematically illustrates an exemplary shower perimeter component for use with a modular shower base kit.

FIG. 9 illustrates an exemplary shower perimeter component 290 for use with a shower base 230 to form a shower base assembly 210. As its descriptive name implies, the shower perimeter component 290 is arranged to couple to the shower base 230 to form a perimeter of the shower base assembly 210 that engages with the shower enclosure 220 or the walls of the remodeled bathroom. The shower base 230, one or more shower perimeter components 290, and associated accessories form an embodiment of a modular shower base kit as described herein. Such a modular shower base kit can be customized on site to form any number of configurations of a shower base assembly 210 to meet a wide and diverse variety of situations to satisfy consumer requirements and needs.

The shower perimeter component 290 is arranged to be a configurable component that can be modified and adjusted to conform to the size and shape of the shower base 230. Once so modified and adjusted, the shower perimeter component 290 can then be coupled along one or more edges of the shower base 230 using one or more accessories. In most embodiments, the shower perimeter component 290 will be coupled to three sides of the shower base 230 that engage the shower enclosure 220 (i.e., excluding the side of the shower base 230 that includes the threshold portion 250). Once coupled to the shower base 230 to form a shower base assembly 210, the shower perimeter component(s) 290 functions as a flange that can engage and/or interface with the shower enclosure 220, as illustrated in FIG. 4. The shower perimeter component 290 can include an accessory such as threaded rod 300 to facilitate the coupling of the shower perimeter component 290 to the shower base 230. The modular shower base kit can include additional accessories that are arranged to enable the completion of a shower base assembly 210 and/or make installation of a shower base assembly 210 more efficient. As will be discussed further, accessories can include fasteners, fixtures, templates, gaskets, bolts, nuts, etc.

The modular shower base kit is configured to facilitate fast, simple, and intuitive assembly and installation of the shower base assembly 210, with low-maintenance requirements after the installation. For example, assembly and installation of a various components (e.g., shower replacement or tub-to-shower conversion) can be completed in one day using the modular shower base kit. An installer can use common tools and methods to assemble and install a shower base assembly 210 using the modular shower base kit. Components of the modular shower base kit are simple and straightforward for the installer to use and assemble. After the installation is completed, minimal or substantially no service or maintenance would be required to maintain the shower base assembly.

An exemplary assembly and installation process for the modular shower base kit is illustrated in FIGS. 10 through 23. As described in association with FIGS. 7 and 8, once an installer measures or is informed of the desired footprint of the shower and drain location, a shower base 230 is selected (i.e., small 230A or large 230B shower base), and the installer cuts or trims the shower base 230 to the desired custom size. The installer can cut or trim the shower base 230 using standard power tools such as a circular saw, table saw, or jig saw. Once the shower base 230 is cut or trimmed to size, any loose materials or rough edges can be removed or smoothened using a power sander, files, sandpaper, and the like.

Figure 10:
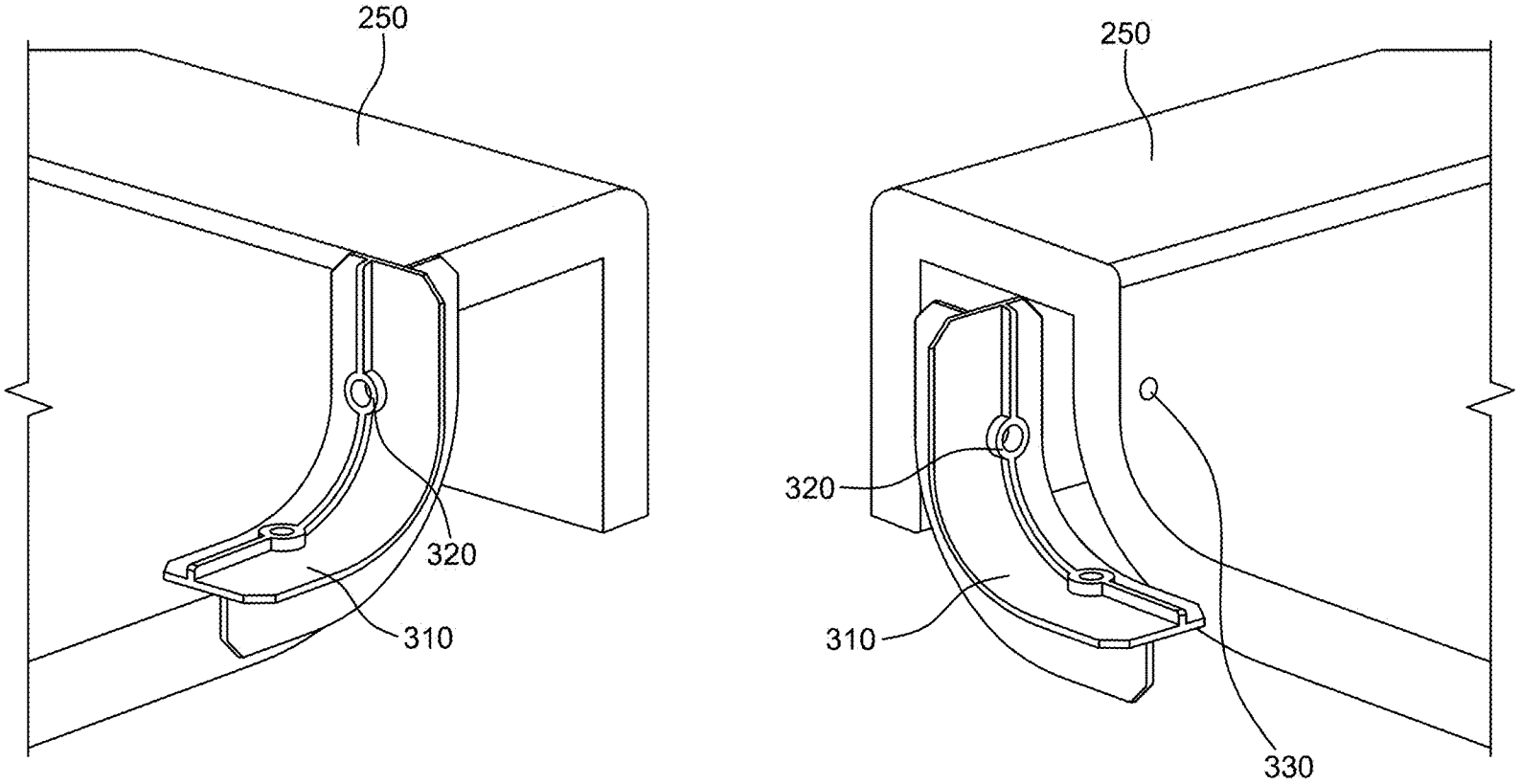
FIG. 10 schematically illustrates an exemplary threshold template for use in assembling a shower base assembly from a modular shower base kit.

As illustrated in FIG. 10, one of the accessories used with the modular shower base kit includes a threshold template 310, which is used to correctly locate and drill holes in the threshold portion 250 of the shower base 230. As will be subsequently described, such a drilled hole will be useful in coupling a shower perimeter component 290 to the shower base 230. The threshold template 310 is shaped to align with the contoured surface at the corner of the threshold portion 250. The threshold template 310 includes a through-hole 320. When the threshold template 310 is aligned with a corner of the threshold portion 250, the through-hole 320 is positioned to guide the installer in drilling a hole 330 through the threshold portion 250 of the shower base 230. The same threshold template 310 can be used to mark and drill a hole 330 through both the left and right sides of the threshold portion 250 of the shower base 230. The holes 330 in the left and right sides of the shower base 230 will be used to accommodate the threaded rod 300 of the shower perimeter component 290 of the shower base 230 during assembly of the shower base assembly 210. While the holes 330 described herein can be formed during fabrication of shower bases 230, it will be understood that such holes 330 are only useful in the case where a small 230A or large 230B shower base is used in its original size without the installer trimming the shower base 230 to a custom size. When a custom size is required, at least one of the holes 330 needs to be formed by the installer after trimming the shower base 230 to the custom size.

Figure 11:
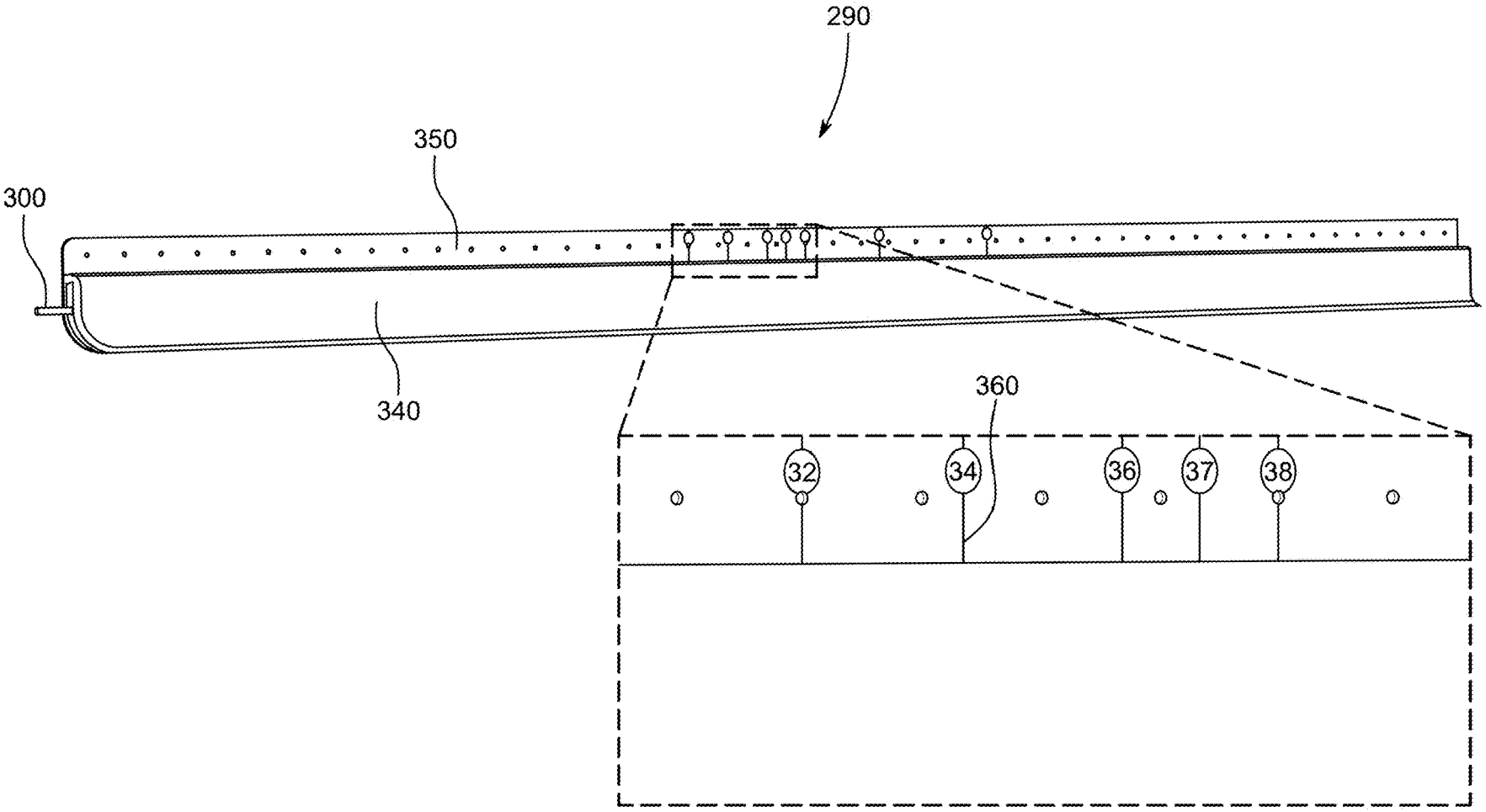
FIG. 11 schematically illustrates details of an exemplary shower perimeter component.

FIG. 11 illustrates a detailed view of the shower perimeter component 290, which is a substantially straight component that can be bent and/or cut to fit along one or more edges of the shower base 230. The shower perimeter component 290 can include a composite material 340 secured to a substrate 350. The composite material 340 can be coupled to the substrate 350 using an adhesive or other bonding agent. The composite material 340 can be fabricated from any suitable materials, such as materials similar or the same as the shower base 230, engineered resin composites, plastics, or other polymers. The substrate 350 can be made of any suitable materials, such as aluminum, polymer, plastic, fiberglass, wood, engineering resin composite, etc. The substrate 350 can include markings 360 that assist in determining a proper length that coincides with one or more side edges of the shower base 230. The markings can inform an installer where the shower perimeter component 290 is to be cut and/or bent to properly engage with one or more side edges of the shower base 230.

Figure 12:
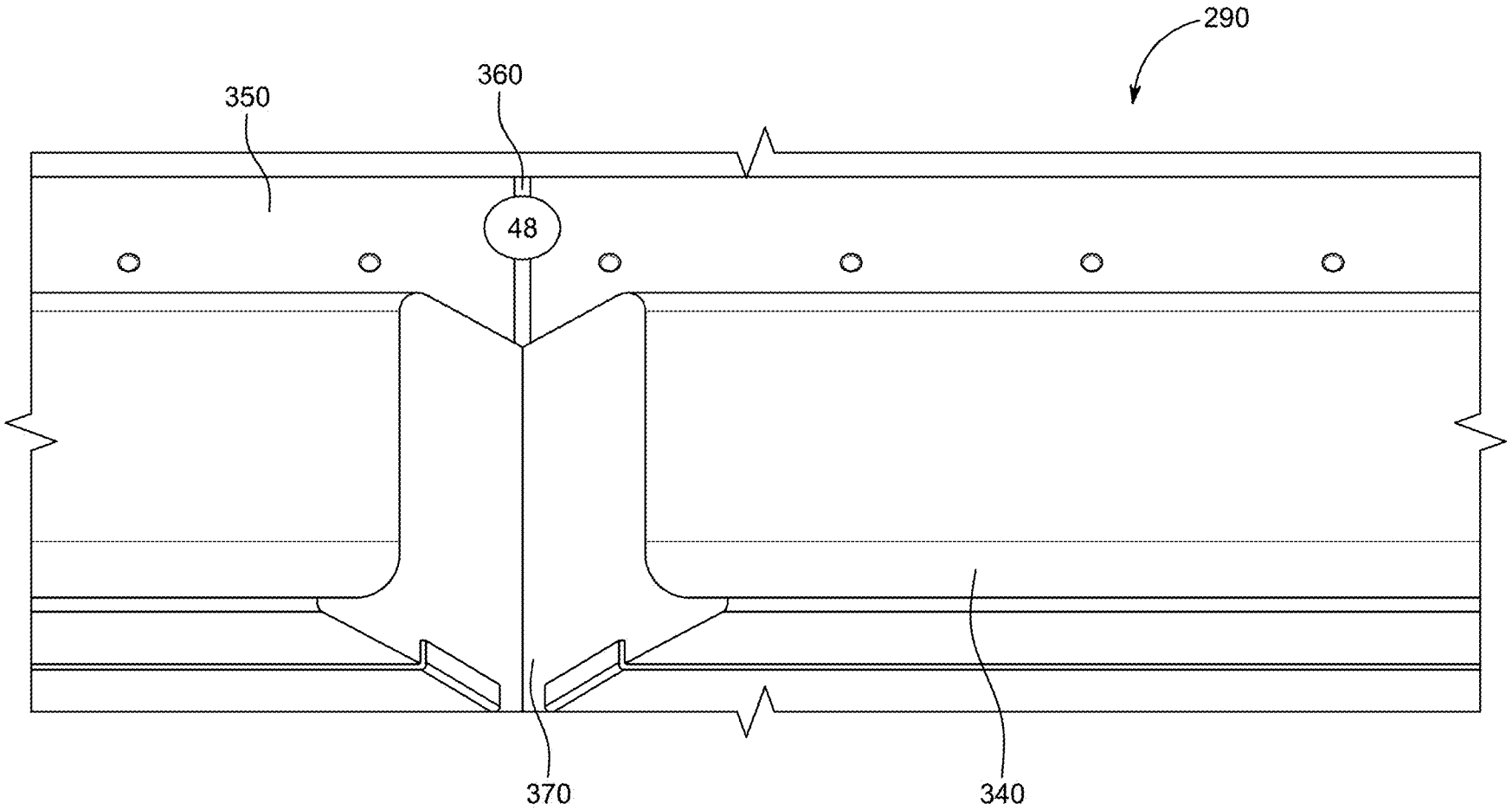
FIG. 12 schematically illustrates a portion of a shower perimeter component with a V-cut made in the shower perimeter component.
Figure 13:
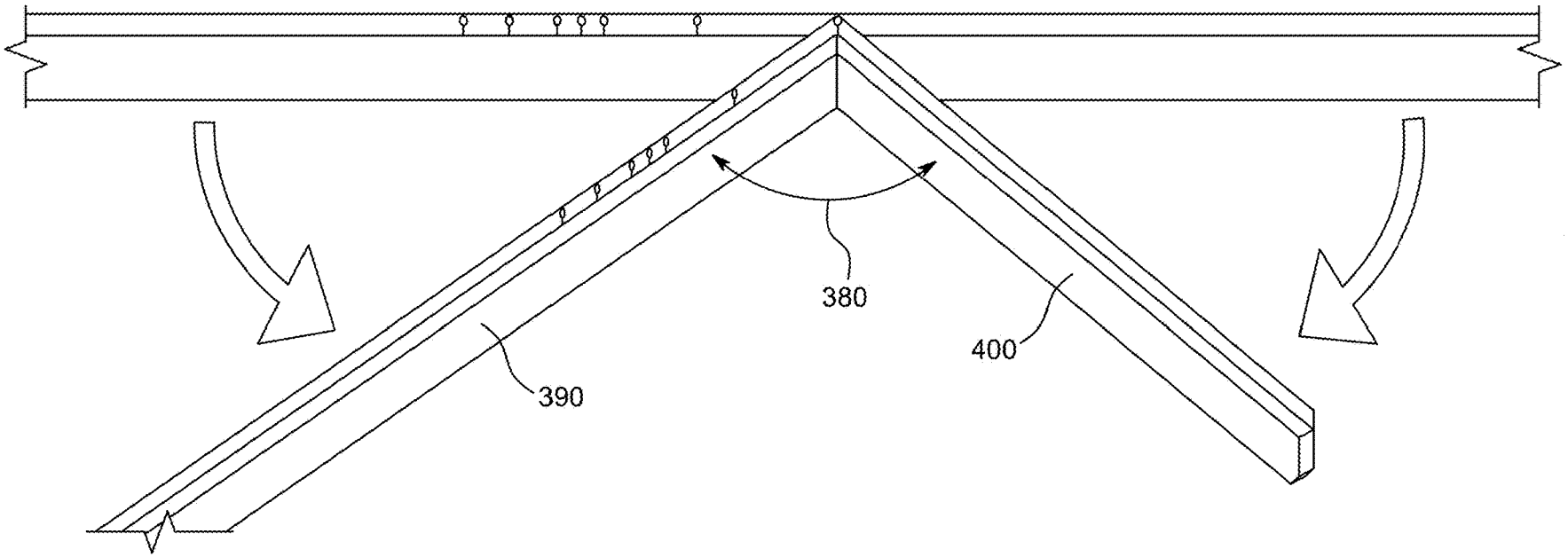
FIG. 13 schematically illustrates a shower perimeter component undergoing a process step prior to assembly of the shower base assembly.

As shown in FIGS. 12 and 13, composite material 340 of the shower perimeter component 290 can be cut and the substrate 350 can be bent to form a right angle such that the shower perimeter component 290 can engage more than one side edge of the shower base 230. As best illustrated in FIG. 12, a "V-cut" 370 can be made through the composite material 340 proximate to one of the markings 360 (in this case to accommodate a shower base 230 that has one side edge that is 48 inches in length). In such a V-cut, the substrate 350 remains fully intact. The shower perimeter component 290 can then be bent (as demonstrated in FIG. 13) to form a substantially 90-degree angle 380. As illustrated, the shower perimeter component 290 forms a "L-shape" that includes a first portion 390 and a second portion 400. In such a configuration, the L-shaped shower perimeter component 290 can conform to two adjacent side edges of the shower base 230. In certain embodiments, the V-cut 370 is a through-cut that passes through the composite material 340 and the substrate 350 (e.g., the shower perimeter component 290 is separated into two separate pieces by the V-cut 370) and the two separate pieces can each be secured to one side edge of the shower base 230.

Figure 14:
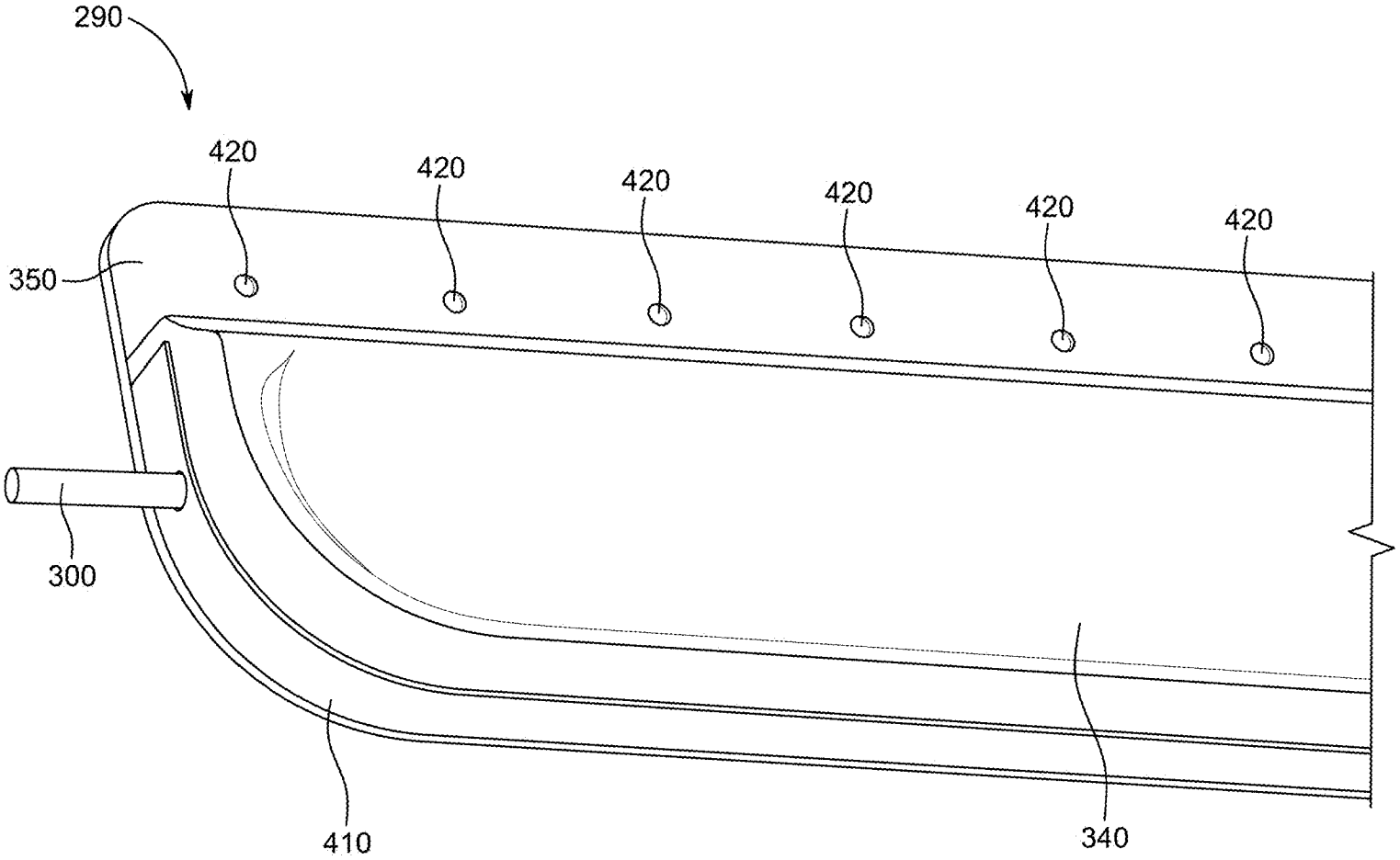
FIG. 14 schematically illustrates a detailed view of a shower perimeter component.
Figure 15:
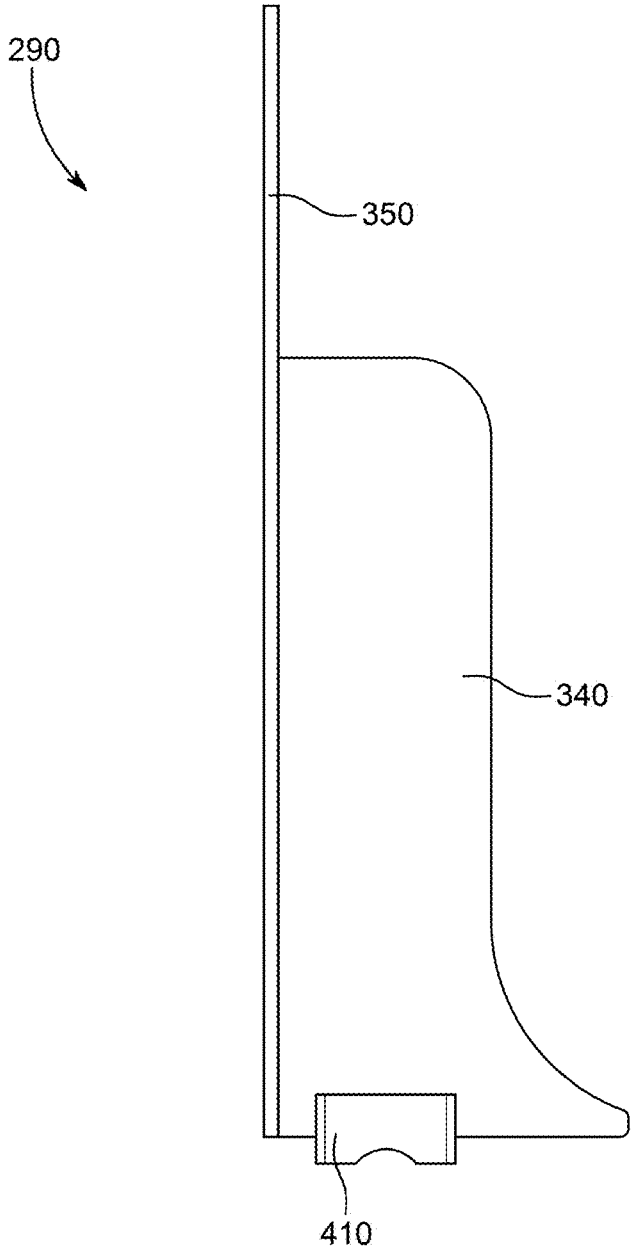
FIG. 15 schematically illustrates another detailed view of a shower perimeter component.
Figure 16:
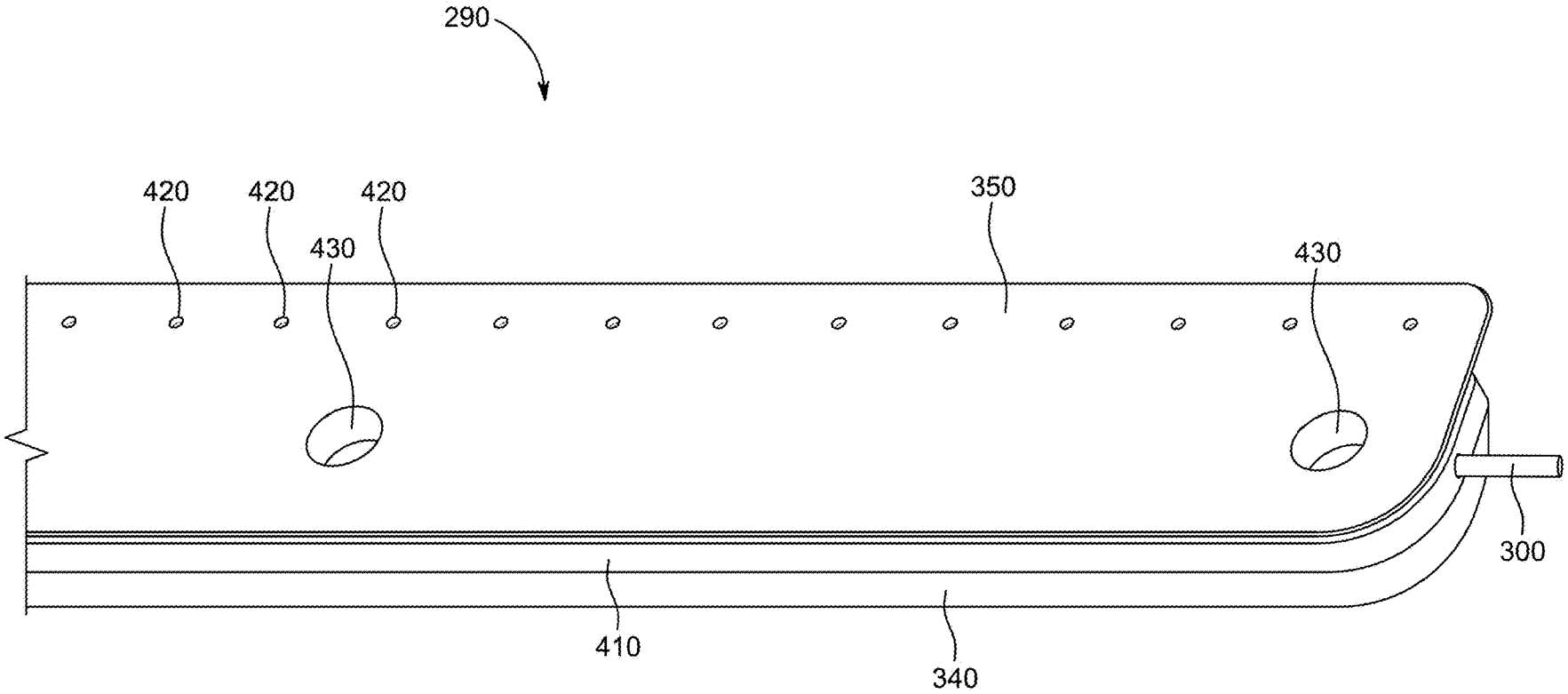
FIG. 16 schematically illustrates yet another detailed view of a shower perimeter component.

As illustrated in FIGS. 14-16, the shower perimeter component 290 can include a number of accessories and features that facilitate the coupling of the shower perimeter component 290 to the shower base 230 to form a shower base assembly 210 with a sealed and leak-proof interface. As noted above, the shower perimeter component 290 can include a threaded rod 300, and further include a sealing mechanism 410, one or more small aperture 420, one or more large aperture 430, and one or more coupling mechanism 440. The sealing mechanism 410 is positioned along the lower and side edges of the composite material 340 of the shower perimeter component 290 and is arranged to be in contact with the floor portion 240 and threshold portion 250 of the shower base 230 when the shower perimeter component 290 is coupled to the shower base 230. The sealing mechanism 410 can be fabricated from an elastomeric or similarly pliable material and serve as a gasket to form a sealed interface between the shower perimeter component 290 and the shower base 230 upon assembly. As will be understood, the sealed interface created by the sealing mechanism 410 will prevent water leakage through the interface once the shower base 230 and shower perimeter component 290 are assembled into a shower base assembly 210. Once the shower base assembly 210 is completed, the small apertures 420 can be used in conjunction with fasteners such as nails, screws, and the like to couple the shower base assembly 210 to the shower enclosure 220 as illustrated in FIG. 4.

While the sealing mechanism 410 plays a primary role in forming a sealed and leak-proof shower base assembly 210, the threaded rod 300, large apertures 430, coupling mechanism 440, apertures 450 in the shower base 230, and additional fasteners are important in securely coupling the shower perimeter component 290 to the shower base 230 to effectuate such a sealed and leak-proof shower base assembly 210. The threaded rod 300 is embedded in and secured to the shower perimeter component 290. The threaded rod 300 can be secured to the shower perimeter component 290 using any suitable mechanisms during manufacturing or at any time prior to assembly of the shower base assembly 210. For example, the threaded rod 300 can be secured to the shower perimeter component 290 through an interference fit or a snap fit within a recess or hole drilled into the shower perimeter component 290. Additionally, adhesives and/or other bonding agents or mechanical features such as barbs, tapered profile, etc. can be used to secure the threaded rod 300 to the shower perimeter component 290.

Figure 17:
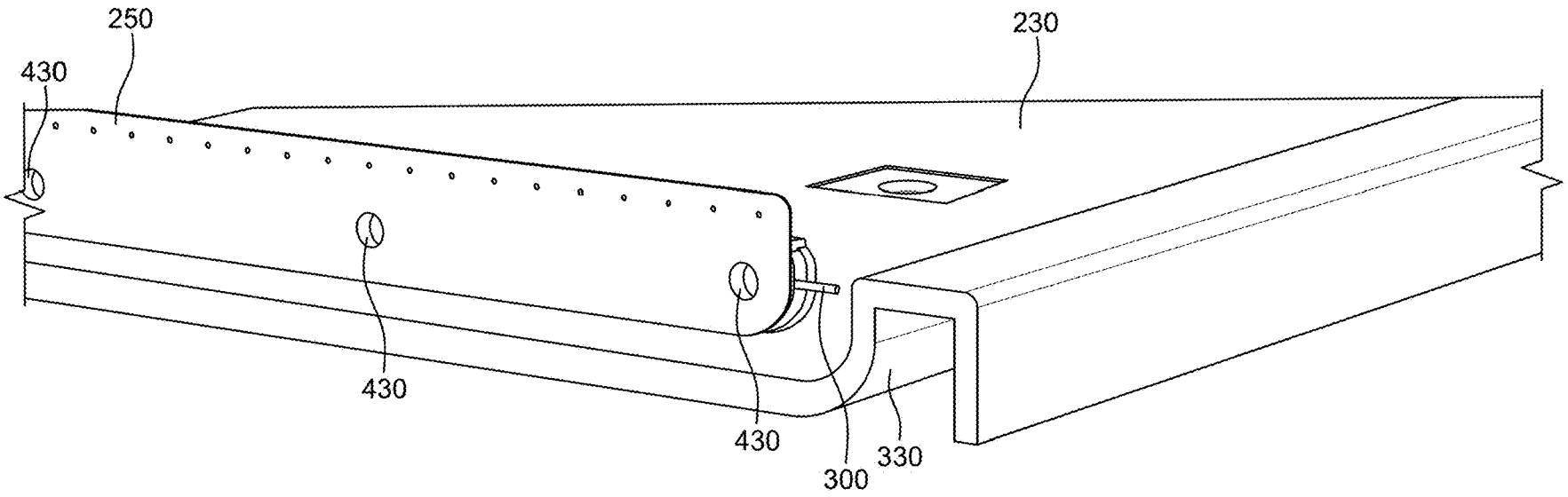
FIG. 17 schematically illustrates a first assembly step for securing a shower perimeter component secured to the shower base assembly.
Figure 18:
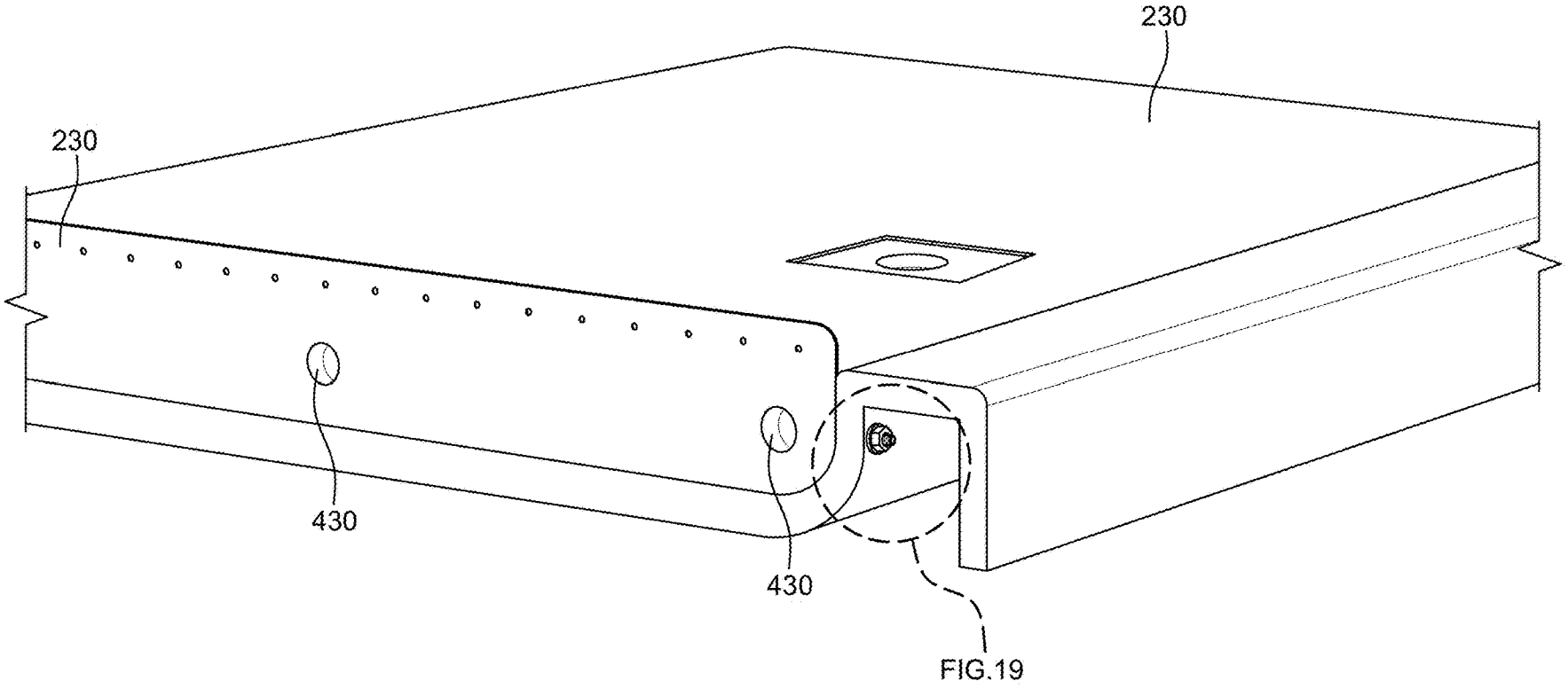
FIG. 18 schematically further illustrates the first assembly step of a shower perimeter component secured to the shower base assembly.
Figure 19:
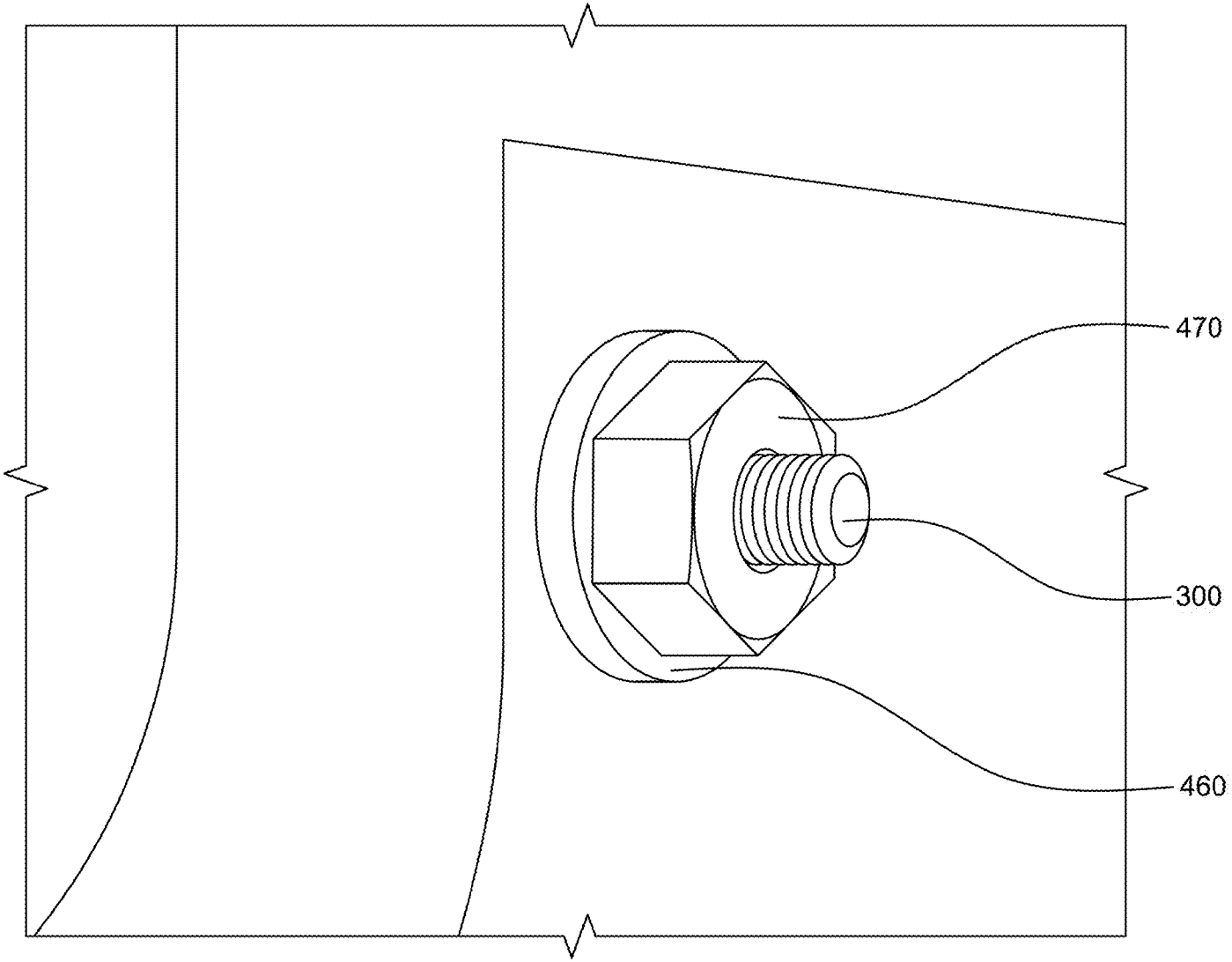
FIG. 19 schematically illustrates a detailed view of the first assembly step of a shower perimeter component secured to the shower base assembly.

As illustrated by FIGS. 17-19, an initial step in coupling the shower perimeter component 290 to the shower base 230 is to insert the threaded rod 300 through the pre-drilled hole 330 in the threshold portion 250 of the shower base 230 (the pre-drilled hole is illustrated in and described along with reference to FIG. 10). Once the threaded rod 300 is inserted, fasteners, such as a washer 460 and a nut 470, can be engaged with the threaded rod 300 to secure the shower perimeter component 290 to the shower base 230 (see detailed view of FIG. 19). The nut 470 can be tightened to apply a desired force to effectively manipulate the sealing mechanism 410 to form the sealed and leak-proof interface between the threshold portion 250 of the shower perimeter component 290 to the shower base 230.

As will be subsequently described, the coupling mechanism 440 can be used with a bolt 480 or other appropriate component to further secure the shower perimeter component 290 to the floor portion 240 of the shower base 230. The coupling mechanism 440 can be any suitable coupling mechanisms that effectively couples the shower perimeter component 290 to the shower base 230 such as a turn-lock fastener positioned in the large apertures 430 of the shower perimeter component 290. As illustrated in FIG. 16, the large apertures 430 are pre-drilled through the substrate 350 and into the composite material 340 of the shower perimeter component 290. The large apertures 430 can be formed during manufacturing of the shower perimeter component 290 or on-site prior to the assembly of the shower base assembly 210.

Figure 20:
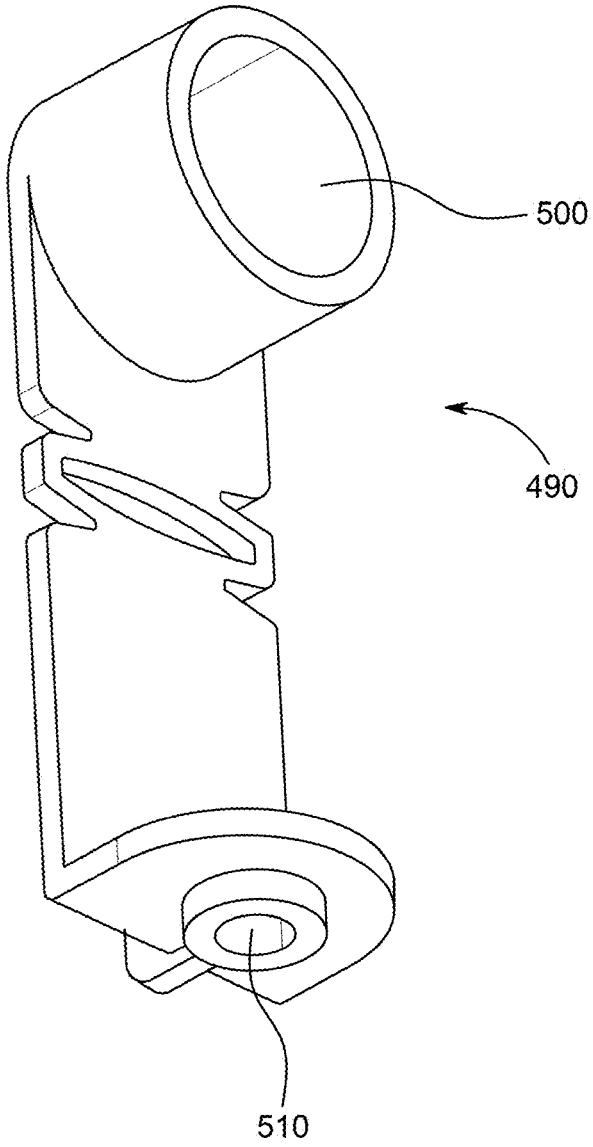
FIG. 20 schematically illustrates an edge template for use in securing the shower perimeter component to the shower base.
Figure 21:
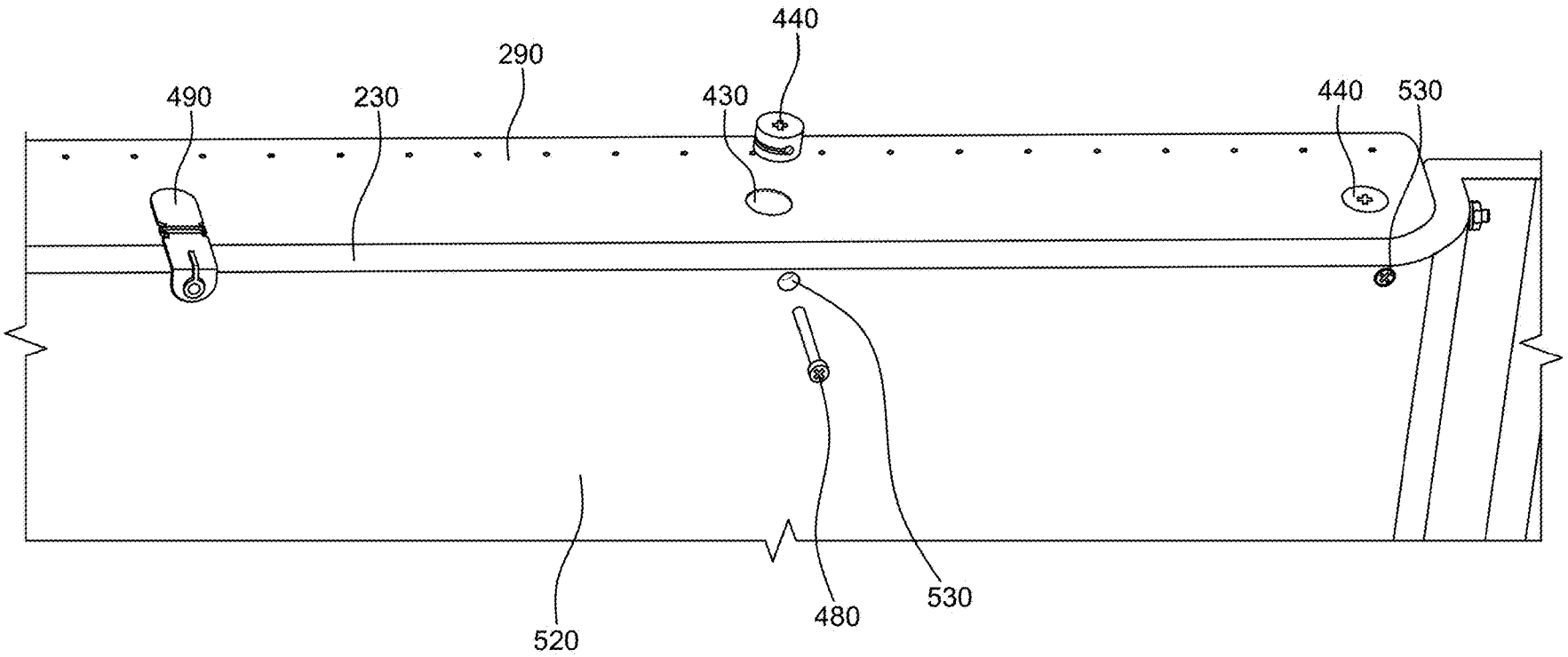
FIG. 21 schematically illustrates a second assembly step for securing a shower perimeter component secured to the shower base assembly.

Once the threaded rod 300 of the shower perimeter component 290 is secured to the shower base 230 as illustrated in FIG. 18, the shower base 230 can be further modified to facilitate the coupling mechanism(s) completing the coupling of the shower perimeter component 290 to the shower base 230. As illustrated in FIGS. 20 and 21, an edge template 490 can be used to guide the drilling of one or more holes in the underside 520 of the shower base 230 to accommodate a bolt 480 that works cooperatively with the coupling mechanism 440 to secure the shower perimeter component 290 to the shower base 230. The edge template 490 includes a protrusion 500 and a guide hole 510. The protrusion 500 has an outer diameter that corresponds to the inner diameter of the large aperture 430 in the shower perimeter component 290. When the protrusion 500 is inserted into a large aperture 430, the guide hole 510 is positioned on the underside 520 of the shower base 230 and vertically aligned approximately with the midpoint of the large aperture 430. An installer can then use the guide hole 510 and a drill to form a passageway 530 from the underside 520 of the shower base 230 to the large aperture 430. Once the installer completes the passageway 530, the edge template 490 can be removed and used again to form other passageways 530 until all required passageways 530 are formed.

To complete the assembly steps of the shower base assembly 210, a coupling mechanism 440 (such as a turn-lock fastener) is inserted into each large aperture 430 of the shower perimeter component 290, and a bolt 480 is inserted into each passageway 530 until the bolt 480 is engaged with its corresponding coupling mechanism 440. Each combination of coupling mechanism 440 and bolt 480 are tightened to further secure the shower perimeter component 290 to the shower base 230. As with the threaded rod 300 and nut 470 illustrated in FIG. 19, the coupling mechanism 440 and bolt 480 can be tightened to apply a desired force to effectively manipulate the sealing mechanism 410 to form the sealed and leak-proof interface along the entire the engagement of the shower perimeter component 290 and the shower base 230.

Figure 22:
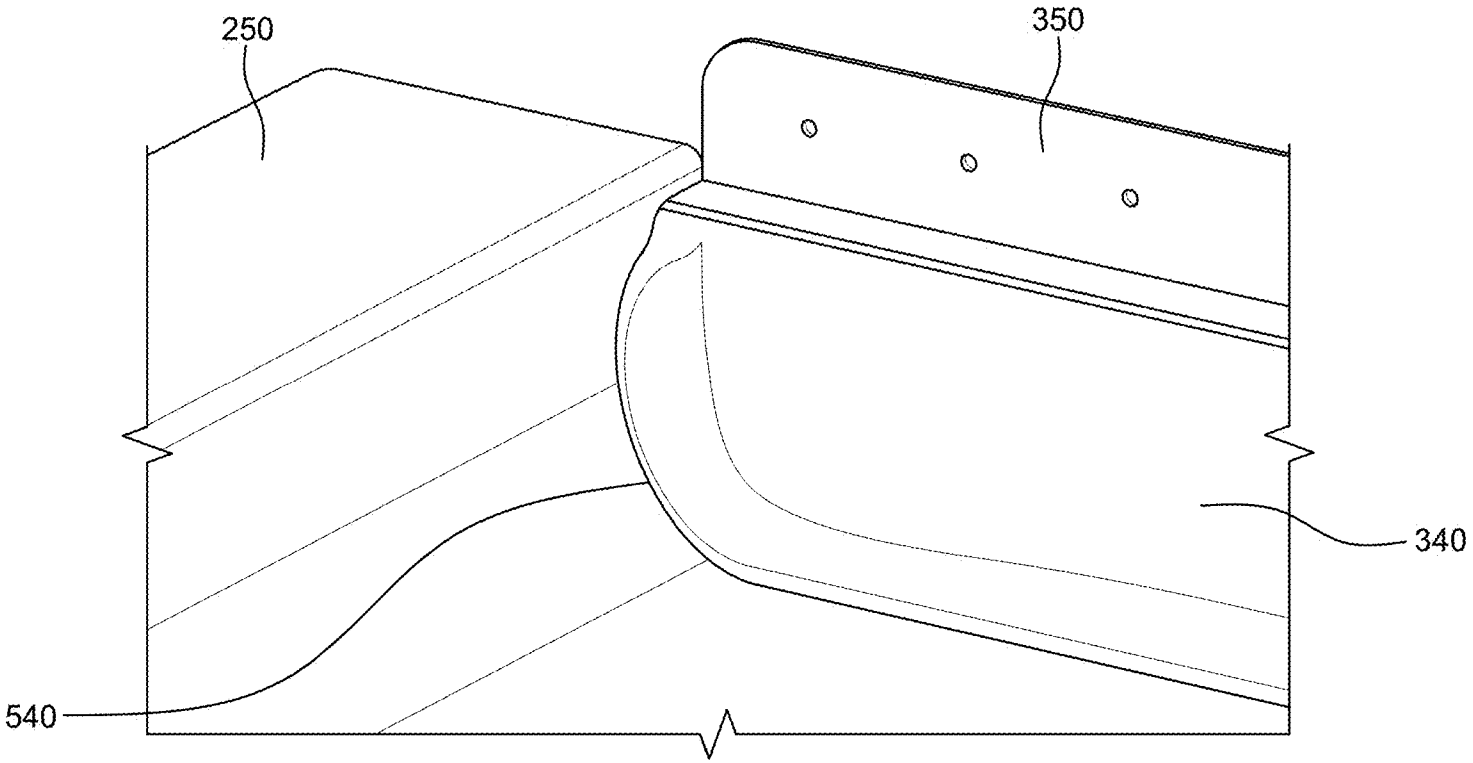
FIG. 22 schematically illustrates a perspective view of an exemplary interface between a threshold portion of the shower perimeter component and the shower base upon assembly of the shower base assembly.

As illustrated in FIG. 22, the contours of the threshold portion 250 of the shower base 230 and the rounded edge 530 of the shower perimeter component 290 are designed to mate so that once the shower base assembly 210 is assembled and the rounded edge 540 engages with the threshold portion 250, there is no gap through which water can leak. In other embodiments, the vertical edges of the shower perimeter component and the threshold portion can both be substantially straight, where again, there would be no gap through which water could leak.

Figure 23:
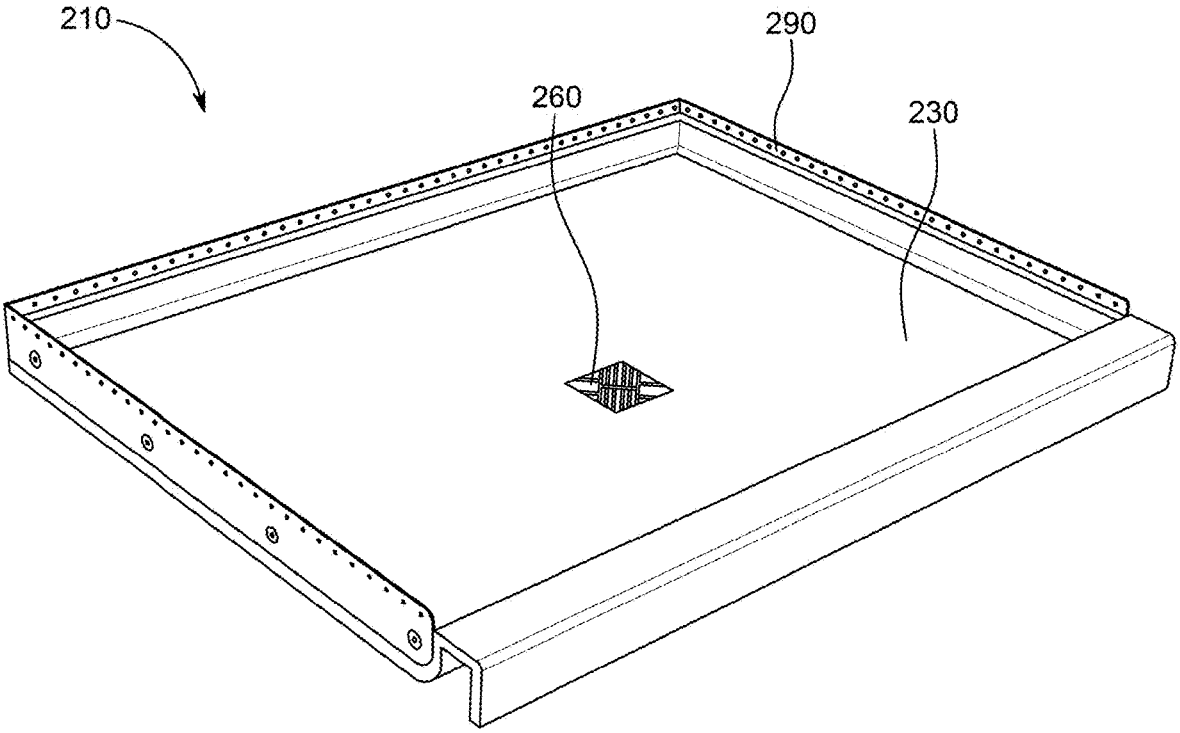
FIG. 23 schematically illustrates a perspective view of an exemplary shower base assembly.

FIG. 23 illustrates an exemplary shower base assembly 210 assembled using a modular shower base kit and methods of assembly disclosed herein. The shower base assembly 210 as illustrated is ready for installation in a desired location to serve as a base for a new shower 200. As illustrated, the shower perimeter component 290 can be secured to three sides of the shower base 230 such that the shower perimeter component 290 and the threshold portion 250 confine and control the water within the shower base assembly 210 during use and channel such water into the drain 260. The assembly methods described and illustrated in FIGS. 10-23 are exemplary and these same or similar arrangements and methods can be used to assemble any number of components into a shower base assembly.

FIGS. 24-46 illustrate a second embodiment of a modular shower base kit and methods of assembling components of the modular shower base kit to form a shower base assembly and install the shower base assembly. The second embodiment includes two shower bases 600, three or more shower perimeter components 650, 800, and a plurality of threshold components configurable to form a threshold along one or more edges of the shower base. The threshold components may include one or more threshold bracket, one or more gasket, one or more threshold curb, and an assortment of accessories. In this second embodiment, the shower base is fabricated without a threshold portion. The threshold is assembled from three components and secured to the shower base during assembly and installation of the shower base assembly. Additionally, this second embodiment is assembled and installed along with the installation of panels that form the shower enclosure and the underlying structural components such as wall studs and drywall.

The shower bases 600 for use with this second embodiment are similar to the shower base previously described. The shower bases 600 are formed of materials that provide a non-slip surface texture for the safety of its users such as materials that have a minimum coefficient of friction (COF) rating of 0.6 according to ASTM C1028 standard, a minimum dynamic coefficient of friction (DCOF) rating of 0.42 according to ANSI A137.1 standard for wet and dry surfaces, or both. The shower bases 600 can be formed of materials comprising engineered resin composites, plastics, or polymers. The shower bases 600 can be made of a colorless resin, a filler material, a coloring agent, and combinations thereof, mixed in appropriate proportions to achieve desirable color and aesthetics. The coloring agent can include poly chips, reflective materials, pigments in the form of powders and/or flakes, color stabilizing agents, or combinations thereof.

Figure 25:
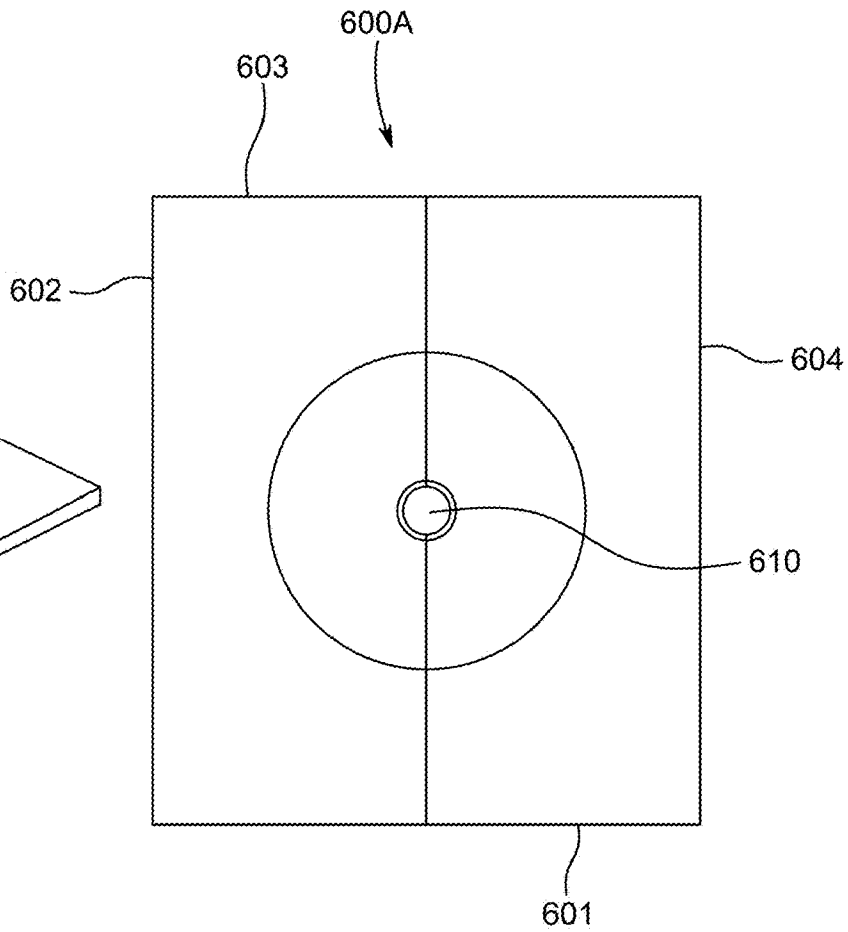
FIG. 25 schematically illustrates a top plan view of the shower base of FIG. 24.
Figure 24:
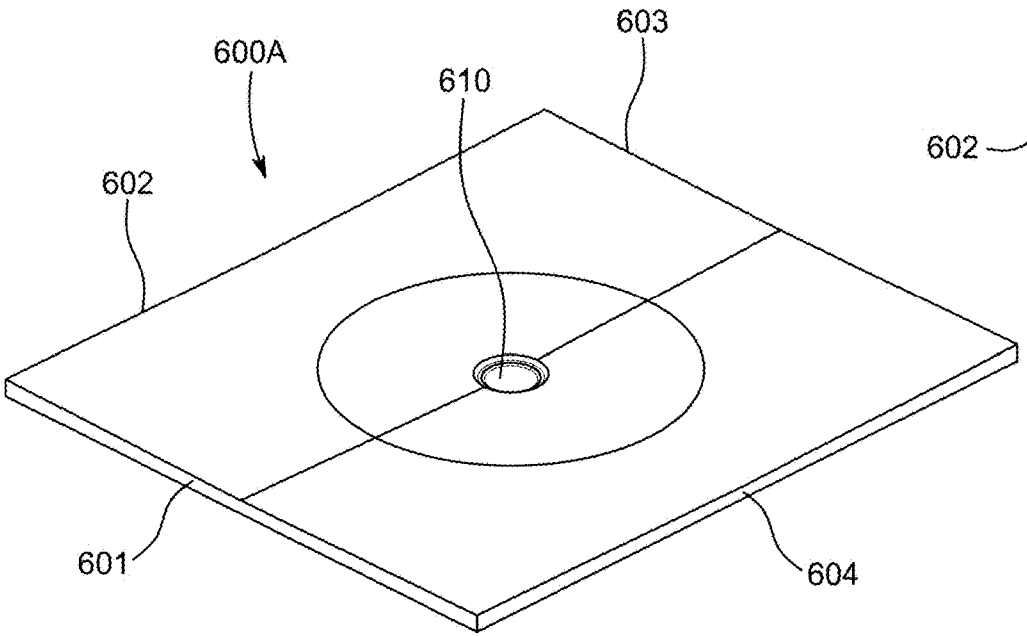
FIG. 24 schematically illustrates a perspective view of a shower base of a first standard size.
Figure 27:
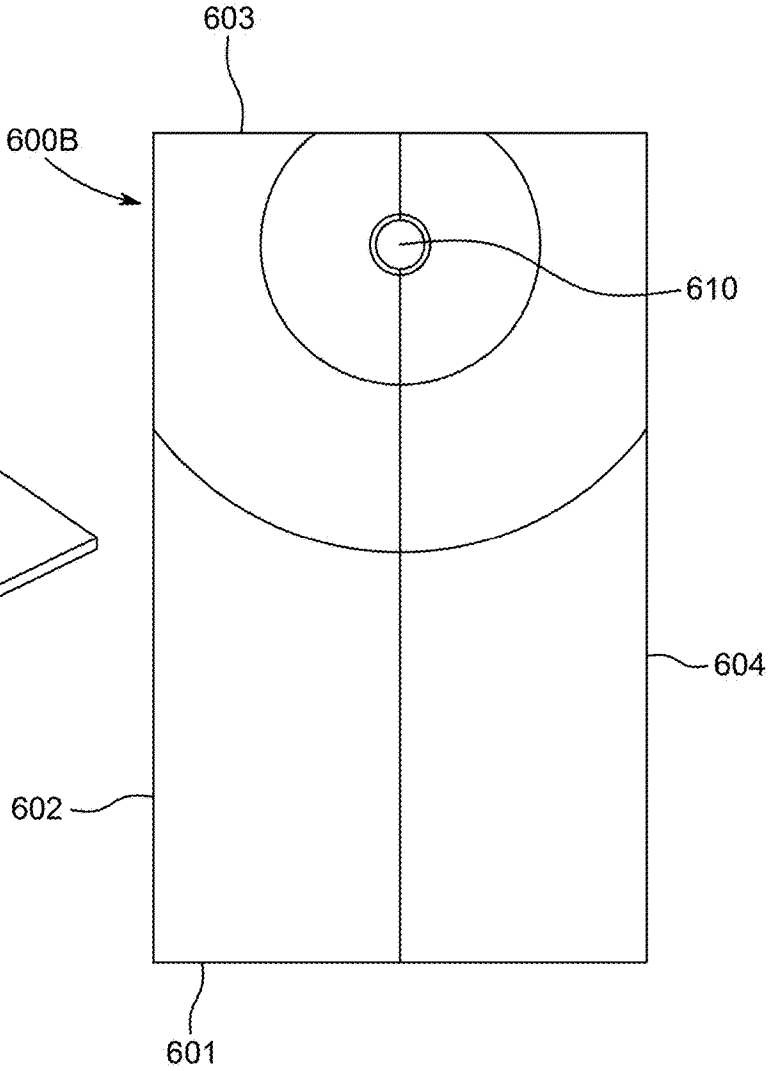
FIG. 27 schematically illustrates a top plan view of the shower base of FIG. 26.
Figure 26:
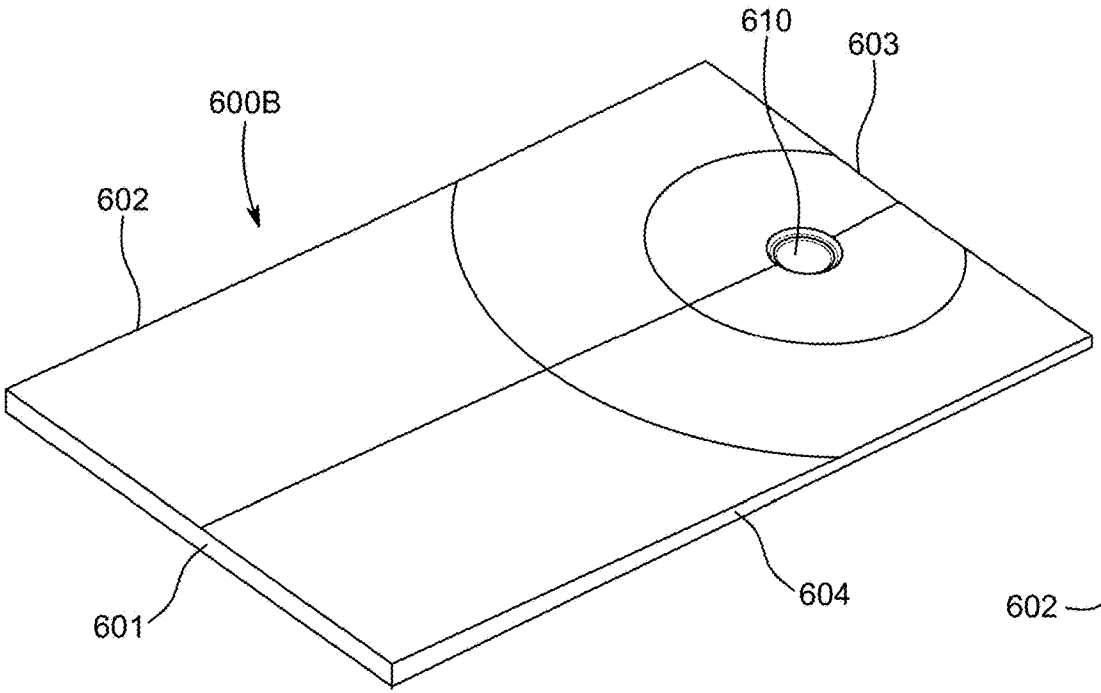
FIG. 26 schematically illustrates a perspective view of a shower base of a second standard size.

FIGS. 24-27 schematically illustrate two shower bases 600. FIG. 24 illustrates a perspective view of a first shower base 600A, and FIG. 25 illustrated a top plan view of the first shower base 600A. The first shower base 600A is 48 inches by 42 inches and includes, a first edge 601, a second edge 602 perpendicular to the first edge, a third edge 603 opposite the first edge and perpendicular to the second edge, a fourth edge 604 opposite the second edge and perpendicular to the first edge and third edge, and a drain 610 that is centered relative to all edges. FIG. 26 illustrates a perspective view of a second shower base 600B, and FIG. 27 illustrated a top plan view of the second shower base 600A. The second shower base 600B is 60 inches by 36 inches and includes a drain 610 that is centered relative to the two opposing long edges but is located significantly closer to one of the short edges of the second shower base 600B. It is noted that both shower bases 600A and 600B are formed without integrated thresholds. The two shower bases illustrated in FIGS. 24-27 are exemplary shower bases and shower bases with other dimensions are equally applicable to the modular shower kits and methods of assembly as described herein. In the following description, for simplicity, reference number 600 will be used generally to identify shower bases without integrated thresholds.

Figure 28:
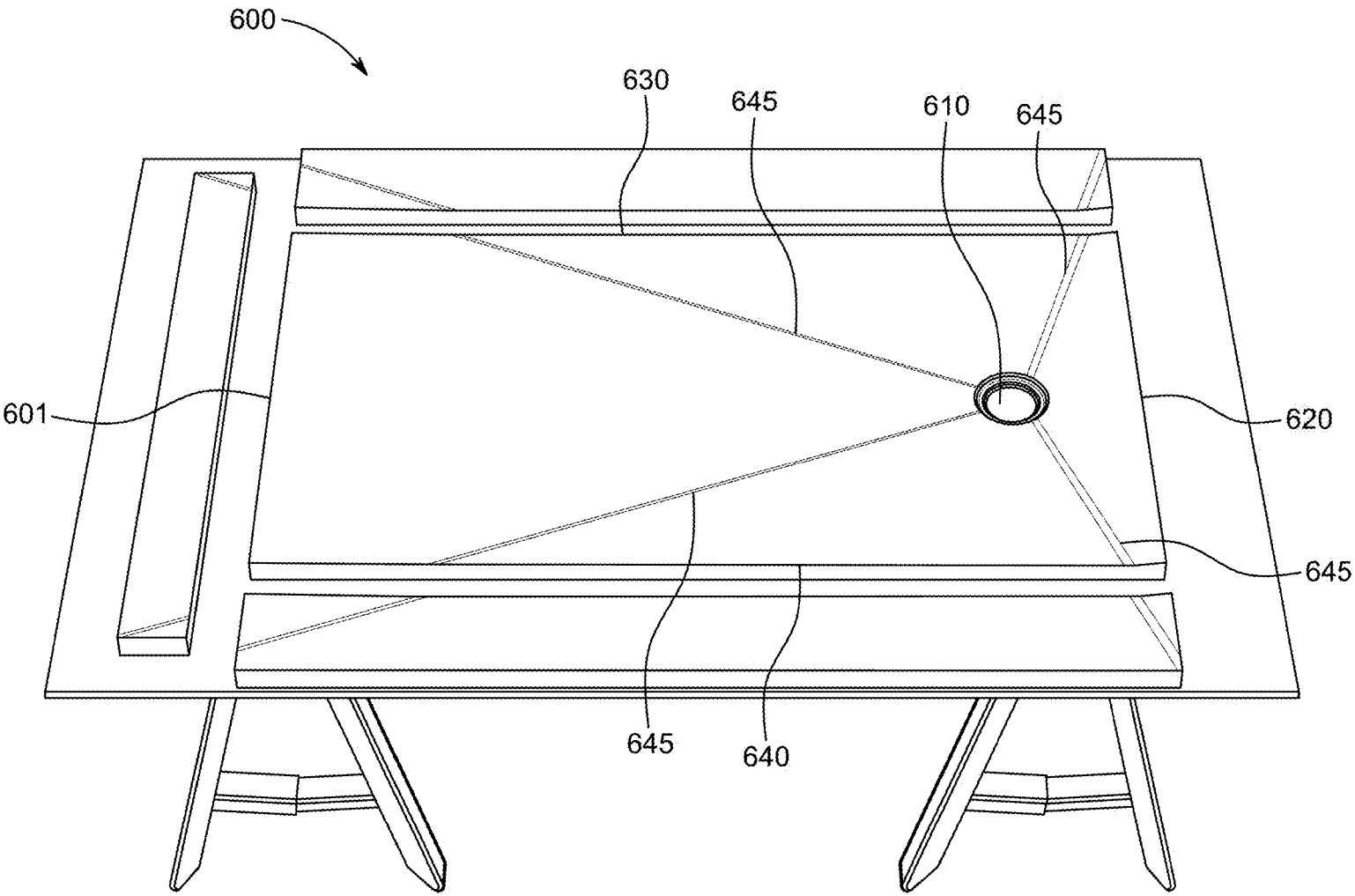
FIG. 28 schematically illustrates an exemplary shower base trimmed to a custom size.

As illustrated in FIG. 28, the shower base 600 can be cut or trimmed to a desired custom size. The cuts to the shower base 600 are typically made so that the location of the drain 610 is maintained relative to one side edge 620 and centered relative to two opposing side edges 630 and 640 of the shower base 600. Because the location of plumbing in a residential home is typically standardized, the shower base 600 is fabricated such that the drain 610 location in the shower base 600 is positioned to align with standardized plumbing. Thus, the cuts to the shower base 600 are made to preserve the location of the preformed drain 610 so that the drain 610 aligns with the home's plumbing upon installation of the shower base assembly. However, if the plumbing is not standardized in the home or the location of the shower is not in a conventional location, the shower base 600 can be accordingly trimmed to accommodate the location of the home plumbing. The shower base 600 additionally includes grooves 645 that are arranged to effectively channel water to the drain 610.

Figure 29:
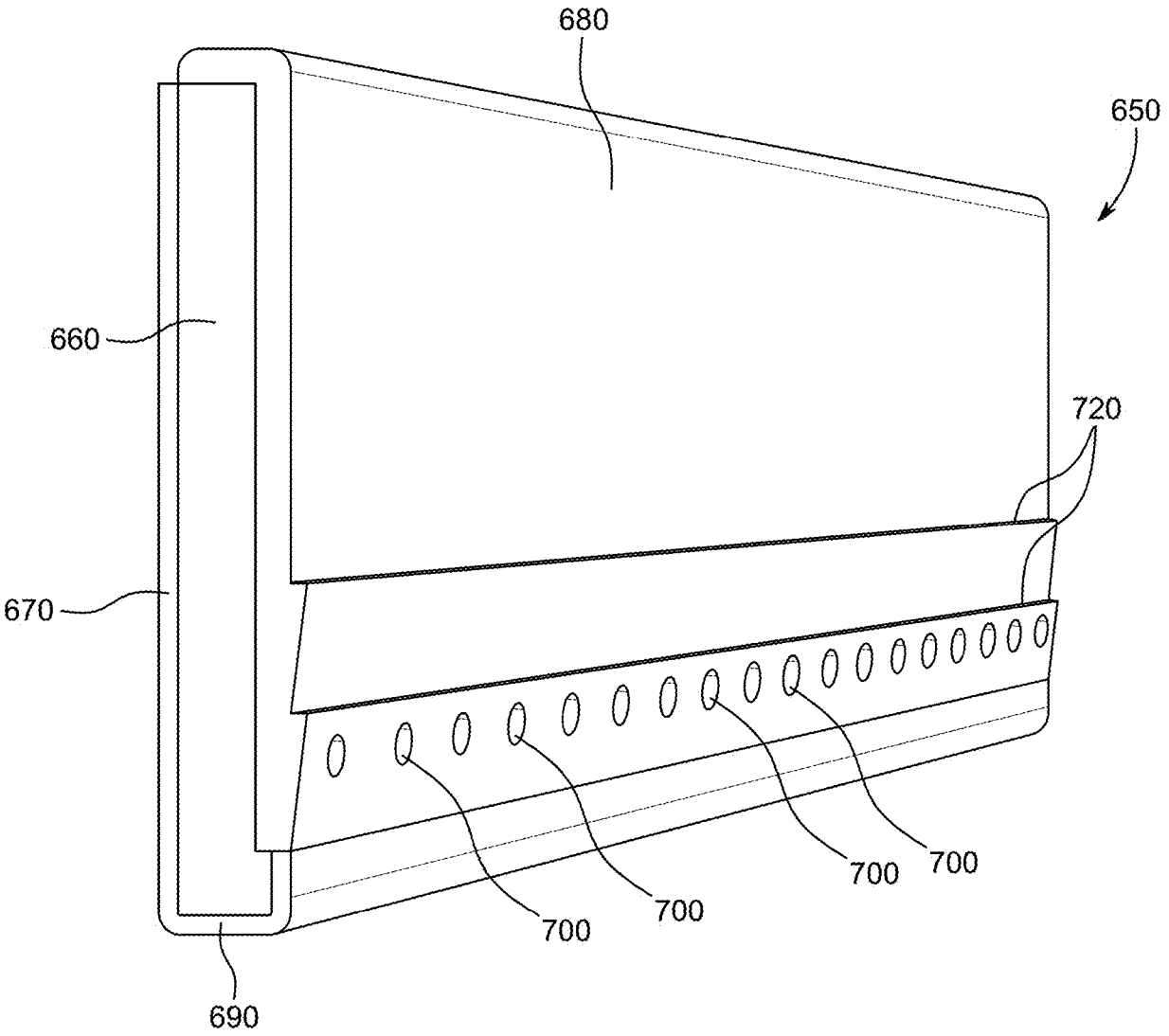
FIG. 29 schematically illustrates a detailed view of a shower perimeter component.
Figure 30:
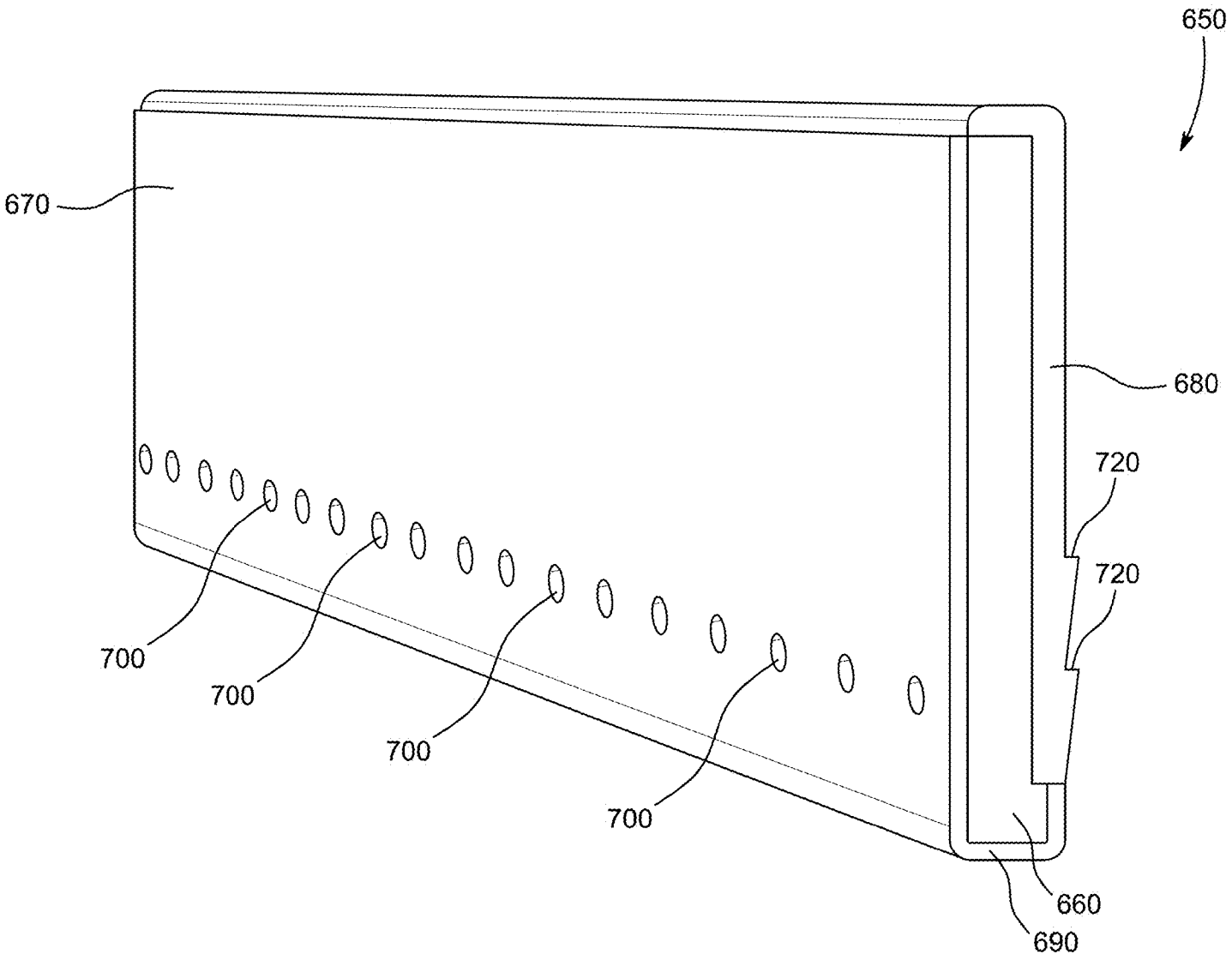
FIG. 30 schematically illustrates another detailed view of a shower perimeter component.
Figure 31:
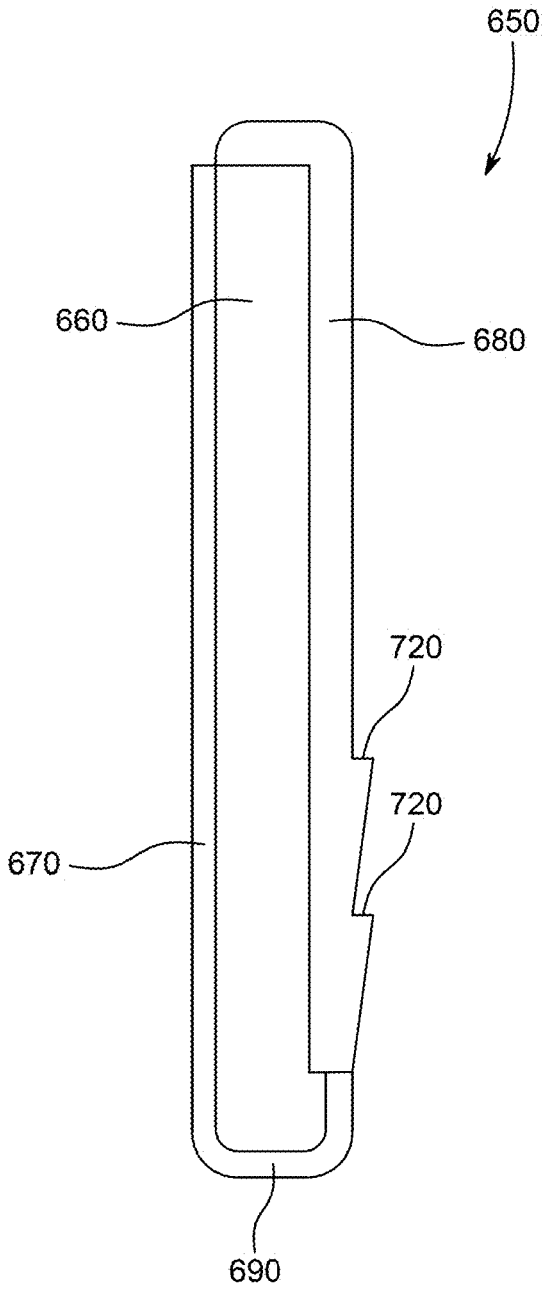
FIG. 31 schematically illustrates yet another detailed view of a shower perimeter component.

An exemplary shower perimeter component 650 of the second embodiment is illustrated in FIGS. 29-31. The shower perimeter component 650 includes three subcomponents—a body 660, an outer component 670 secured to the body 660, and an inner component 680 overmolded onto the body 660. The body 660 can be formed from a polymer such as polypropylene or other suitable material. The outer component 670 can be secured to the body through a number of methods including an adhesive or similar bonding agent. The outer component 670 can also be arranged such that a lower portion 690 of the outer component 670 wraps around the body 660 (as best illustrated in FIG. 31). The outer component 670 can be formed from a metal, such as for example 16-gauge galvanized steel, or any other suitable material. As noted above, the inner component 680 can be formed by an overmolding process using any number of polymers such as, for example, an elastomer or other such rubber or pliable material. In one embodiment, the inner component 680 can be formed from a vulcanized ethylene propylene diene monomer (EPDM). One such EPDM is branded as Santoprene™ and distributed by United States Plastic Corp.

Figure 32:
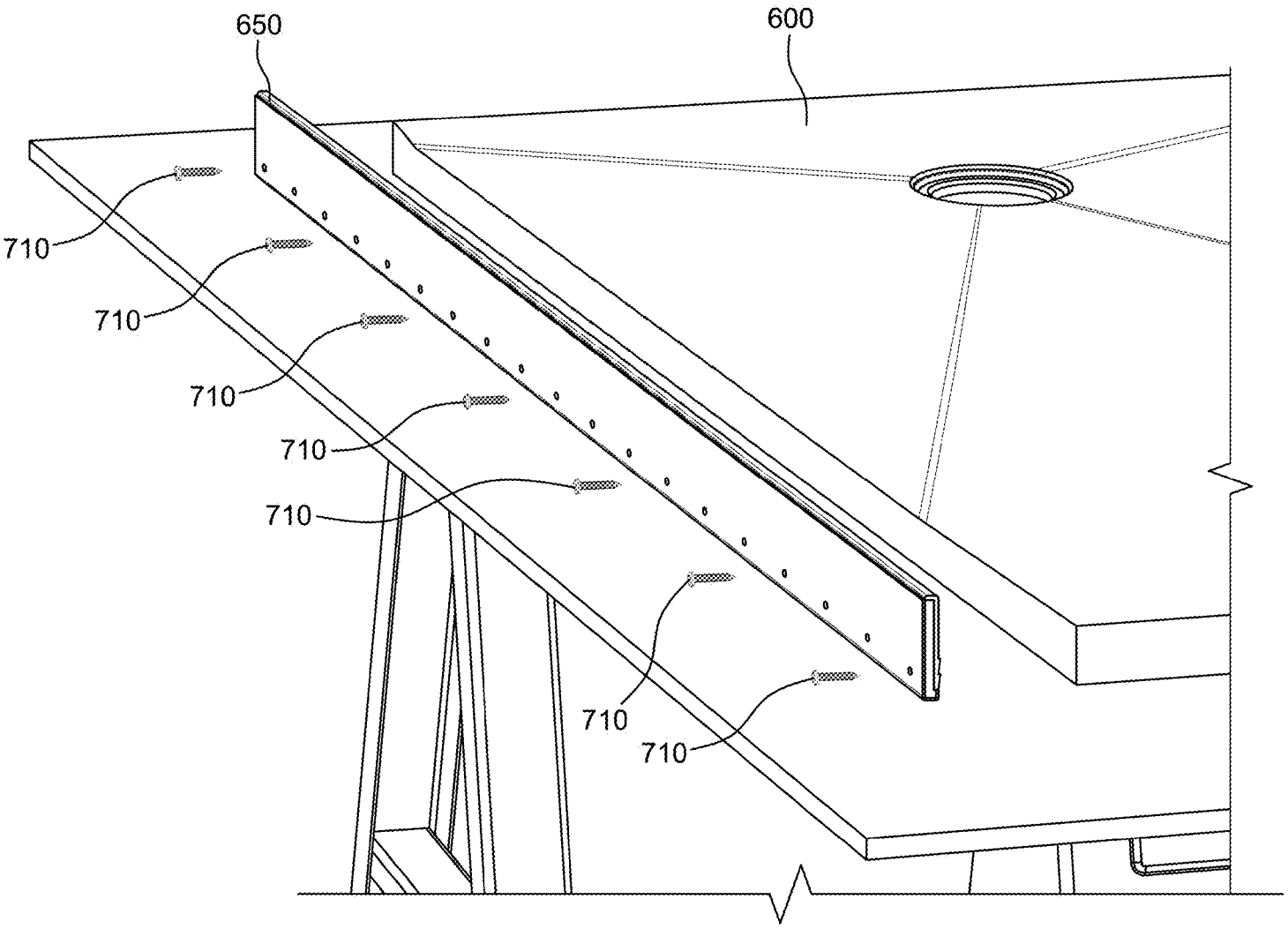
FIG. 32 schematically illustrates the assembly step of securing a shower perimeter component to a shower base.
Figure 33:
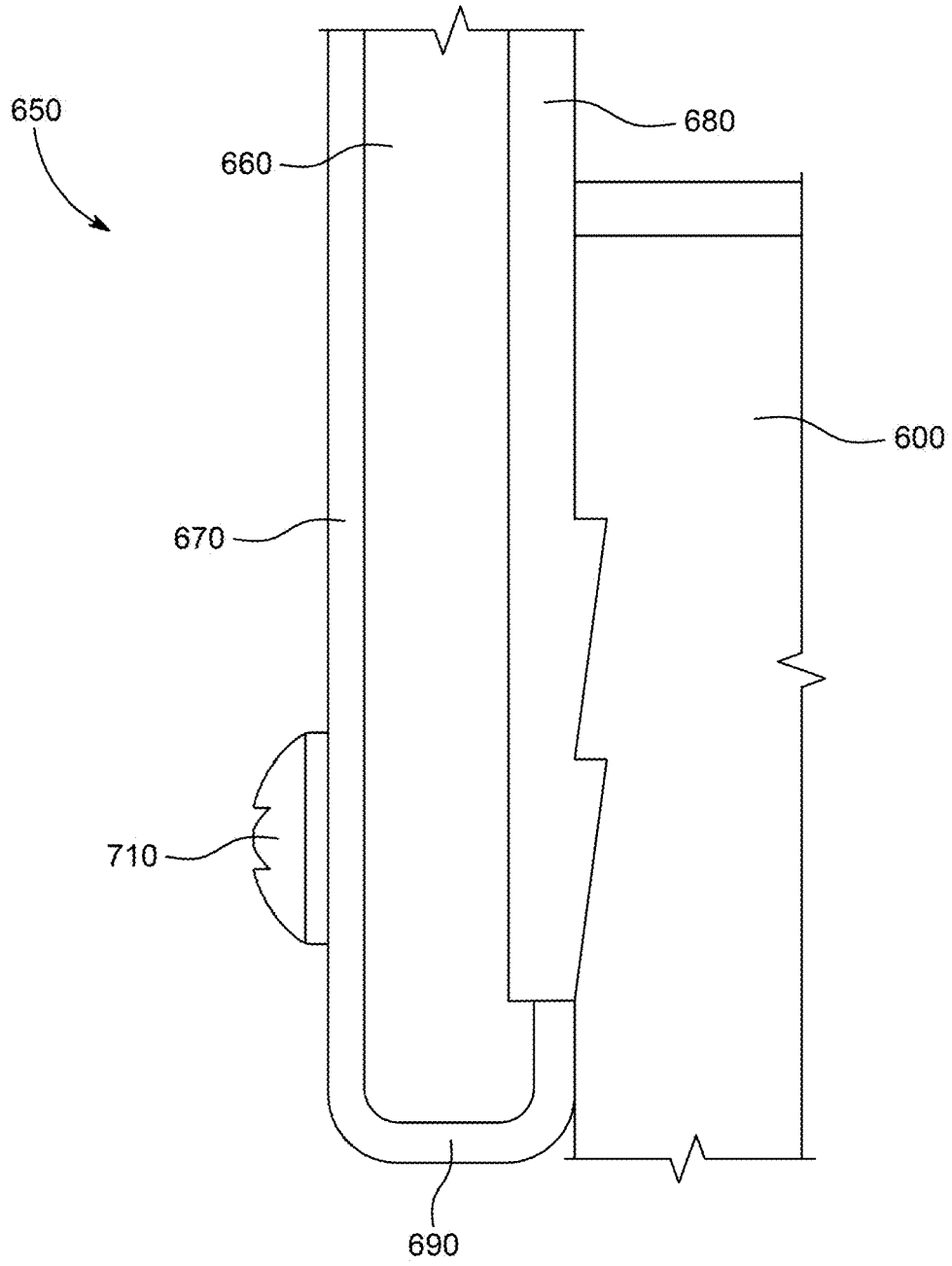
FIG. 33 schematically illustrates a side view of a shower perimeter component secured to a shower base.

As will be further described, when the shower perimeter component 650 is secured to a side edge of the shower base 600, the inner component 680 engages with such side edge to form a sealed and leak-proof interface between the shower perimeter component 650 and the shower base 600. As illustrated in FIGS. 32 and 33, the engagement of the shower perimeter component 650 with the shower base 600 is facilitated by a series of mounting holes 700 and a series of fasteners 710. The fasteners 710 can be screws, nails, and the like. The mounting holes 700 pass through the outer component 670, body 660, and inner component 680 of the shower perimeter component 650 so that each fastener 710 can be embedded in the side edge of the shower base 600. As best illustrated in FIG. 33, the lower portion 690 of the outer component 670 that wraps around the body 660 acts as a stop to prevent over-tightening of the fasteners 710. The inner component 680 includes a pair of barbs 720 extending from the free surface of the inner component 680 and are approximately in line with the mounting holes 700. It will be appreciated that because the barbs 720 extend from the free surface of the inner component 680, when the fasteners 710 are tightened, the barbs 720 (which are fabricated from an elastomeric or other pliable material) engage the shower base 600 and create a sealed and leak-proof interface between the shower perimeter component 650 and the shower base 600.

Figure 34:
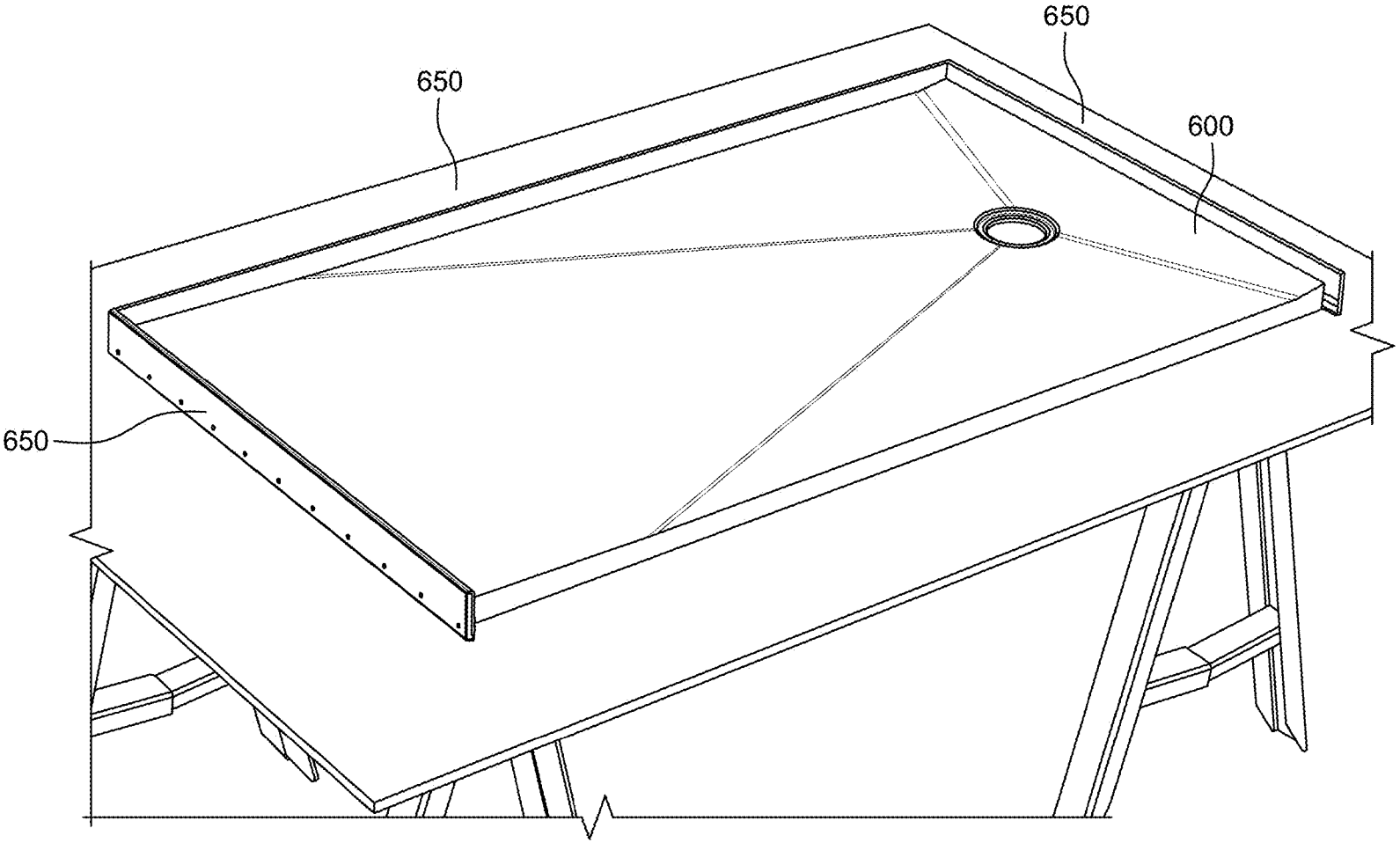
FIG. 34 schematically illustrates a perspective view of three shower perimeter component secured to three side edges of a shower base.
Figure 35:
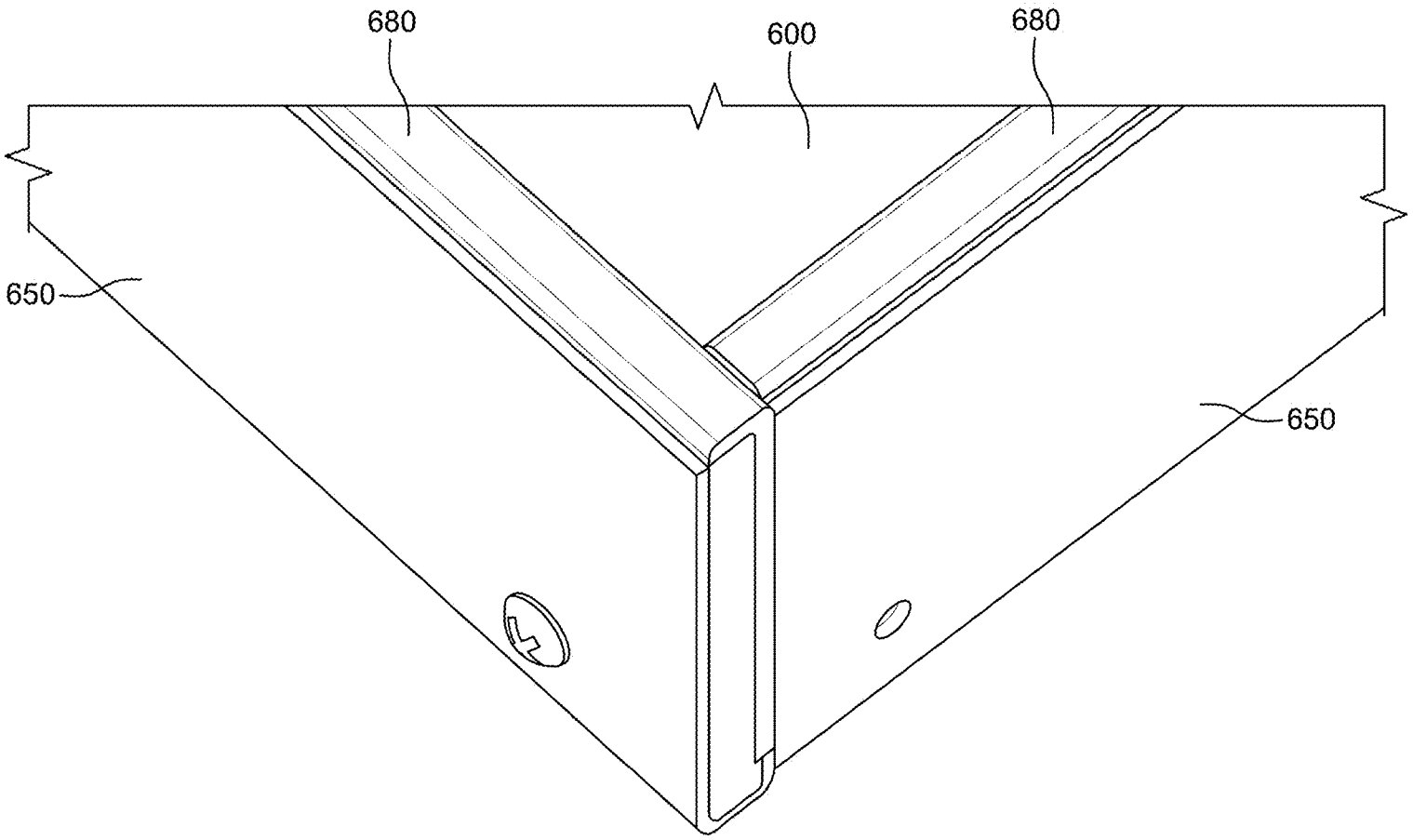
FIG. 35 schematically illustrates a detailed view of an overlapping joint of two shower perimeter components secured to two edges of a shower base.

FIG. 34 illustrates a subassembly 730 that includes three shower perimeter components 650 secured to three side edges of the shower base 600. In a subsequent assembly step, a threshold will be secured to the free side edge of the shower base 600. The sealed and leak-proof interface between the shower perimeter component 650 and the shower base 600 has been previously described. FIG. 35 illustrates the sealed and leak-proof interface between adjoining shower perimeter components 650. The adjoining shower perimeter components 650 form an overlapping joint where the inner components 680 of the adjoining shower perimeter components 650 engage to form a seal along the engagement. Thus, creating a sealed and leak-proof interface at the corners of the subassembly 730.

Figure 36:
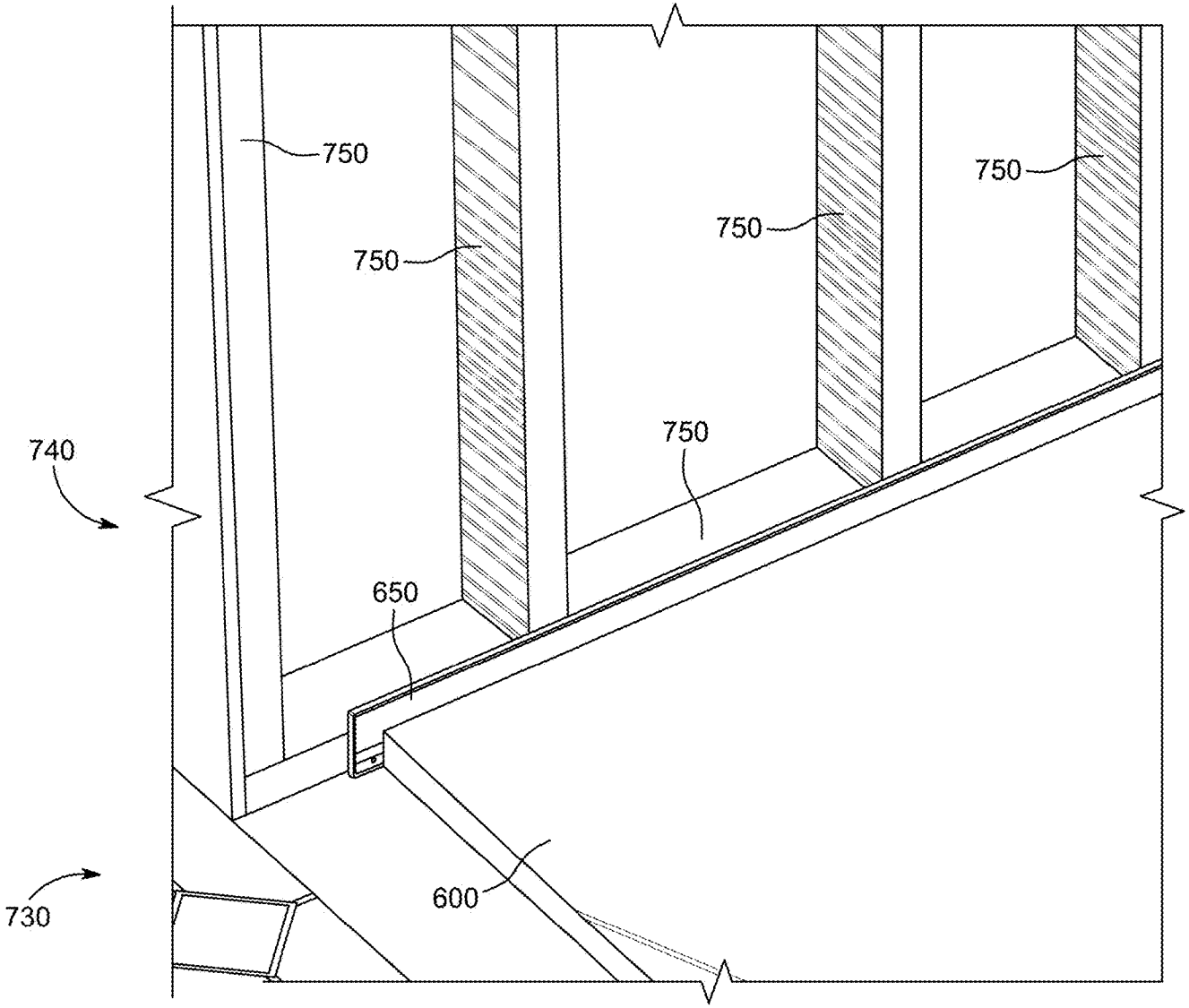
FIG. 36 schematically illustrates the positioning and installation of a subassembly within the framing of a shower.
Figure 38:
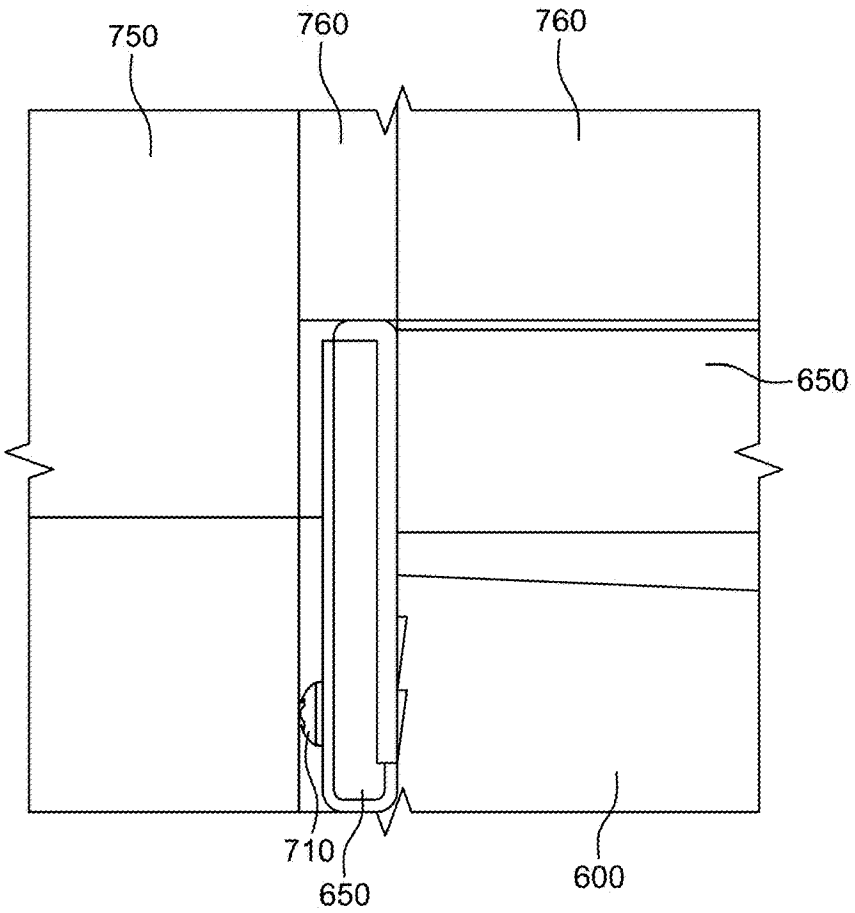
FIG. 38 schematically illustrates a side view of the installation of drywall proximate to the subassembly within a shower.
Figure 37:
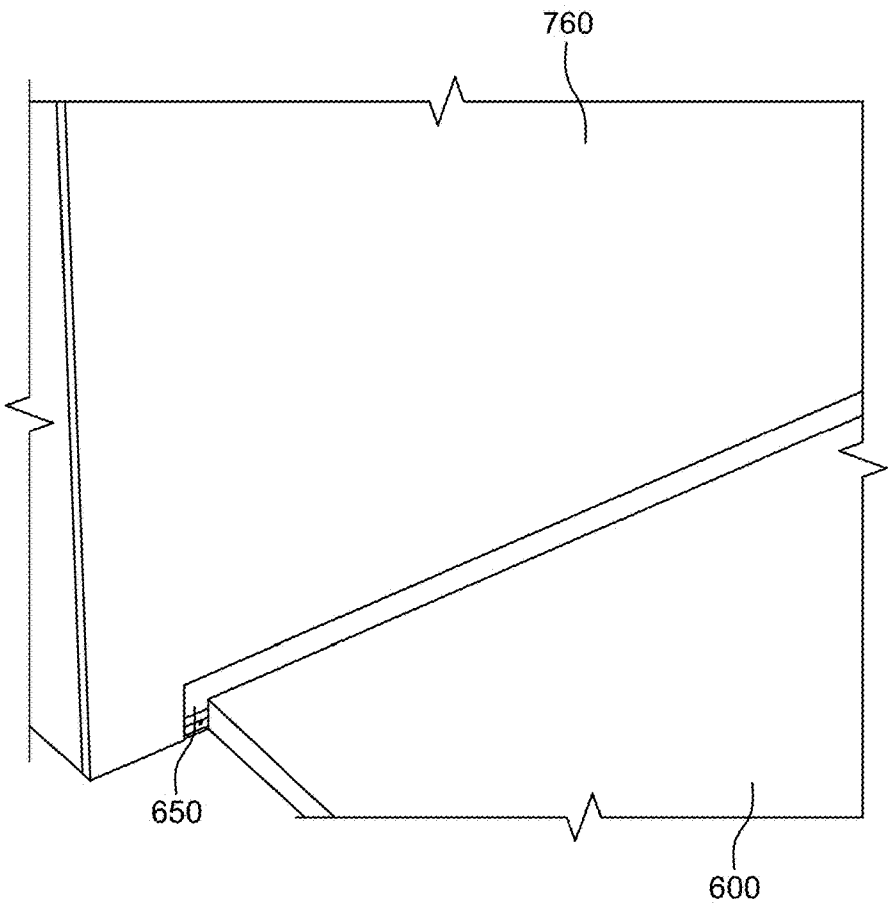
FIG. 37 schematically illustrates the installation of drywall proximate to the subassembly within a shower.

Once the subassembly 730 is completed, the installation process can begin. As illustrated in FIG. 36, framing 740 for the shower walls can be constructed from wall studs 750 (i.e., 2×4 wooden studs or other comparable structural elements). The framing 740 is carefully constructed to accommodate the custom size of the shower base assembly. Once the framing 740 is completed, the subassembly 730 is positioned such that the shower perimeter components 650 are in contact with and flush with the framing 740. Once the installer has inspected the positioning of the subassembly 730, as illustrated in FIG. 37, drywall 760 is installed by securing the drywall 760 to the framing 740. FIG. 38 illustrates a detailed front view of the positioning of the subassembly 730, wall studs 750, and drywall 760 after the completion of this installation step. It is noted that the drywall 760 is installed such that the bottom edge of the drywall 760 rests on top of the shower perimeter component 650.

Figure 40:
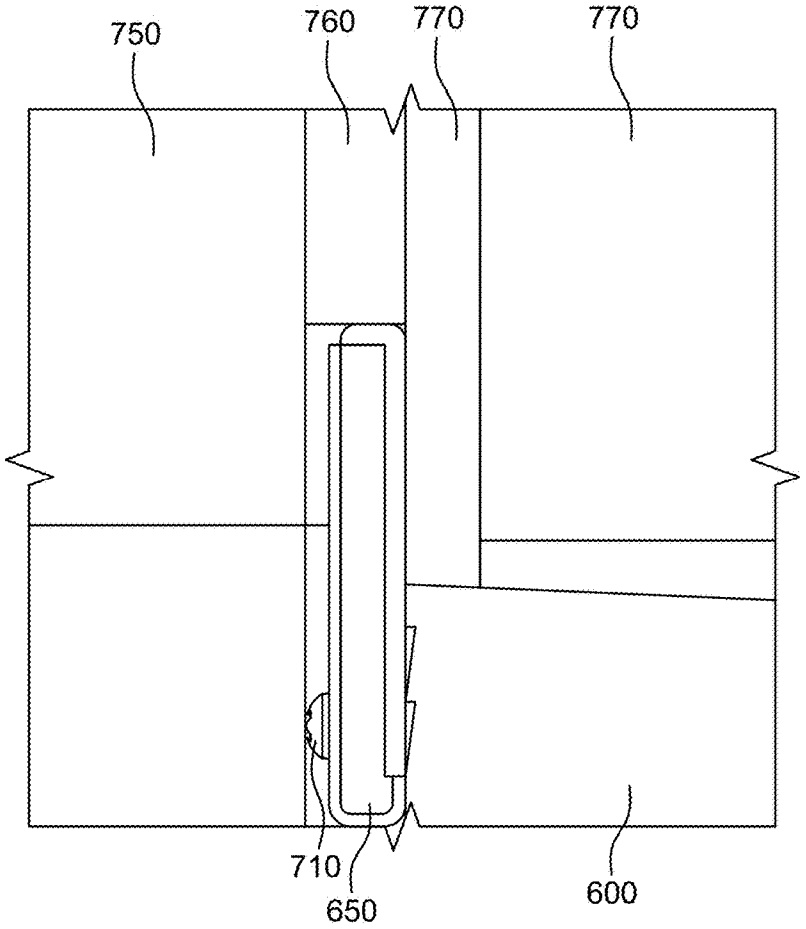
FIG. 40 schematically illustrates a side view of the installation of wall panels proximate to the subassembly within a shower.
Figure 39:
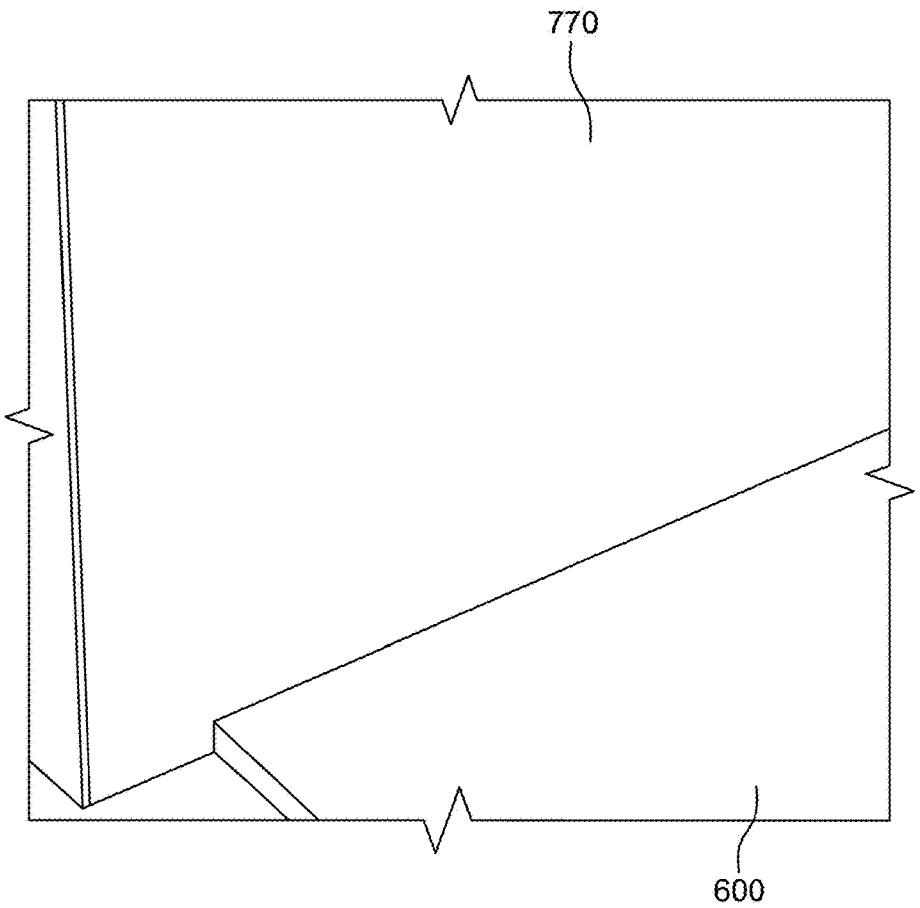
FIG. 39 schematically illustrates the installation of wall panels proximate to the subassembly within a shower.

Once the drywall 760 is installed and inspected, as illustrated in FIG. 39, wall panels 770 (i.e., water-resistant panels that form the inside vertical surfaces of the shower) are installed onto the drywall 760. The wall panels 770 can be fabricated from a combination of materials such as fiberglass resin, silica, and quartz. The wall panels 770 can be fabricated using a molding process to achieve the desired dimensions and shape. One type of applicable wall panel 770 is commonly referred to in the industry as an onyx shower panel. FIG. 40 illustrates a detailed front view of the positioning of the subassembly 730, wall studs 750, drywall 760, and wall panels 770 after the completion of this installation step. It is noted that the wall panels 770 are installed such that the bottom edge of the wall panels 770 rests on top of shower base 600 and a vertical surface of the wall panels 770 engage with the free vertical surface of the shower perimeter component 650 (i.e., the free surface of the inner component 680).

Figure 41:
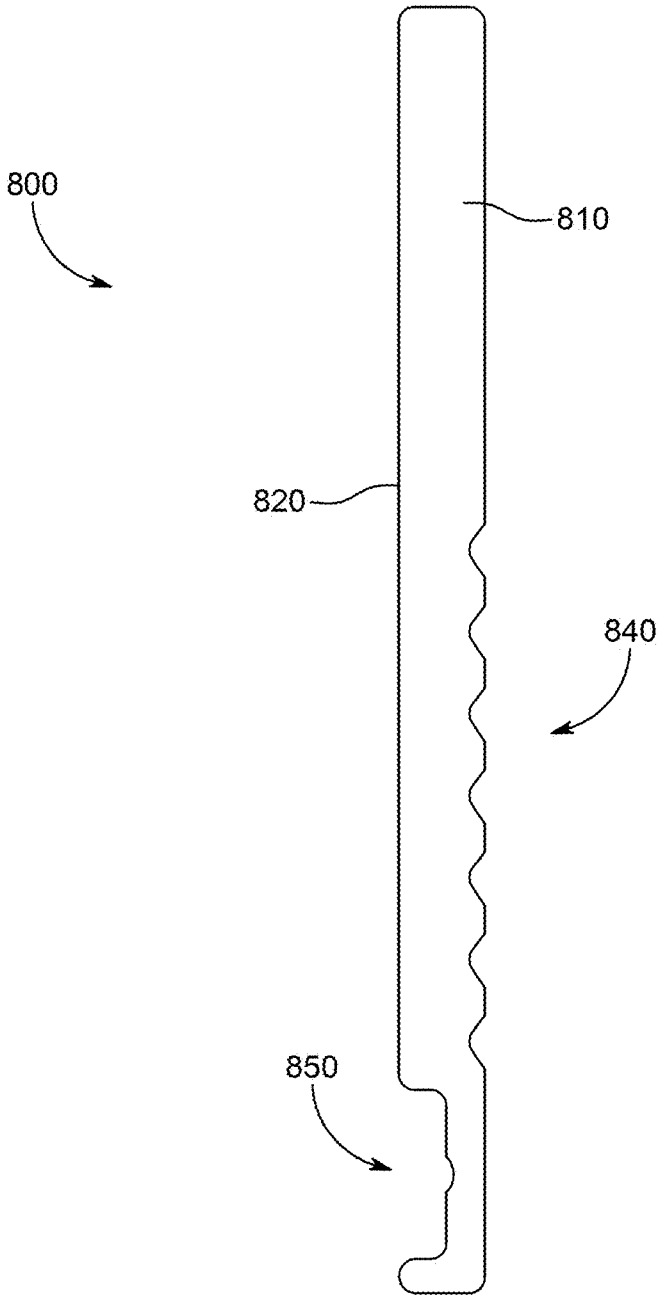
FIG. 41 schematically illustrates a side view of another embodiment of a shower perimeter component.
Figure 42:
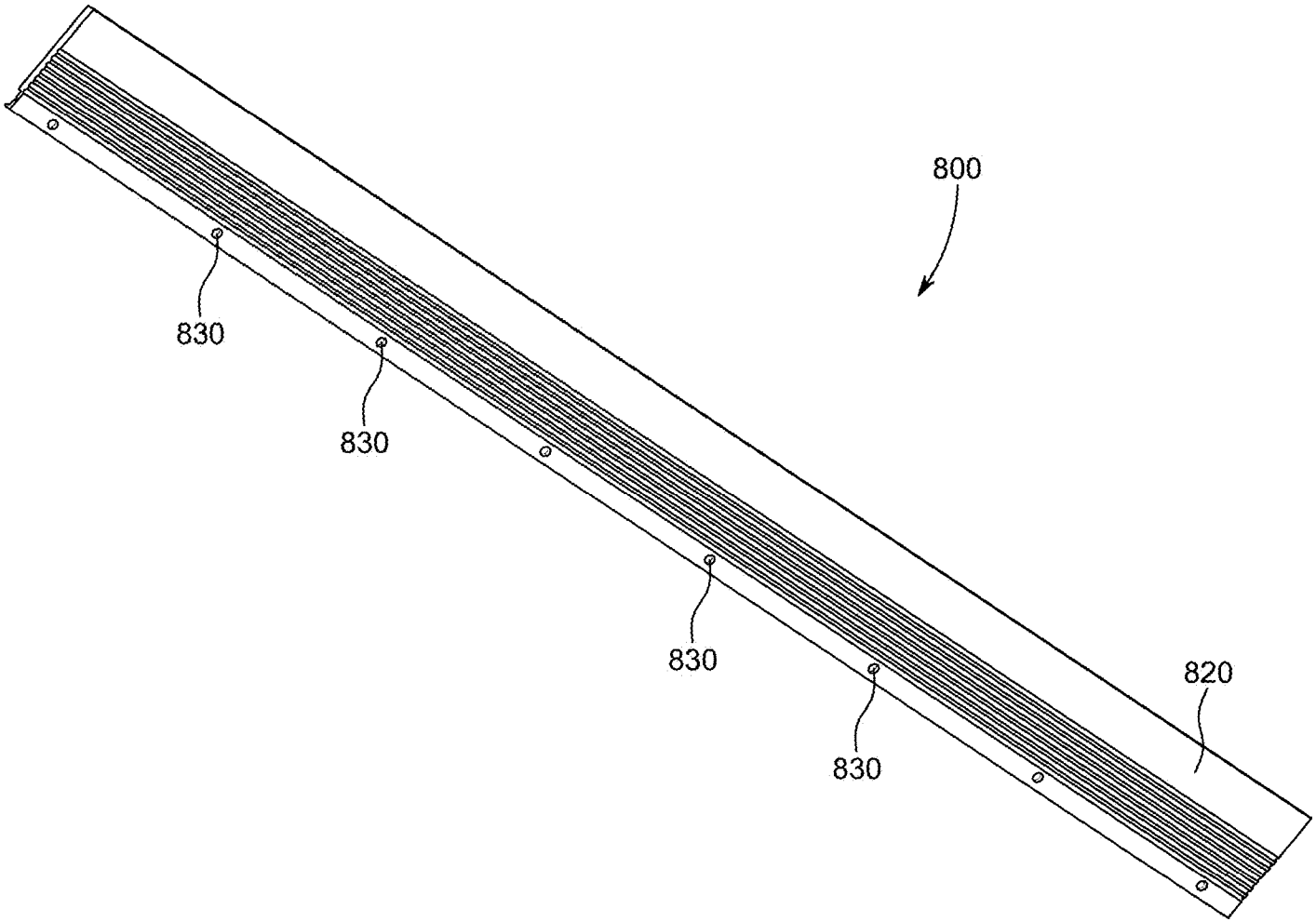
FIG. 42 schematically illustrates a perspective view of the shower perimeter component of FIG. 41.
Figure 43:
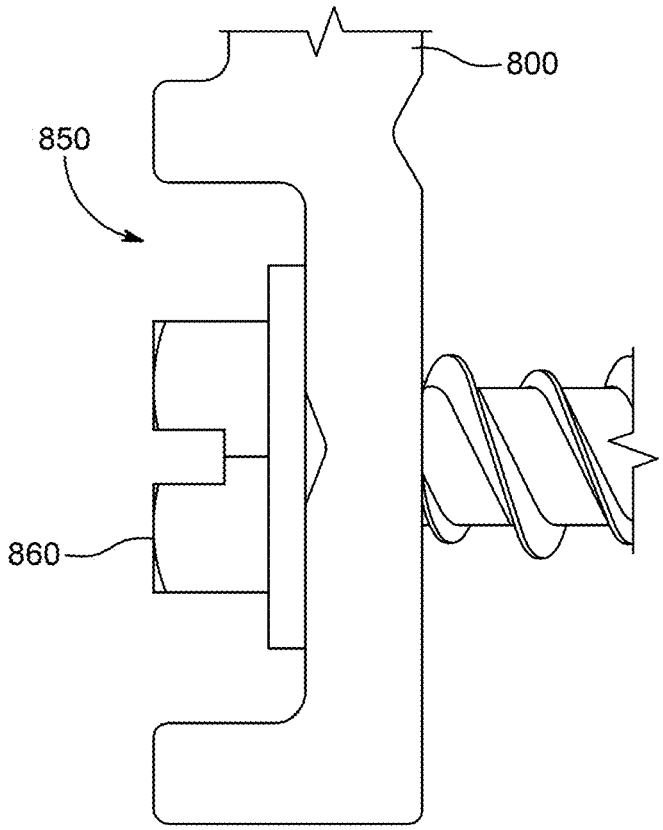
FIG. 43 schematically illustrates a side view of a portion of the shower perimeter component of FIG. 41 with a screw passing through the shower perimeter component.

FIGS. 41-43 illustrate another embodiment of a shower perimeter component 800. The shower perimeter component 800 includes a number of features that provide for easy installation and a secure seal once installed. The shower perimeter component 800 can be manufactured through a number of different processes and from a number of different materials such as, for example, injection molded from a polymer resin, extruded from any polymer resin, extruded from any metal, or molded from any engineered resin. The resulting shower perimeter component 800 can be arranged to be secured to a shower base with fasteners such as nails and screws and an adhesive such as a methyl methacrylate adhesive. Such an adhesive can also improve a water-tight seal between the shower base and the shower perimeter component 800.

The shower perimeter component 800 includes a side 810 that is arranged to engage the shower base and a side 820 that is arranged to engage a wall of the home or a shower enclosure. The initial engagement of the shower perimeter component 800 with a shower base can be facilitated by a series of mounting holes 830 (illustrated in FIG. 42) through which a series of fasteners, such as nails, can be passed to secure the shower perimeter component 800 to the shower base. The shower base side 810 includes a series of v-shaped recessions 840 that are arranged to increase the bonding area for any adhesive optionally used to secure and seal the shower perimeter component to the shower base. In one assembly method, an adhesive can be applied to the shower base side 810 and nails can be passed through the mounting holds to hold the shower perimeter component in place while the adhesive cures. The wall side 820 of the shower perimeter component 800 includes a large recess 850 arranged to accommodate a series of fasteners 860, such as screws. The recess 850 is arranged so that the head of the fastener 860 is fully within the recess 850 once fully installed. Thus, the head of the fastener 860 will not interfere with the shower perimeter component's 800 engagement with a wall or shower enclosure. The recess 850 is further arranged to accommodate any tools required to install the fastener 860. The fasteners 860 are spaced out along the length of the shower perimeter component 800 and used to tightly secure the shower perimeter component 800 to the shower base to promote a water-tight seal. This is particularly effective when an adhesive used is a flexible adhesive and can be further compressed by the forces applied by the fasteners 860 to further enhance the seal. It will be appreciated that the shower perimeter components illustrated and described herein are only examples, and other arrangements of shower perimeter components that share features and attributes of those described herein can also be used with modular shower kits as described herein.

Figure 44:
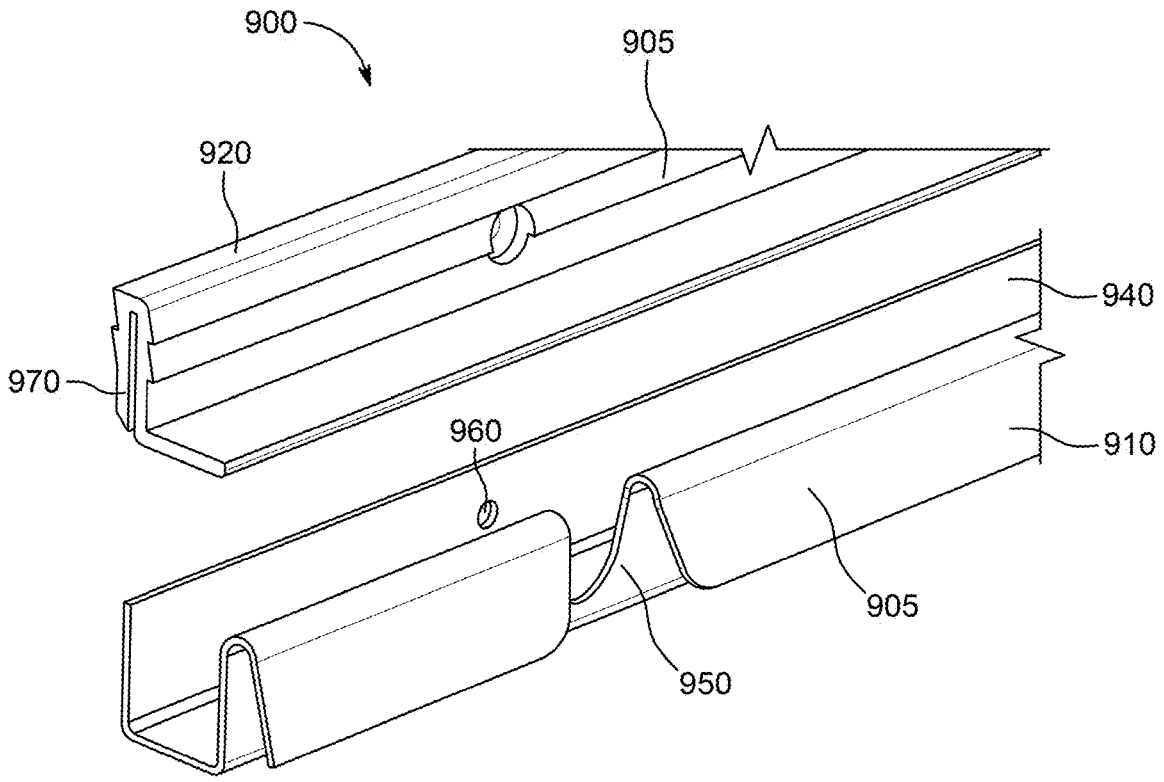
FIG. 44 schematically illustrates an exploded view of a threshold bracket and gasket.
Figure 45:
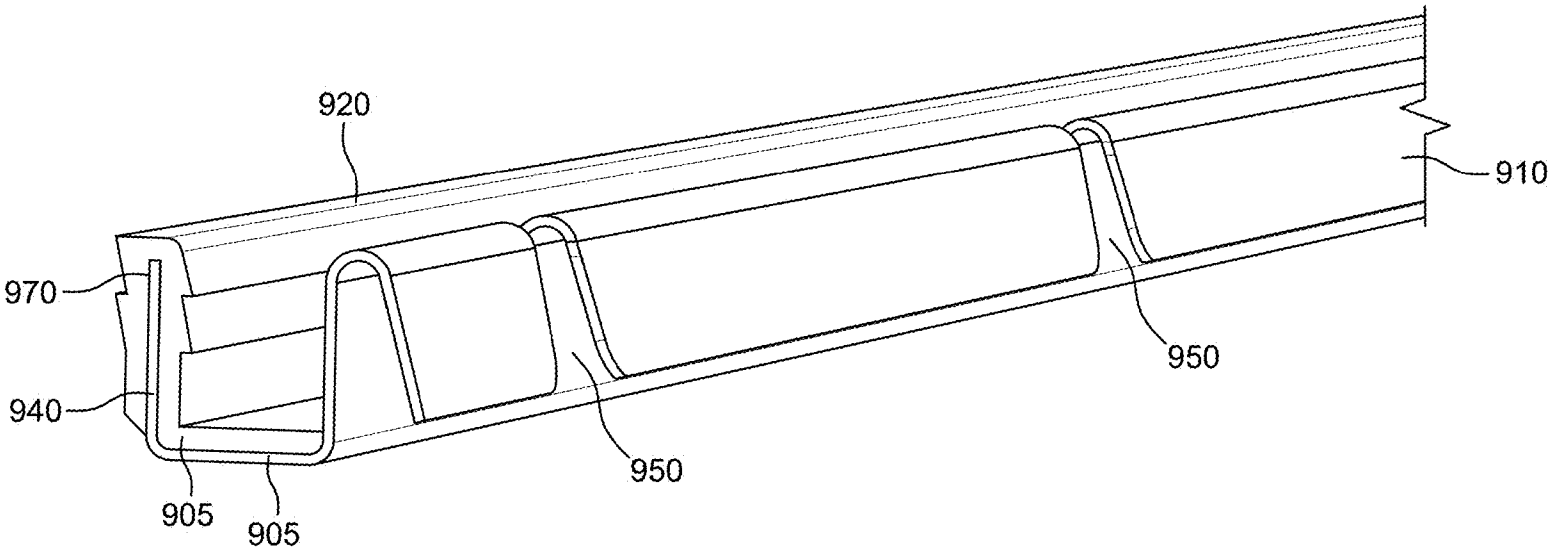
FIG. 45 schematically illustrates an assembled view of a threshold bracket and gasket.

Once the wall panels 770 are installed and inspected, a threshold 900 can be secured to the subassembly 730. A threshold 900 includes three main threshold components 905—a threshold bracket 910, a gasket 920, and a threshold curb 930. The threshold bracket 910 and gasket 920 are illustrated in FIGS. 44 and 45, the threshold curb is illustrated in FIGS. 50-54. The threshold bracket 910 is typically fabricated from a rigid material. In one example, the threshold bracket 910 is fabricated by stamping or bending sheet metal. The threshold bracket 910 includes a vertical extension 940 to accommodate the gasket 920 (as will be subsequently described) and a series of cutouts 950 and apertures 960 to facilitate securing the threshold bracket 910 and gasket 920 to the shower base 600 (as will also be subsequently described). The gasket 920 includes a slot 970. The gasket 920 can be fabricated from an elastomeric or other pliable material. In one embodiment, the gasket 920 is fabricated from a material that has a relatively low hardness as determine by durometer testing.

Figure 46:
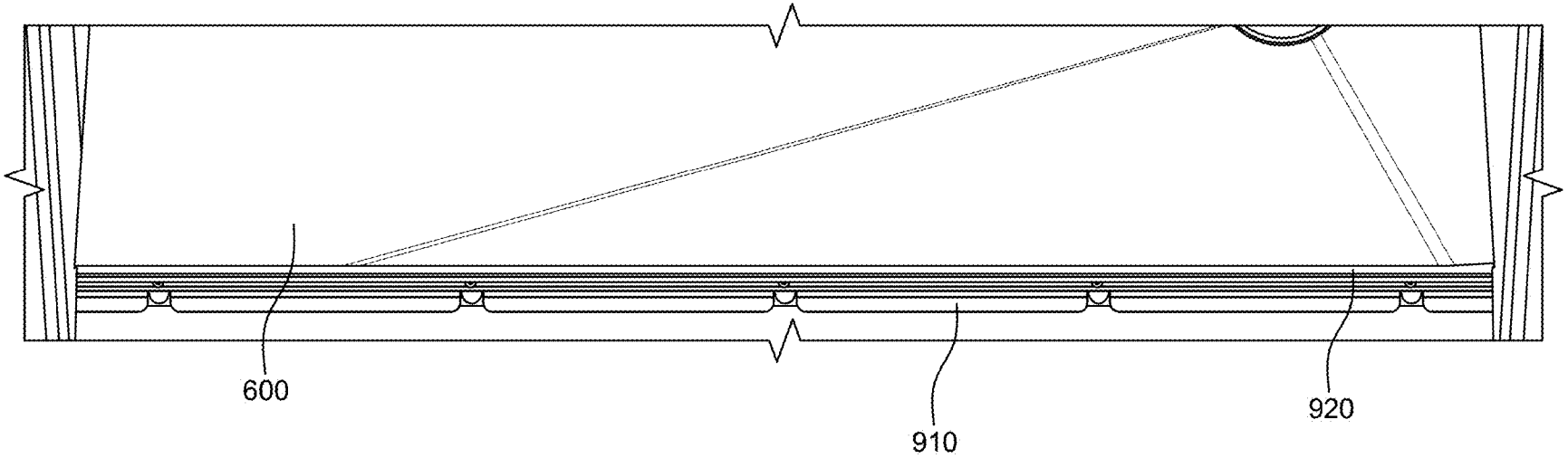
FIG. 46 schematically illustrates a threshold bracket and gasket secured to a shower base.
Figure 47:
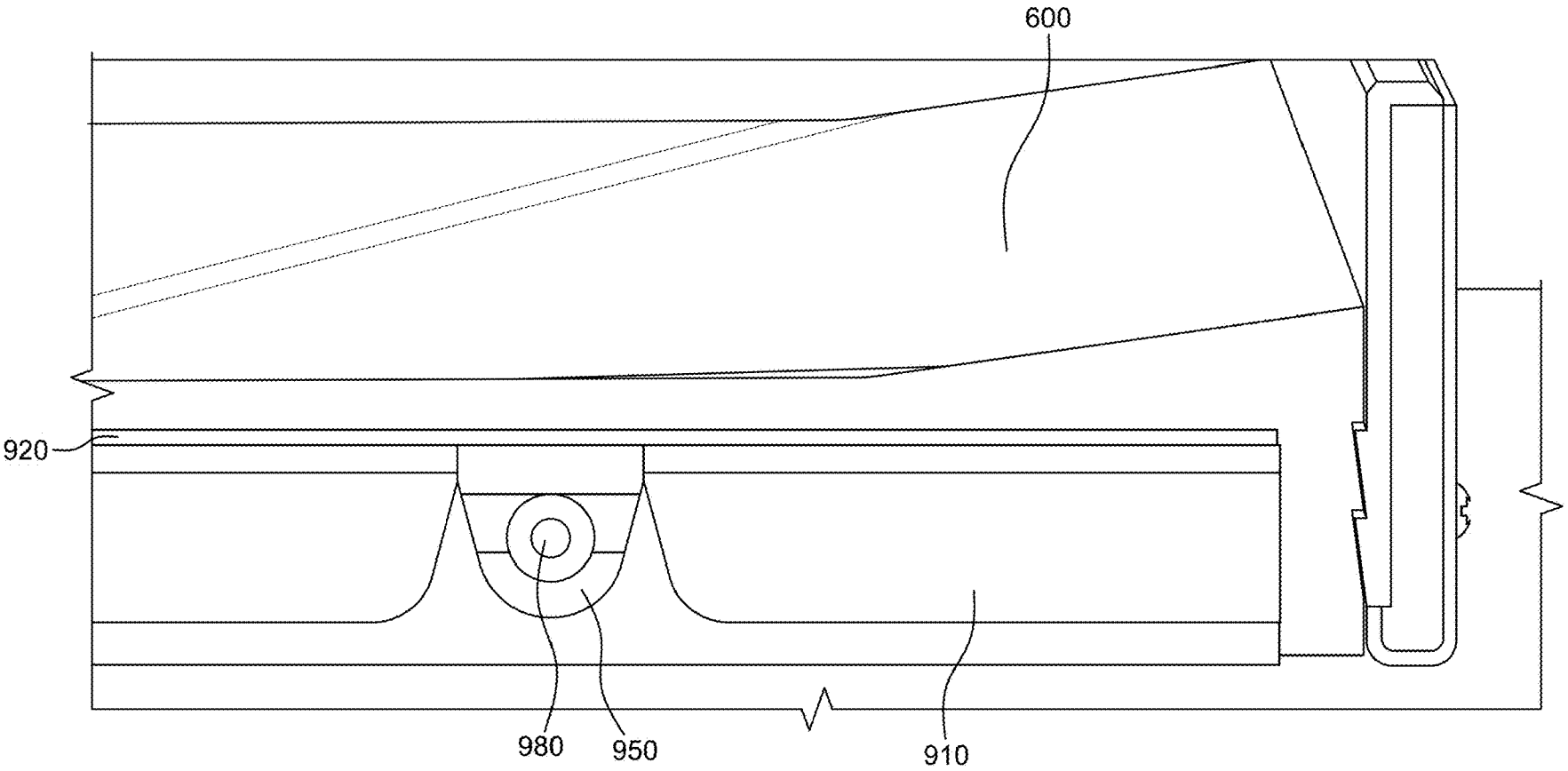
FIG. 47 schematically illustrates a detailed view of a threshold bracket and gasket secured to a shower base.
Figure 48:
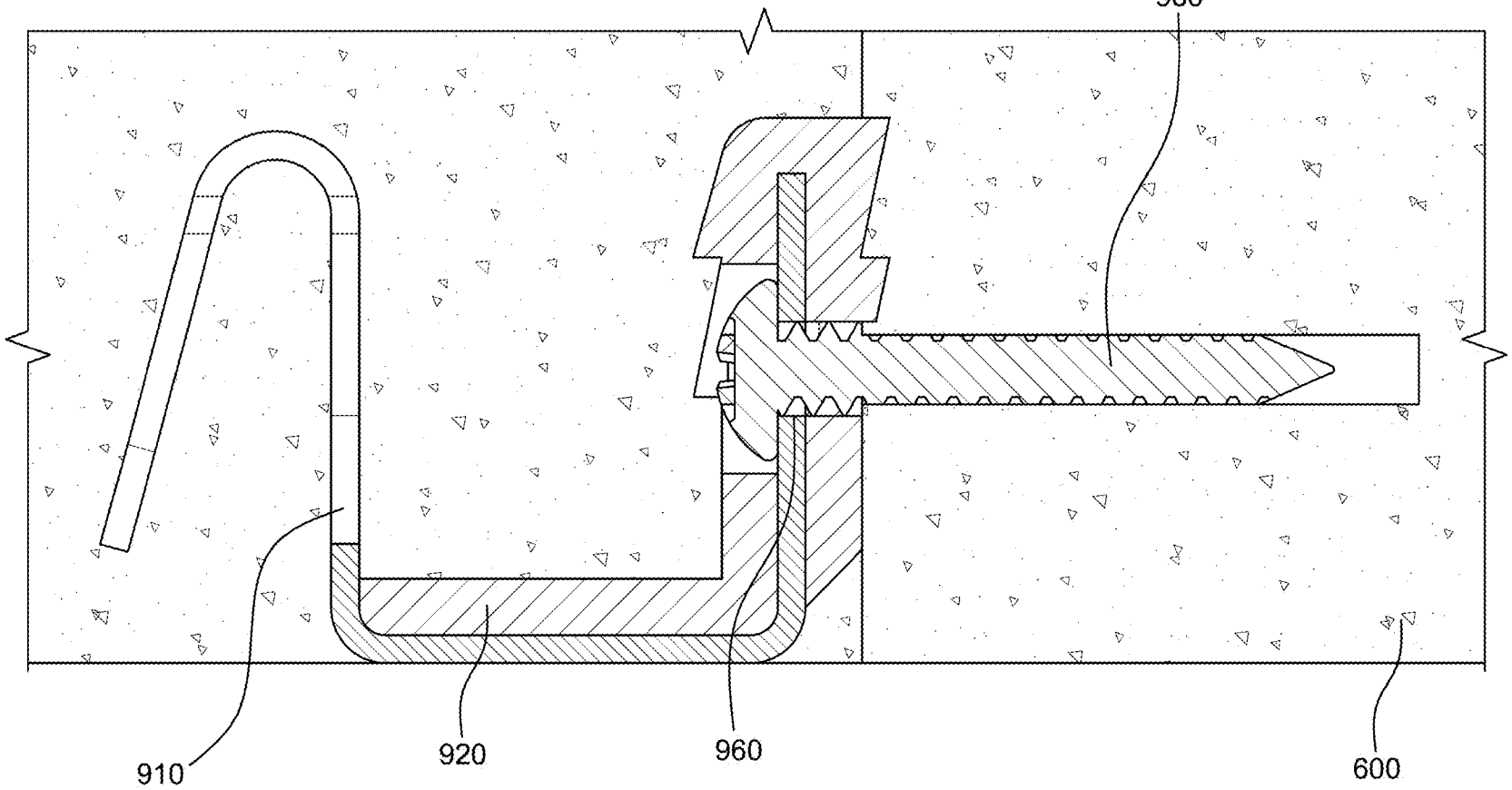
FIG. 48 schematically illustrates another detailed view of a threshold bracket and gasket secured to a shower base.

With reference again to FIGS. 44 and 45, the gasket 920 is positioned onto the threshold bracket 910 by inserting the vertical extension 940 of the threshold bracket 910 into a slot 970 of the gasket 920. Once the gasket 920 and threshold bracket 910 are assembled, the assembly is secured to the shower base 600. Similar to the shower perimeter component 650, the threshold 910 and gasket 920 assembly is secured to the shower base 600 by a series of fasteners 980 passing through the series apertures 960 in the threshold bracket 910 (as illustrated in FIGS. 46-48). The assembled threshold bracket 910 and gasket 920 are placed in contact with the free side edge of the shower base 600, with the gasket 920 in contact with the shower base 600. The cutouts 950 provide access to the apertures 960 in the vertical extension 940 of the threshold bracket 910. The positioning of the gasket 920 results in a portion of the gasket 920 covering both sides of the apertures 960. However, a recess 990 in the gasket 920 can be aligned with each aperture 960 in the threshold bracket 910 so that the installer can identify the locations of the apertures 960 in the threshold bracket 910.

Figure 49:
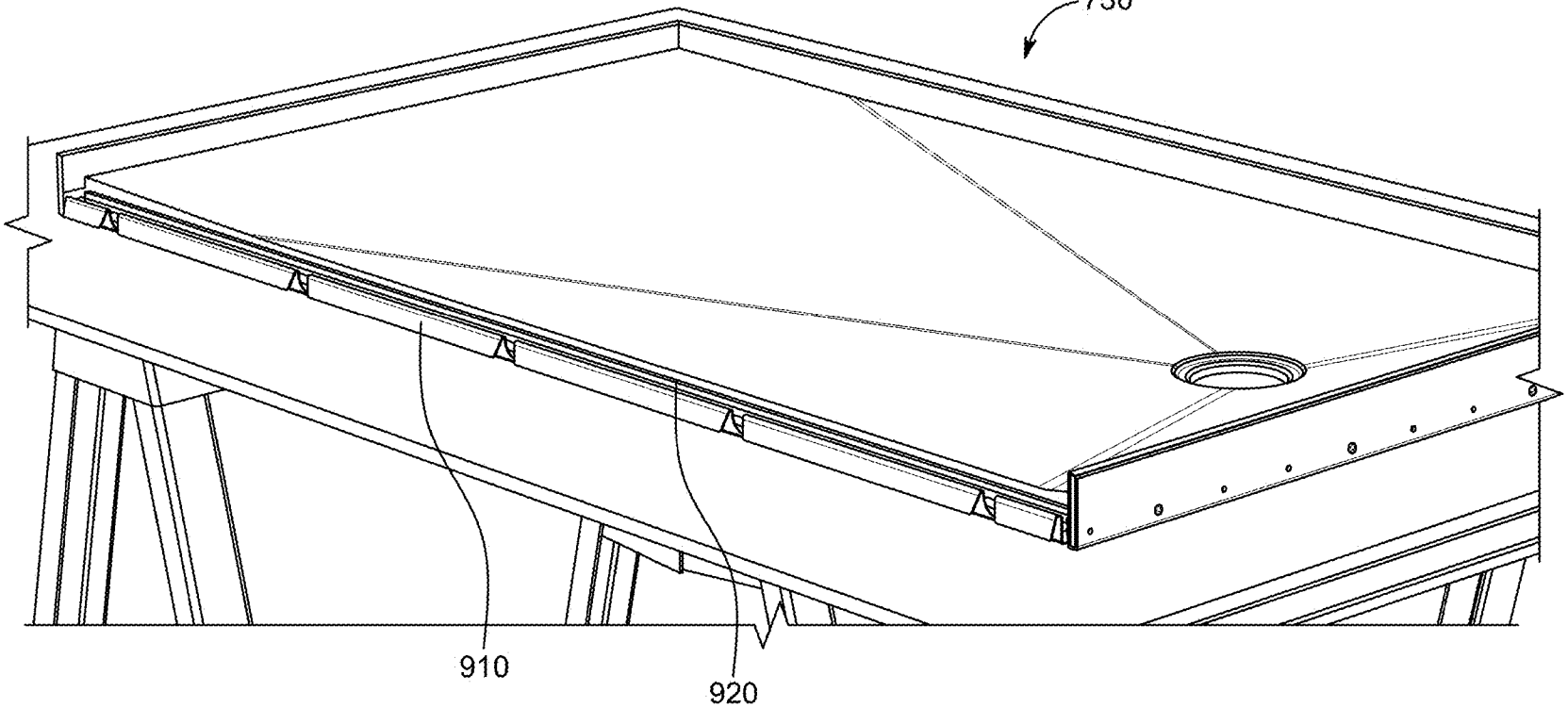
FIG. 49 schematically illustrates an alternative arrangement for securing a threshold bracket and gasket to a shower base.
Figure 50:
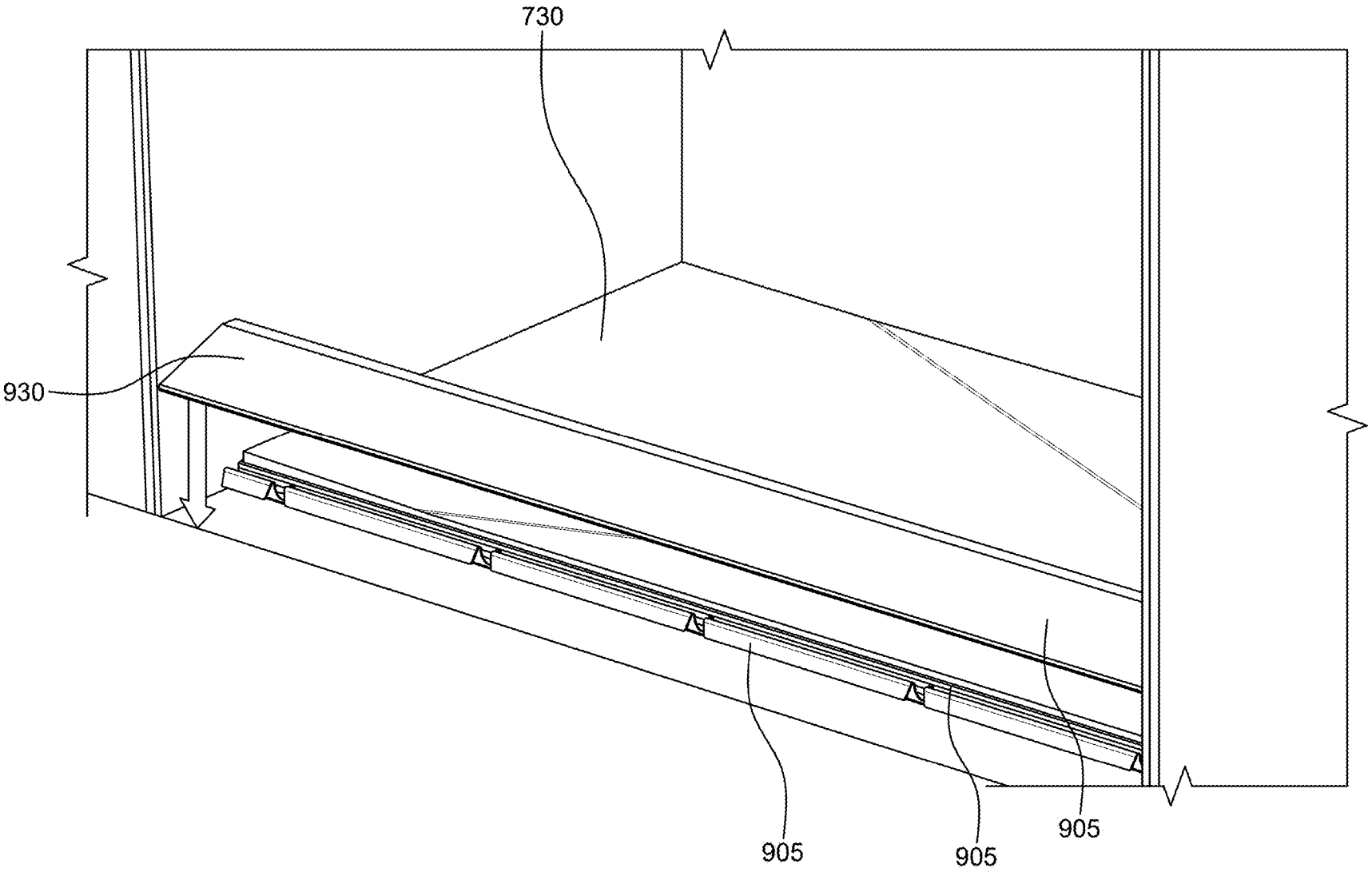
FIG. 50 schematically illustrates an assembly step for securing a threshold curb to a threshold bracket and gasket.
Figure 51:
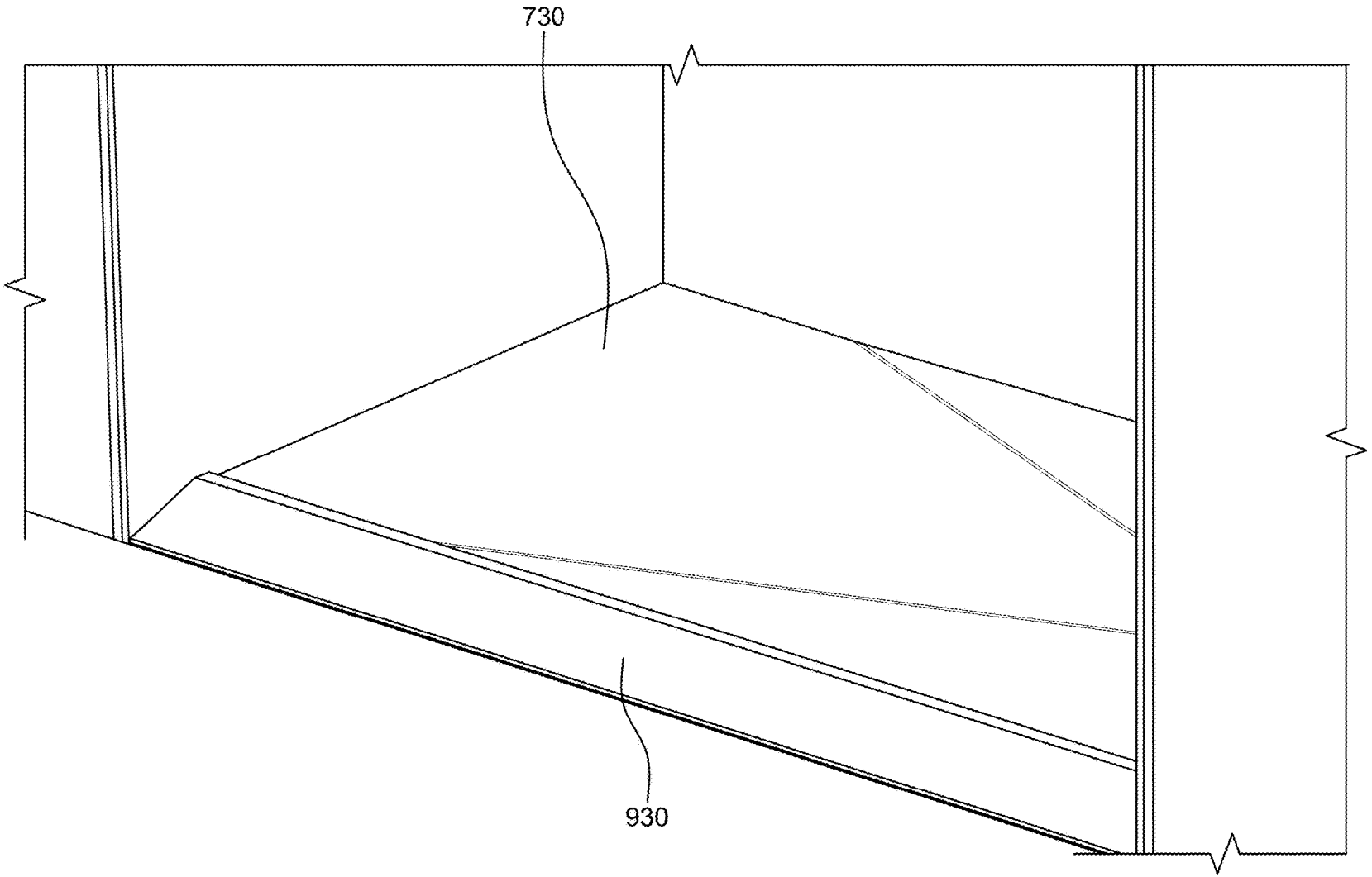
FIG. 51 schematically illustrates a threshold curb secured to a threshold bracket and gasket.

Once the assembled threshold bracket 910 and gasket 920 are correctly positioned relative to the shower base 600, an installer can use the cutouts 950 to insert a fastener 980 through each recess 990 in the gasket 920, which will result in the fastener 980 passing through the corresponding aperture 960 in the threshold bracket 910, through the backside of the gasket 920, and into the side edge of the shower base 600. The installer can tighten the fasteners 980 to ensure contact between the gasket 920 and the side edge of the shower base 600 and form a sealed and leak-proof interface between the gasket 920 and the shower base 600. Alternatively, in addition to fasteners, the install may also use an adhesive such as, for example, a methyl methacrylate adhesive between the gasket 920 and the shower base 600 to further secure the components together and ensure a water tight seal. While the disclosure describes the threshold bracket 910 and gasket 920 as secured to the shower base 600 after the subassembly 730 is installed in the shower location, as illustrated in FIG. 49, the threshold bracket 910 and gasket 920 can be secured to the subassembly 730 prior to installation in the shower location.

Figure 52:
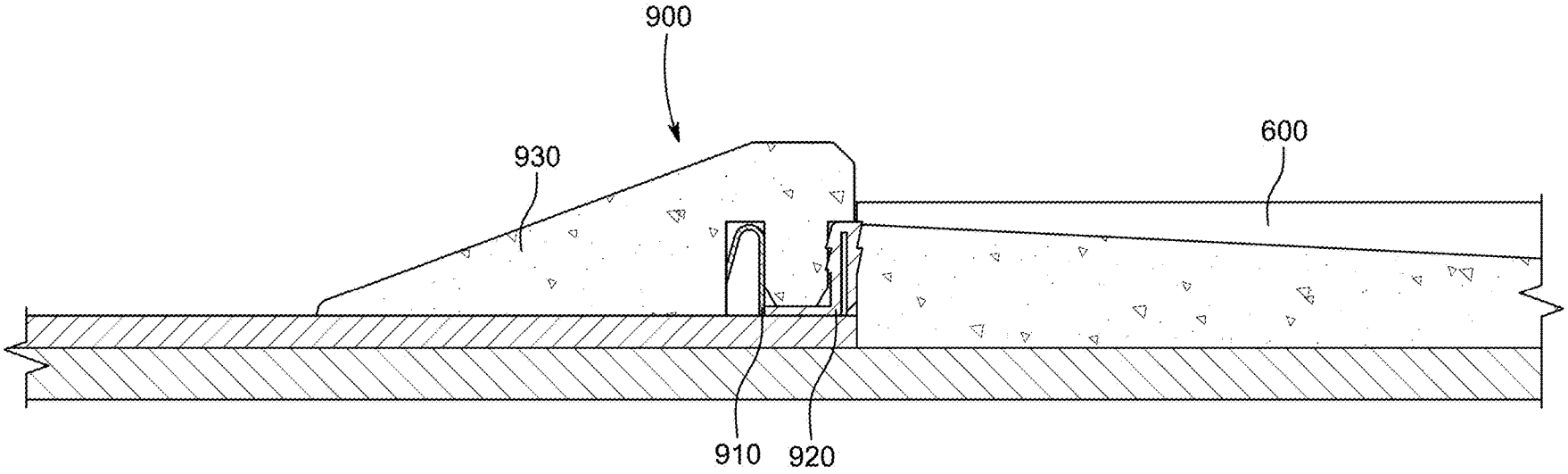
FIG. 52 schematically illustrates a detailed view of a threshold curb secured to a threshold bracket and gasket.
Figure 53:
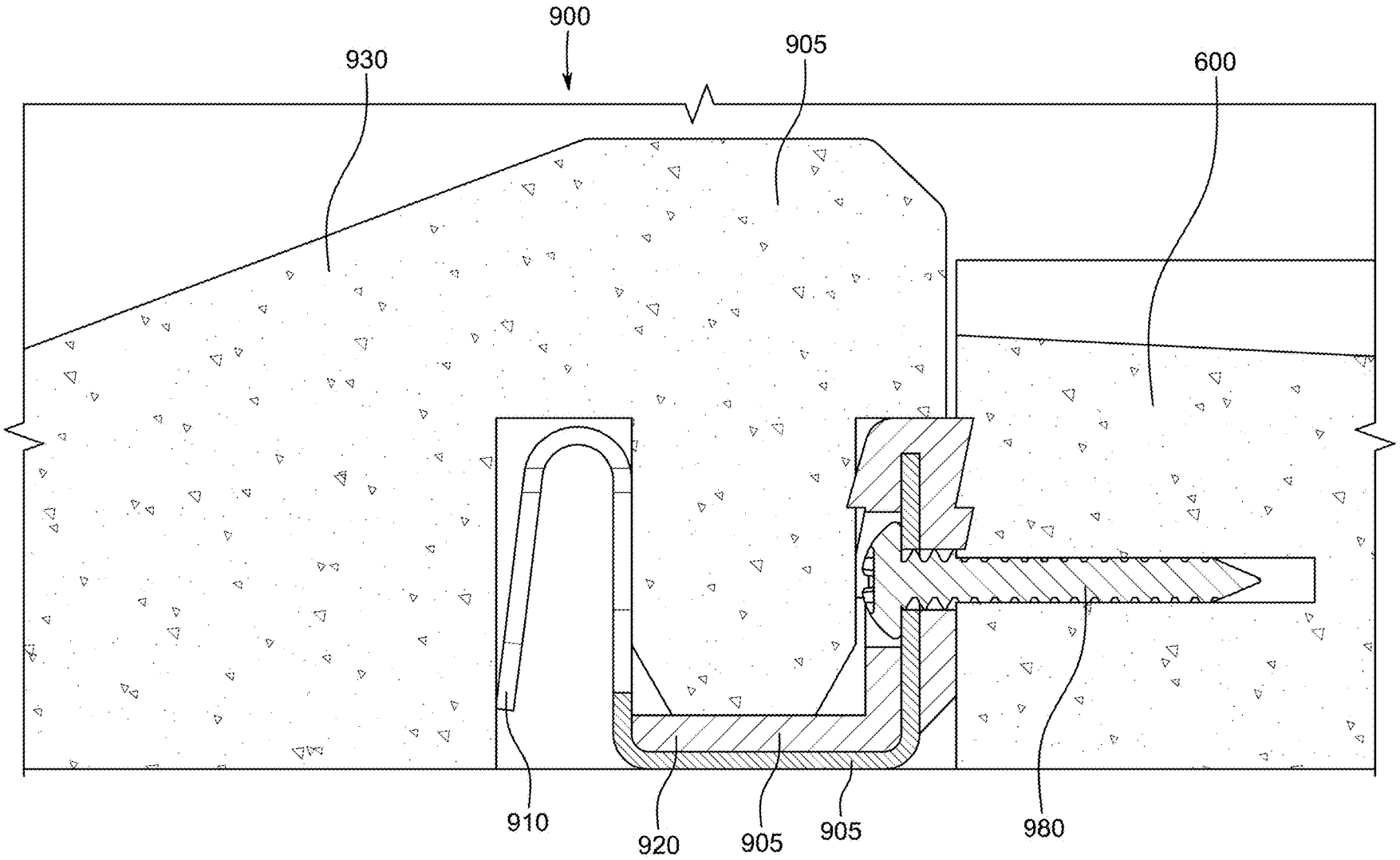
FIG. 53 schematically illustrates another detailed view of a threshold curb secured to a threshold bracket and gasket.

Once the threshold bracket 910 and gasket 920 are secured to the subassembly 730, a threshold curb 930 can be secured to the threshold bracket 910 and gasket 920 to complete the threshold 900. FIGS. 53-53 illustrate such an assembly step. The threshold curb 930 is arranged so that it can engage in an interference fit between the threshold bracket 910 and gasket 920 (as illustrated in FIGS. 52 and 53). The installer positions the threshold curb 930 above the threshold bracket 910 and gasket 920 and applies a downward force on the threshold curb 930 until it is seated between the threshold bracket 910 and gasket 920. The elastic nature of the gasket 920 and the flexibility of the vertical extension 940 of threshold bracket 910 work cooperatively to facilitate an interference fit with the threshold curb 930. This final assembly step completes the shower base assembly.

Figure 54:
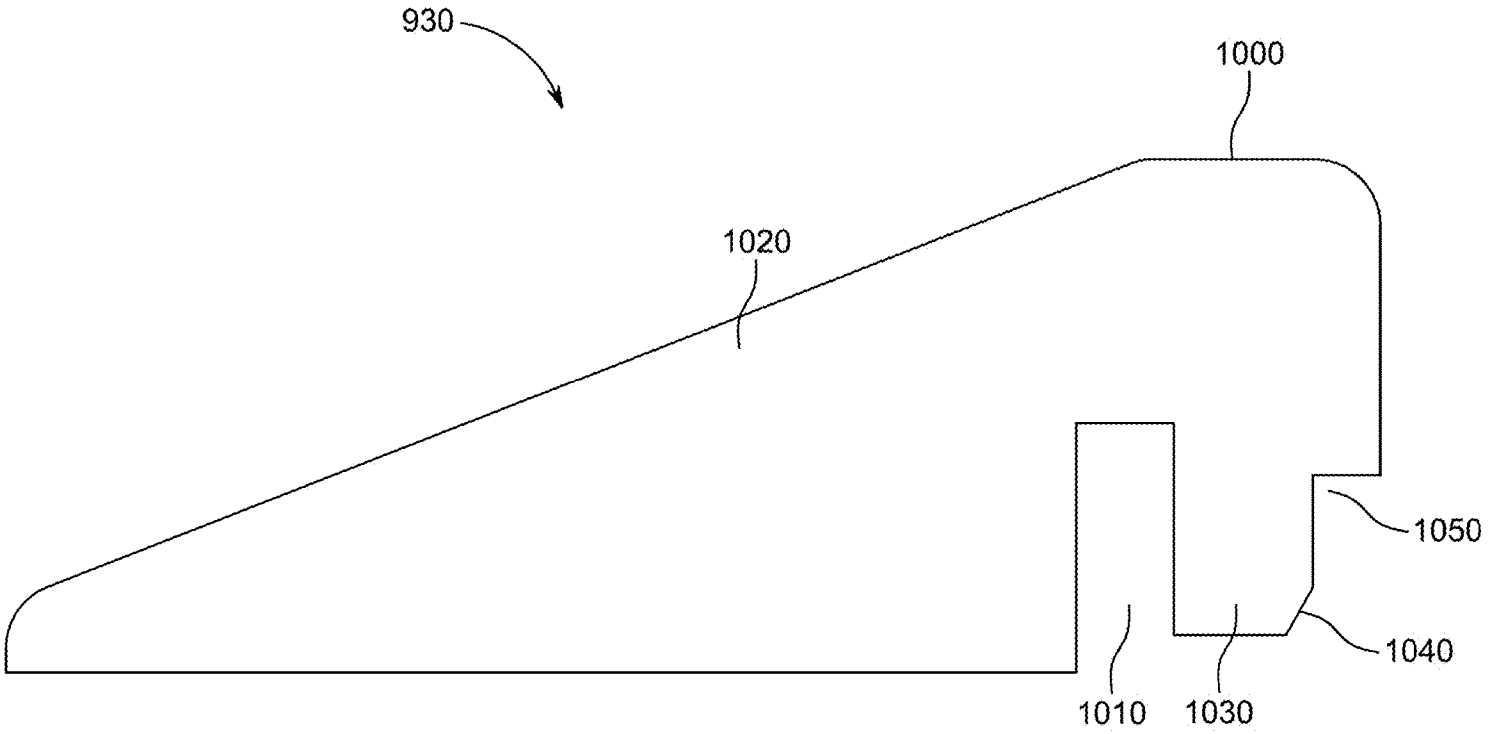
FIG. 54 schematically illustrates a side view of the threshold curb.

FIG. 54 illustrates a side view of the threshold curb 930. The top surface 1000 of the threshold curb 930 includes a negative slope to encourage water to flow back into the shower base and further channeling of the water to the drain. The threshold curb 930 includes a channel 1010 running between the body 1020 of the threshold curb 930 and a downward extending leg 1030. The channel 1010 and leg 1030 are arranged to engage with the threshold bracket 910 and gasket 920 combination. The leg 1030 includes a chamfered corner 1040 to facilitate the insertion of the threshold curb 930 (and particularly the leg 1030) into the threshold bracket 910 and gasket 920 combination. The threshold curb 930 further includes a cut away 1050 on the opposite side of the leg 1030 as the channel 1010. This cut away 1050 provides for three points of contact between the threshold curb 930 and the gasket 920 to form an effective mechanical seal between the threshold curb 930 and the gasket 920.

Figure 55:
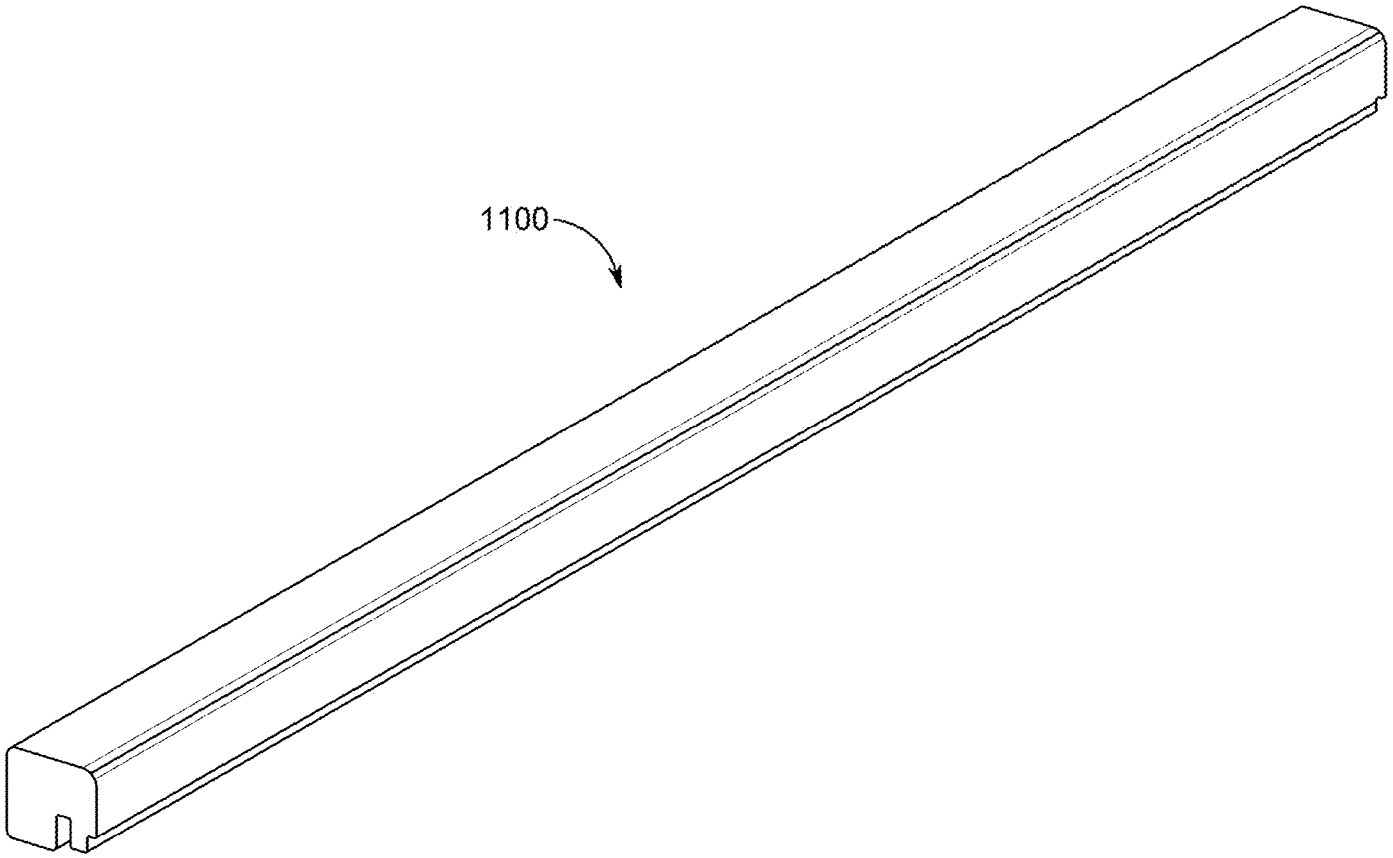
FIG. 55 schematically illustrates a perspective view of another embodiment of a threshold curb.
Figure 56:
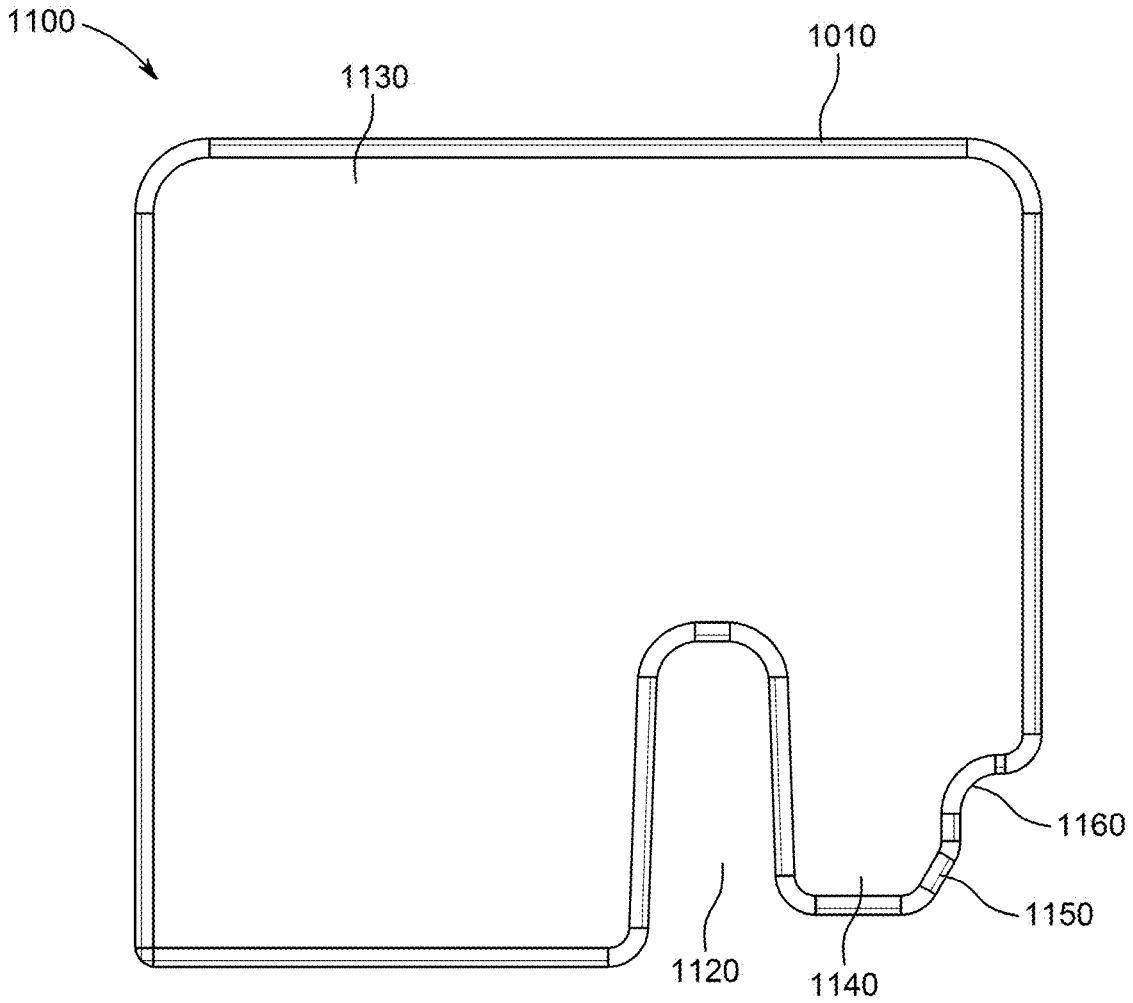
FIG. 56 schematically illustrates a side view of the threshold bracket of FIG. 55.

FIGS. 55-56 schematically illustrate another embodiment of a threshold curb 1100. The inclusion of this threshold curb 1100 with a shower base assembly results in a design that is somewhat similar to the shower base 230 illustrated in FIGS. 5-8. The top surface 1110 of the threshold curb 1100 includes a negative slope to encourage water to flow back into the shower base and further channeling of the water to the drain. The threshold curb 1100 includes a channel 1120 running between the body 1130 of the threshold curb 1100 and a downward extending leg 1140. The channel 1120 and leg 1140 are arranged to engage with a threshold bracket and gasket combination. The leg 1140 includes a chamfered corner 1150 to facilitate the insertion of the threshold curb 110 (and particularly the leg 1140) into a threshold bracket and gasket combination. The threshold curb 1100 further includes a cut away 1160 on the opposite side of the leg 1140 as the channel 1120. This cut away 1160 provides for three points of contact between the threshold curb 1100 and a gasket to form an effective mechanical seal between the threshold curb 1100 and the gasket.

Figure 57:
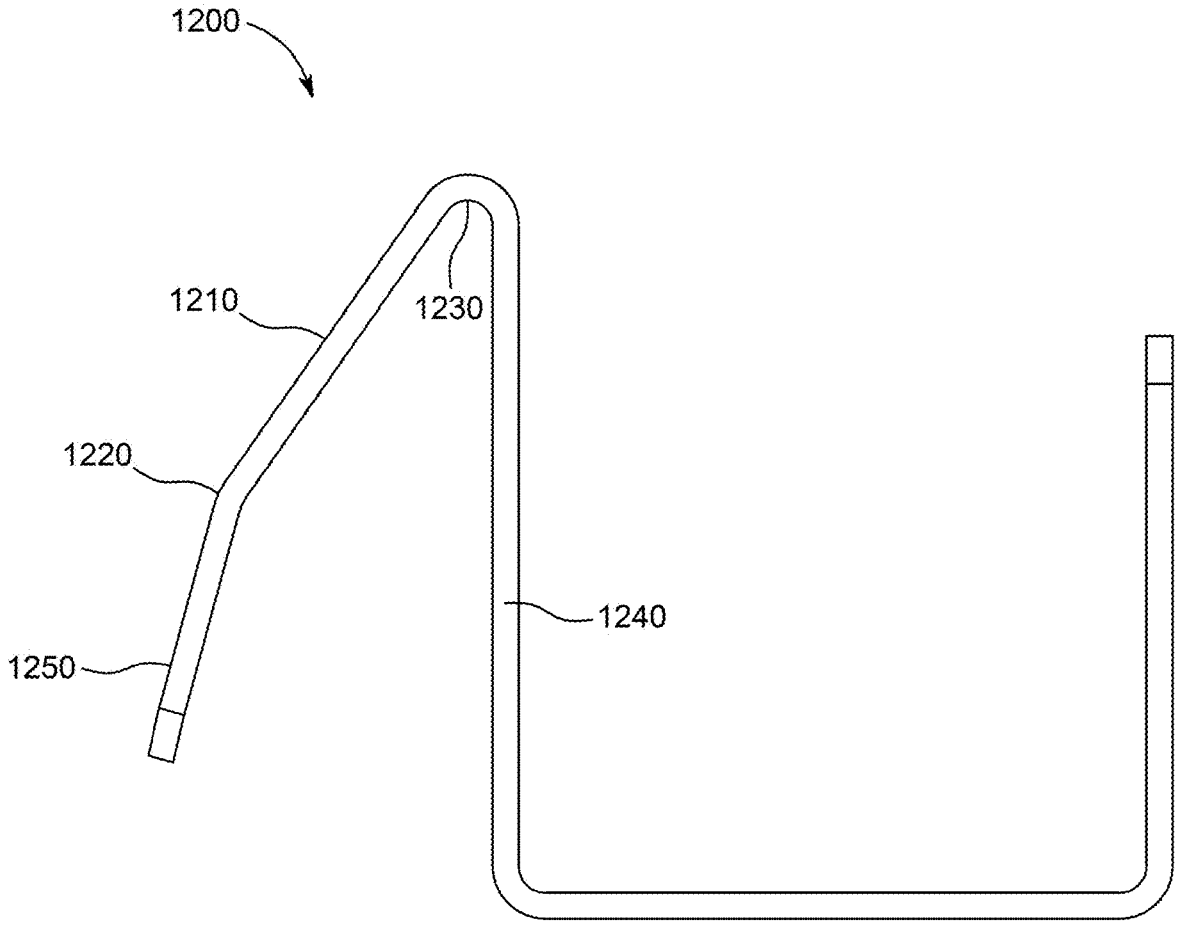
FIG. 57 schematically illustrates a perspective view of another embodiment of a threshold bracket.

FIG. 57 schematically illustrates another embodiment of a threshold bracket 1200. The threshold bracket 1200 is similar to prior descriptions but differs in the arrangement of a leading channel 1210 formed in the threshold bracket 1200. The bend 1220 formed in the leading channel 1210 and the radius 1230 of the intersection of the leading channel 1210 and the body 1240 of the threshold bracket 1200 result in the leading channel 1210 acting as a spring. Such spring like action allows an installer to insert the threshold bracket 1200 into a threshold curb by pushing the threshold curb downward until the threshold curb settles into the threshold bracket 1200. Such action causes the leading channel 1210 to compress like a spring and secure the threshold curb tightly to the threshold bracket 1200. Once the threshold bracket 1200 is installed into a threshold curb, a section 1250 extending downward from the bend 1220 acts as a barb that resists the threshold curb being separated from the threshold bracket 1200.

Figure 58:
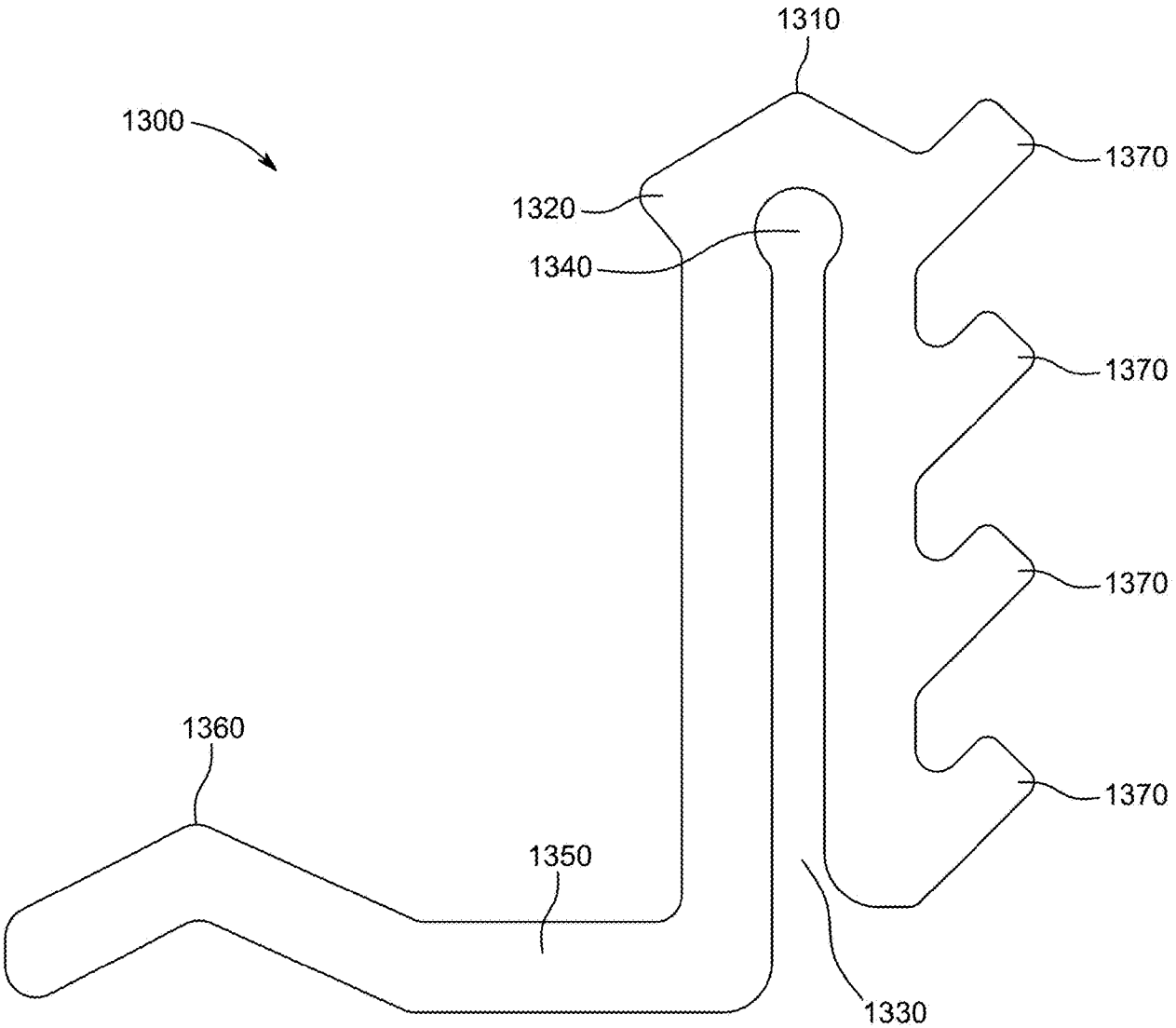
FIG. 58 schematically illustrates a perspective view of another embodiment of a threshold gasket.

FIG. 58 schematically illustrates another embodiment of a threshold gasket 1300. The threshold gasket 1300 includes a peaked top surface 1310; a nub 1320 extending outward near the edge of the top surface 1310; a slot 1330 with a cylindrical opening 1340 at the top of the slot 1330; an extending leg 1350 with a peak 1360 in the extending leg 1350; and a series of extending flanges 1370. Once a threshold curb is assembled onto a threshold gasket 1300, the peaked top surface 1310 and nub 1320 engage with the interior surfaces of the threshold curb and effectuate a seal between the threshold gasket 1300 and the threshold curb. The opening 1340 at the top of the slot 1330 provides additional room to accommodate tolerance extremes of other issues of a threshold bracket. The peak 1360 of the extending leg 1350 engage with an interior surface of the threshold curb to further effectuate a seal between the threshold gasket 1300 and the threshold curb. The extending flanges 1370 provide form multiple and redundant points of contact between the threshold gasket 1300 and a shower base. Such redundancy ensures a consistent and long lasting seal between the threshold curb and shower base.

The foregoing description of examples has been presented for purposes of illustration and description. It is not intended to be exhaustive or limiting to the forms described. Numerous modifications are possible in light of the above teachings. Some of those modifications have been discussed, and others will be understood by those skilled in the art. The examples were chosen and described in order to best illustrate principles of various examples as are suited to particular uses contemplated. The scope is, of course, not limited to the examples set forth herein, but can be employed in any number of applications and equivalent devices by those of ordinary skill in the art.

The invention claimed is:

1. A modular shower base system for assembling a shower base assembly for a shower, the system comprising:

at least one customizable and trimmable shower base having:

a first edge;

a second edge perpendicular to the first edge;

a third edge opposite the first edge and perpendicular to the second edge;

a fourth edge opposite the second edge and perpendicular to both of the first edge and the third edge; and a drain aperture defined in the shower base, the shower base being configured to be trimmed at or along one or more of the first edge, the second edge, the third edge, or the fourth edge to adjust at least one of a size of the shower base, a shape of the shower base, or a location of the drain aperture in the shower base relative to one or more of the first, second, third, or fourth edge, to accommodate a preexisting shower drain location;

a plurality of perimeter components configured to be affixed to one of the first, second, third, or fourth edges of the shower base, and further configured to couple one of the first, second, third, or fourth edges of the shower base to a shower enclosure; and a plurality of threshold components configurable to form a threshold along one or more of the edges of the base.

2. The modular shower base system of claim 1, wherein the at least one shower base comprises:

a first shower base that is 48 inches by 42 inches is size; and a second shower base that is 60 inches by 36 inches in size.

3. The modular shower base system of claim 2, wherein the drain aperture of the first shower base is located equidistant from the first edge and third edge and located equidistant from the second edge and fourth edge.

4. The modular shower base system of claim 2, wherein the drain aperture of the second shower base is located equidistant from the first edge and the third edge.

5. The modular shower base system of claim 4, wherein the drain aperture of the second shower base is located a first distance from the second edge and a second distance from the fourth edge, wherein the first distance is not equal to the second distance.

6. The modular shower base system of claim 1, wherein a shower enclosure can be a wall, a panel, or other finished or unfinished interior surfaces.

7. The modular shower base system of claim 1, wherein each of the plurality of perimeter components comprises:

a body;

an inner component attached to the body and formed from a polymeric material; and an outer component attached to the body and formed from a metal material.

8. The modular shower base system of claim 7, wherein for each of the plurality of perimeter components:

the inner component is attached to the body by an over molding process; and the outer component is attached to the body by an adhesive.

9. The modular shower base system of claim 7, wherein the body is formed from a polymeric material.

10. The modular shower base system of claim 7, wherein the body is formed from a metallic material.

11. The modular shower base system of claim 1, wherein each of the plurality of perimeter components is a single integral component comprising:

a first side configured to engage with the at least one shower base, the first side including a plurality of v-shaped recessions; and a second side arranged to engage with the shower enclosure, the second side including a recess and a plurality of apertures located in the recess.

12. The modular shower base system of claim 11, wherein for each of the plurality of perimeter components, the perimeter component can be attached to the shower base by either fasteners passing through the plurality of apertures, by an adhesive, or by a combination of fasteners and adhesive.

13. The modular shower base system of claim 12, wherein:

the v-shaped recessions increase the surface area of the first side to facilitate a more secure attachment when adhesive is used; and the recess in the second side is arranged to accommodate the head of a fastener such that the head of the fastener does not interfere with the engagement of the perimeter component with the shower enclosure.

14. The modular base system of claim 1, wherein the plurality of threshold components includes:

one or more threshold brackets;

one or more threshold gaskets; and one or more threshold curbs.

15. The modular base system of claim 14, wherein:

each threshold bracket includes:

a vertical extension, a v-shaped section opposite the vertical extension, and a u-shaped channel between the vertical extension and v-shaped section; and each threshold gasket includes:

a slot arranged to accommodate the vertical extension of the threshold bracket, and a body arranged to fit into the u-shaped channel of the threshold bracket.

16. The modular base system of claim 15, wherein the threshold gasket further includes a series of extending flanges.

17. The modular base system of claim 15, wherein each of the threshold curbs includes:

a top surface;

a rectangular channel arranged to accommodate the v-shaped section of the threshold bracket; and a downward extending leg arranged to fit into the u-shaped channel of the threshold bracket.

18. The modular base system of claim 17, wherein the top surface includes:

a first section that declines in a first direction; and a second section that declines in the second direction, wherein the angle of decline of the first section is less than the angle of decline of the second section.

19. The modular base system of claim 17, wherein the top surface is a declining surface.

20. A method of preparing, assembling, and installing components of a modular shower base, the method comprising:

selecting a location at which to install a shower;

selecting one of a plurality of shower bases;

selecting one or more perimeter components configured to be affixed to one or more outer perimeter edges of the selected shower base;

selecting one or more threshold components;

trimming at least one of a plurality of outer perimeter edges of the selected shower base to adjust at least one of the size or shape of the selected shower base to appropriate dimensions to accommodate a space available for the shower at the selected location;

trimming at least a length of the selected one or more perimeter components to appropriate dimensions to accommodate securing the perimeter components to the shower base; and trimming at least a length of the selected threshold components to appropriate dimensions to accommodate securing the threshold components to the shower base.

21. The method of claim 20, further comprising:

securing each of the selected one or more perimeter components to an edge of the shower base; and assembling each of the selected one or more threshold components into a threshold assembly.

22. The method of claim 21, wherein each of the selected one or more perimeter components is secured to an edge of the shower base using either a plurality of fasteners, adhesive, or a combination of fasteners and adhesive.

23. The method of claim 22, further comprising:

positioning the shower base in the space selected for a shower;

securing the shower base in place; and securing the threshold assembly to an edge of the shower base.

24. The method of claim 23, wherein the shower base is secured in place by securing at least one of the one or more perimeter components to a shower enclosure.

* * * * *